US006776815B2

(12) United States Patent
Kato et al.

(10) Patent No.: US 6,776,815 B2
(45) Date of Patent: Aug. 17, 2004

(54) PARTICULATE FILTER

(75) Inventors: Zenichiro Kato, Mishima (JP); Hiromichi Yanagihara, Gotenba (JP); Kazuhiko Shiratani, Susono (JP); Youichi Nagai, Itami (JP); Satoru Itsuaki, Itami (JP); Kohei Shimoda, Itami (JP); Kazutoshi Shibutani, Itami (JP)

(73) Assignees: Toyota Jidosha Kabushiki Kaisha, Toyota (JP); Sumitomo Electric Industries, Ltd., Osaka (JP)

( * ) Notice: Subject to any disclaimer, the term of this patent is extended or adjusted under 35 U.S.C. 154(b) by 82 days.

(21) Appl. No.: 09/959,275

(22) PCT Filed: Feb. 22, 2001

(86) PCT No.: PCT/JP01/01320

§ 371 (c)(1),
(2), (4) Date: Oct. 19, 2001

(87) PCT Pub. No.: WO01/63102

PCT Pub. Date: Aug. 30, 2001

(65) Prior Publication Data

US 2002/0157361 A1 Oct. 31, 2002

(30) Foreign Application Priority Data

Feb. 22, 2000 (JP) ..... 2000-045225
Jul. 24, 2000 (JP) ..... 2000-223144

(51) Int. Cl.[7] ..... B01D 46/00; B01D 39/20

(52) U.S. Cl. ..... 55/492; 55/282.3; 55/385.3; 55/486; 55/495; 55/498; 55/501; 55/502; 55/520; 55/521; 55/523; 55/527; 55/DIG. 10; 55/DIG. 30; 60/311

(58) Field of Search ..... 55/282.3, 282.2, 55/385.3, 486, 487, 490, 492, 501, 502, 520, 521, 523, 527, DIG. 10, DIG. 30, 495, 498; 60/303, 311

(56) References Cited

U.S. PATENT DOCUMENTS

| | | | | | |
|---|---|---|---|---|---|
| 4,278,454 | A | * | 7/1981 | Nemesi | 55/521 |
| 4,498,989 | A | * | 2/1985 | Miyakawa et al. | 55/492 |
| 5,110,561 | A | * | 5/1992 | Hitachi et al. | 55/520 |
| 5,405,422 | A | * | 4/1995 | Ueda et al. | 55/282.3 |
| 5,562,825 | A | * | 10/1996 | Yamada et al. | 55/520 |
| 5,851,249 | A | * | 12/1998 | Henda et al. | 55/521 |
| 5,902,364 | A | * | 5/1999 | Tokar et al. | 55/520 |
| 5,908,480 | A | * | 6/1999 | Ban et al. | 55/520 |
| 5,968,373 | A | * | 10/1999 | Choi | 55/487 |

FOREIGN PATENT DOCUMENTS

| | | |
|---|---|---|
| EP | 1-038-566 A2 | 9/2000 |
| JP | 58137423 | 8/1983 |
| JP | 58-137423 A | 8/1983 |
| JP | 02-37741 | 3/1990 |
| JP | 02259219 | 10/1990 |

(List continued on next page.)

*Primary Examiner*—Duane Smith
*Assistant Examiner*—Jason M. Greene
(74) *Attorney, Agent, or Firm*—Oliff & Berridge, PLC

(57) ABSTRACT

A particulate filter can be prevented from being damaged. The ashes can be removed from the particulate filter without by burning. A non-woven welding operation for a sealing portion can be simplified. The operability is enhanced by facilitating an insertion of a multi-layer body into a heat resisting container. The number of recycling processes executed when particulate matters such as soot are accumulated on the particulate filter is made as small as possible. A particulate filter 1 comprises an axial core 7 composed of a heat resisting metal, a multi-layer body 3 formed by winding said axial core with a multi-layer member into which a non-woven fabric 11 and a corrugated sheet 13 each composed of a heat resisting metal are tiered, and a heat resisting container 5 charged with said multi-layer body 3.

42 Claims, 27 Drawing Sheets

FOREIGN PATENT DOCUMENTS

| | | | | | |
|---|---|---|---|---|---|
| JP | 2-259219 | A | | 10/1990 | |
| JP | 04-203416 | | | 7/1992 | |
| JP | 05-044455 | | | 2/1993 | |
| JP | 5-288036 | A | | 11/1993 | |
| JP | 05288036 | | | 11/1993 | |
| JP | 07-310529 | | | 11/1995 | |
| JP | 07-332063 | | | 12/1995 | |
| JP | 08-080441 | | | 3/1996 | |
| JP | 08-243333 | | | 9/1996 | |
| JP | 9-262414 | | * | 10/1997 | ..... B01D/46/00 |
| JP | 9-262414 | A | | 10/1997 | |
| JP | 10-37740 | A | | 2/1998 | |
| JP | 10-220217 | | | 8/1998 | |
| JP | 11-62555 | A | | 3/1999 | |
| JP | 11-062555 | | * | 3/1999 | ..... F01N/3/02 |
| JP | 11159319 | | | 6/1999 | |
| JP | 11-159319 | A | | 6/1999 | |
| WO | WO 98/34015 | | | 8/1998 | |

* cited by examiner

%

| | COMPARATIVE EXAMPLE 1 | COUNTERMEASURE VERSION |
|---|---|---|
| TOWN-DRIVING MODE | 83 - 100 | 65 - 88 |
| HIGH-SPEED MODE | 72 - 100 | 56 - 89 |

PARTICULATE FILTER

TECHNICAL FIELD

The present invention relates to a particulate filter for scavenging particulate matters (which will hereinafter be abbreviated to PMs if not especially specified) typified by soot defined as suspended particulate matters contained in an exhaust gas of, e.g., a diesel engine.

BACKGROUND ARTS

The diesel engine has a high economical merit and is, while on the other hand, highly required to purge the exhaust gas of the PMs. What is known for attaining this is a technology of providing a particulate filter for scavenging the PMs in an exhaust system of the diesel engine so that the PMs are not discharged into the atmospheric air (see Japanese Patent Application Laying-Open Publication No.9-262414).

The particulate filter basically includes N-sheets of (N is an even-number of 2 or larger) composed of heat resisting metal fibers and having a filter function, and the same number of heat resisting metal plates as that of the non-woven fabrics, each having a widthwise dimension somewhat smaller than the non-woven fabric, taking a corrugated shape in vertical section and therefore generally called a corrugated sheet.

The following is an outline of the method of forming the particulate filter.

An elongate rectangular multi-layer member is formed by piling up alternately the corrugated sheets and the non-woven fabrics in same direction, and is thereafter wound in roll as to be a cylindrical shape (what the elongate rectangular multi-layer member is formed in the cylindrical shape will hereinafter be called a [cylindrical multi-layer body]).

Note that a configuration of the cylindrical multi-layer body is kept in the cylindrical shape owing to a rigidity of the corrugated sheet. Namely, the corrugated sheet functions as a bone member of the cylindrical multi-layer body.

Then, the cylindrical multi-layer body has a sealing portion that seals by welding the leading edges of the non-woven fabrics adjacent to each other in the radial direction, and a non-sealing portion that keeps open the leading edges of the non-woven fabrics similarly adjacent to each other, these sealing and non-sealing portions being formed alternately.

To describe it in depth, the cylindrical multi-layer body is formed alternately with the sealing portion at which the corrugated sheet positioned between the non-woven fabrics is closed and invisible when viewed from is one side end thereof, and with the non-sealing portion at which the corrugated sheet is visible because of its being opened. Then, the sealing portion and the non-sealing portion are also formed alternately at the other side end thereof. The positions of forming the sealing and non-sealing portions are, however, different at one side end and at the other side end.

Namely, with respect to a couple of adjacent non-woven fabrics with the sealing portions at one side end of the cylindrical multi-layer body, the other side end is provided with no sealing portion. With respect to another couple of adjacent non-woven fabrics with no sealing portion formed at one side end, the other side end is provided with the sealing portion.

As a result, portions with the corrugated sheets inserted into spaces, of which one side end closed and the other side end opened, surrounded by the non-woven fabrics, (hereinafter be called a [layer portion]), are formed spirally in multi-layers in the cylindrical multi-layer body. Then, the thus configured cylindrical multi-layer body is inserted into the heat resisting metal container having substantially the same diameter as an inside diameter of the exhaust pipe and opened at both of side ends thereof. The inner surface of the heat resisting metal container and the outer peripheral surface of the cylindrical multi-layer body, are welded at proper portions, thereby fixing the cylindrical multi-layer body to the heat resisting metal container. The particulate filter is thus formed. Note that the particulate filter is formed so that no gap is formed to the greatest possible degree between the cylindrical multi-layer body and the heat resisting metal container in order to ensure the durability against vibrations.

The particulate filter is attached to the exhaust pipe by fitting the filter into a joint portion between the exhaust pipes.

Further, the heat resisting metal container is charged with the cylindrical multi-layer body so as to not form any gap within the heat resisting metal container, and the exhaust gas flows through the cylindrical multi-layer body without any leakage. It can be therefore said that the outside diameter of the cylindrical multi-layer body has, though slightly smaller, substantially the same dimension as the inside diameter of the heat-resistant metal container.

The thus configured particulate filter attached to the exhaust pipe is coaxial with the exhaust pipe.

Then, in a state where the particulate filter is attached to the exhaust pipe, the exhaust gas flowing through the exhaust pipe towards the particulate filter enters the layer portion from the non-sealing portion provided upstream of the exhaust gas in the non-woven fabric, and thereafter flows downstream of the exhaust pipe. The downstream side within this layer portion is sealed by welding, and extremely minute gaps formed between the fibers of the non-woven fabric are closed at this portion. Accordingly, the exhaust gas flowing nowhere flows from the layer portion sealed downstream towards other layer portion adjacent to the former layer portion and having the non-sealing portion on the downstream side. At this time, the PMs are scavenged in between the minute gaps of the non-woven fabric, thereby purging the exhaust gas of the PMs.

The exhaust gas with the PMs removed flows into the other layer portion and is thereafter, because of the other layer portion with the non-sealing portion provided downstream and opened, discharged into the atmospheric air.

On the other hand, when a quantity of the PMs scavenged by the particulate filter becomes large enough to cause clogging in the metal fiber non-woven fabric, an exhaust resistance rises with the result that the flow of the exhaust gas becomes unsmoothed Besides, no further scavenging of the PMs can be attained.

Such being the case, the scavenged PMs are removed by periodically burning PMs with the heat of the exhaust gas or the heat of an electric heater, etc., thereby preventing the clogging. This serves to eliminate an obstacle against scavenging the PMs by the particulate filter. This is called a recycling of the particulate filter.

By the way, according to the prior art disclosed in Japanese Patent Application Laying-Open Publication No.9-262414, the elongate rectangular multi-layer member composed of the non-woven fabric and the corrugated sheet is wound in roll, and needed to slightly bend a start-of-winding portion of the elongate rectangular multi-layer member because of such a configuration. Therefore, an excessive stress occurs on the bent portion as the start-of-winding portion of the elongate rectangular multi-layer member, and as a result cracks and creases are, though minute, easy to form in that portion.

Further, when forming the cylindrical multi-layer body, though feasible to obtain a strength in the radial direction with the corrugated plate, the non-woven fabric and the corrugated plate are held in the axial direction only by a frictional resistance due to a contact therebetween with only an arrangement that the elongate rectangular multi-layer member is wound in roll by simply piling up the non-woven fabric and the corrugated sheet. Hence, if a pressure of the exhaust gas that acts in the axial direction abruptly changes, a deviation between the non-woven fabric and the corrugated plate might occur. If the deviation therebetween occurs, the rigidity of the cylindrical multi-layer body that is kept by the corrugated plates decreases, and it is considered that the cracks and the damages are caused in the cylindrical multi-layer body.

Next, the particulate filter is, as described above, coaxial with the exhaust pipe, and the outer peripheral portion of the cylindrical multi-layer body is welded to the heat resisting metal container.

On the other hand, the portion exhibiting the highest velocity (i.e., the highest pressure) of the flow of the exhaust gas within the exhaust pipe, is the axial core of the exhaust pipe, and this axial core is the easiest to receive an influence of exhaust pulses defined as pressure wave movements occurred within the exhaust pipe.

Hence, while the particulate filter is used for a long period, the central portion of the cylindrical multi-layer body is thrust downstream due to the influence of the pressure and then protruded, and gets deformed as if a tapered helical spring. Then, if the thrust force acts more than the rigidity of the cylindrical multi-layer body, the particulate filter comes into a fracture.

Further, if the particulate plate is used over a long period of time, it is considered that the welding of the sealing portion provided on the downstream side of the cylindrical multi-layer body, might be taken off due to fluctuations in pressure that are caused by the exhaust heat and the exhaust pulses. As a result, the sealing portion gets open, and this does not make much difference from the exhaust gas just flowing through the particulate filter with nothing obstructing. Then, a rate of scavenging the PMs with the non-woven fabric extremely decrease, and the filter function of the particulate filter might decline.

In addition, the exhaust gas contains a so-called ash having an influence as little as harmless on a human body, which contains, as a main component, calcium sulfur trioxide (lime) defined as a combustible component of the engine oil. The ash is also a substance adhered to the particulate filter. Therefore, if the ash is adhered to the particulate filter, a further increase in the exhaust resistance is brought about. Hence, the ash, if adhered to the particulate filter, is required to be removed.

What can be considered as a removing method thereof is burning that utilizes the heat of the exhaust gas and so on. In the case of the soot as a typical example of the PM, the soot can be burnt with the heat on the order of 600° C. However, the ash cannot be burnt if not over 1000° C. Besides, if the heat as high as 1000° C. is brought into the exhaust system, though the ash can be burnt, thermal damages are exerted on and exhaust system structures such as the particulate filter itself, a catalyst converter, etc.

It is therefore an important subject how the ash is removed from the particulate filter.

The present inventors of this application discovered as a result of having performed repeatedly tests and studies about the particulate filter that a rate of the ashes adhered to the surface of the non-woven fabric differs depending on a difference between metal fibers constituting the non-woven fabric.

Further, the present inventors discovered a specific non-woven fabric capable of remarkably reducing a quantity of deposition of the ash even if less than 1000° C. defined as an ash combustible temperature, for example, even at approximately 600° C. defined as a soot combustible temperature.

In addition, the present inventors pursued a cause that the ash is not deposited on this specific non-woven fabric, and discovered that the PM typified by the soot and the ash permeate into the fibers of the non-woven fabric.

Moreover, it proved that a void ratio (a ratio of volume of voids contained in the non-woven fabric to unit capacity of the non-woven fabric with respect), and a line diameter and a thickness of the metal fiber of the specific non-woven fabric fall within specified ranges.

Further, the present inventors elucidated the reason why the ash is hard to deposit on the non-woven fabric if at least the void ratio, and the line diameter among the void ratio, the line diameter and the thickness fall within the specified ranges described above.

Still further, since the operation of welding the non-woven fabric for sealing is done at a very minute portion, the operation being simplified as much as possible is also desired.

In addition, generally the exhaust pipe of the internal combustion engine accommodates the heat resisting container, and therefore the container takes a cylindrical shape as its outer configuration. When the cylindrical multi-layer body assuming the similar shape to the cylindrical heat resisting container is inserted into this container, if a dimension of the inside diameter of the heat resisting container is in close proximity to a dimension of the outside diameter of the cylindrical multi-layer body, there arises a problem that these two members are fitted to each other with a difficulty.

Further, it is desirable to provide a technology capable of reducing the number of the recycling processes of the particulate filter.

Moreover, it is considered that a durability of the particulate filter might decline due to an occurrence of the thermal stress caused by a difference in thermal expansion between the exhaust pipe where the particulate filter is disposed and the constructive members of the particulate filter.

It is an object of the present invention, which was devised under such circumstances, to provide a technology capable of, for instance, preventing damages to the particulate filter, removing the ash from the particulate filter without by burning, simplifying the operation of welding the non-woven fabric for sealing, improving an operability by facilitating an insertion of the multi-layer body into the heat resisting container, reducing the number of the recycling processes executed when the particulate matters such as the soot are accumulated on the particulate filter, and enhancing a durability of the particulate filter.

DISCLOSURE OF THE INVENTION

To accomplish the above object, a particulate filter of the present invention adopts the following means.

(1) A particulate filter according to the present invention comprises an axial core composed of a heat resisting metal, a multi-layer body formed by winding the axial core with a multi-layer member into which a non-woven fabric and a corrugated sheet each composed of a heat resisting metal are tiered, and a heat resistant container charged with the multi-layer body.

Herein, the [non-woven fabric] is a fabric formed by mechanically, chemically and thermally processing fiber sheets without taking the form of yarns and joining them by adhesives and a fusing force of the fibers themselves.

Further, as the particulate filter is provided in the exhaust system of the internal combustion engine, said [heat resisting container] is resistible against the high heat of the exhaust gas and has an inlet and an outlet through which the exhaust gas can flow inside. Further, it is desirable that a diameter of the heat resisting metal container be substantially the same as an inside diameter of the exhaust pipe of the engine.

According to the present invention, when forming the cylindrical multi-layer body, the multi-layer member is wound on the axial core. Hence, when starting winding a leading edge of the multi-layer member to be wound on the axial core, a bending degree (curvature) needed to wind the leading edge of the multi-layer member can be set larger by a degree of existence of the axial core than when starting winding the leading edge in a state where there is provided no axial core. Therefore, the minute cracks and creases are hard to occur in the start-of-winding portion (that is, the leading edge) of the multi-layer member, in other words, in the portion of the multi-layer member that comes into contact with the periphery of the axial core when forming the cylindrical multi-layer body by winding the axial core with the multi-layer member. Hence, the durability of the central portion of the cylindrical multi-layer body can be improved.

(2) In the case of the item (1) described above, the multi-layer body takes a cylindrical shape, of which two side ends are formed alternately with a sealing portion for sealing leading edges of the non-woven fabrics adjacent to each other and a non-sealing portion opened in the radial direction, and, with the sealing and non-sealing portions ensured, a bag-shaped layer portion with its one side end closed and the other side end opened is formed.

(3) In the case of the item (1) or (2) described above, it is preferable that the particulate filter further comprises axial core movement preventing means for preventing the axial core from moving in the axial direction within the heat resisting container.

In this case, for example, when the particulate filter is installed in the engine exhaust system, even if a peripheral portion (the central portion of the cylindrical multi-layer body) containing the axial core with respect to the cylindrical multi-layer body receives an influence of the pressure caused by exhaust pulses, etc. and is thrust towards the downstream side, the axial core movement preventing means prevents the axial core from moving. Accordingly, the axial core does not protrude from the heat resisting container, so that the cylindrical multi-layer body gets neither deformed nor fractured. Hence, the particulate filter is not damaged.

(4) In the case of the item (3) described above, it is preferable that the axial core movement preventing means is a connection member for fixedly connecting the heat resisting container to the axial core of the cylindrical multi-layer body.

With this contrivance, when the particulate filter is installed in the engine exhaust system, even if the central portion of the cylindrical multi-layer body is thrust downstream by the influence of the pressure caused due to exhaust pulses, etc., the connection member becomes a hindrance to prevent the movement of the axial core. Accordingly, the axial core does not protrude from the heat resistant container, and the cylindrical multi-layer body gets neither deformed nor fractured. Hence, the particulate filter can be prevented from being damaged.

(5) In the case of the item (4), it is preferable that the heat resistant container is a container of which two side ends are opened, and the connection member is fitted to an opening at one side end of the heat resistant container and includes a ring portion facing to an opening edge of one side end of the heat resistant container, a boss portion facing to the axial core of the cylindrical multi-layer body, and arm portions connecting the ring portion to the boss portion and facing to portions excluding the axial core with respect to the cylindrical multi-layer body.

In this case, the connection member is attached to the opening at one side end of the heat resisting container with both side ends opened, charged with the cylindrical multi-layer body. In the connection member, the boss portion faces to the axial core of the cylindrical multi-layer body and is fixed to the ring portion via the arm portions. Therefore, even if the axial core is thrust downstream by the influence of the pressure due to the exhaust pulses, etc., the axial core impinges on the boss portion. The boss portion is fixed to the ring portion via the arm portions, i.e., the axial core is hindered by the component of the connection member and is unable to move, and hence the whole cylindrical multi-layer body including the axial core at its central portion does not protrude from the heat resistant container. Accordingly, the particulate filter is not damaged.

Further, the number of the arm portions of the connection member is not limited if capable of fixing the boss portion to the ring portion. If the number of the arm portions is too many, however, the arm portions hinder the flow of the exhaust gas, with the result that an exhaust resistance increases. According to the tests performed by the present inventors, approximately four pieces of arm portions are considered preferable.

(6) In the case of the item (5), it is preferable that the boss portion includes a joining portion joining the boss portion to the axial core. With this contrivance, the boss portion is hard to come off the axial core, so that the protrusion of the axial core can be surely restrained.

Note that there can be considered some structures of the joining portion for joining the boss portion to the axial core, however, for example, fitting means for fitting the boss portion to the axial core may be exemplified.

(7) In the case of the item (5) or (6), it is preferable that the arm portion takes a rectilinear shape.

Herein, for instance, a shape like a cross centering the boss portion is preferable as the rectilinear shape.

(8) In the case of the item (5) or (6), it is preferable that the arm portion further takes a curvilinear shape.

A shape like an S-shape centering the boss portion is preferable as the curvilinear shape.

Herein, the arm portion taking the rectilinear shape described above is compared with the arm portion taking the curvilinear shape.

A length of the rectilinear arm portion is shorter than that of the curvilinear arm portion, and therefore a rate of the arm portions facing to the cylindrical multi-layer body is smaller. Hence, it can be said that there is less hindrance against the flow of the exhaust gas, resulting in a decrease in the exhaust resistance. Accordingly, the exhaust gas gains a smooth flow, however, a force for restraining a protrusion of the cylindrical multi-layer body from the heat resistant container decreases.

In the case of the curvilinear arm portions taking the S-shape, a length of each of the arm portions that connect the ring portion to the boss portion is larger than the rectilinear arm portion. Hence, the rate of the arm portions facing to the cylindrical multi-layer body increases, so that there rises the degree to which the flow of the exhaust gas flowing through cylindrical multi-layer body is restrained by the arm portions. Hence, the exhaust resistance increases corresponding thereto. Therefore, the flow of the exhaust gas gets unsmoothed. There, however, increases the force of restraining the protrusion of the cylindrical multi-layer body from the heat resistant container. Further, the curvilinear arm portions take a larger allowable difference in dimension due to the thermal expansion than the rectilinear arm portions, thereby providing a higher usability.

Thus, the rectilinear and curvilinear arm portions have their advantages and disadvantages. Whatever shape the arm portion may take, the boss portion that restrains the movement of the axial core is fixed by the arm portion, so that the strength of the boss portion rises. Further, the force of restraining the central portion of the cylindrical multi-layer body facing the boss portion from protruding downstream out of the heat resistant container rises.

(9) In the case of the item (6), the particulate filter is installed in an exhaust system of an internal combustion engine and used as a scavenger for scavenging mainly particulate matters contained in the exhaust gas, the axial core has a hollow of which two side ends are opened, the hollow containing a partition wall for partitioning the hollow into two, when the particulate filter is installed in the engine exhaust system, the partition wall partitions the hollow into an upstream-sided hollow opened upstream of the exhaust system but closed downstream thereof and a downstream-sided hollow opened downstream but closed upstream, the joining portion serves as a fitting shaft fitted into the downstream-sided hollow, and a substantial lengthwise dimension of the fitting shaft is set somewhat larger than a lengthwise dimension of the downstream-sided hollow, the fitting shaft and the axial core are composed of separate members each having a different elasticity, and a gap is formed between the heat resistant container and the connection member due to a dimensional difference between the lengthwise dimension of the fitting shaft and the lengthwise dimension of the downstream-sided hollow when the fitting shaft is fitted into the down-stream-sided hollow.

Herein, the [substantial lengthwise dimension of the fitting shaft] is a lengthwise dimension of the fitting shaft protruding towards the upstream side of the axial core from the boss portion of the connection member.

According to the present invention, the lengthwise dimension of the fitting shaft is set somewhat larger than the lengthwise dimension of the downstream-sided hollow, and the fitting shaft and the axial core are composed of the separate members each having a different elasticity. When the fitting shaft is fitted into the downstream-sided hollow, the gap is formed between the heat resistant container and the connection member due to the dimensional difference between the lengthwise dimension of the fitting shaft and the lengthwise dimension of the downstream-sided hollow. Therefore, if, for instance, the periodic vibrations caused by the external force, i.e., the vibrations due to the fluctuations in pressure caused by, e.g., the exhaust pulses are transferred to the particulate filter, the axial core easy to largely receive the influence thereof and the fitting shaft fitted into the downstream-sided hollow, oscillate within the gap due to the difference in elasticity therebetween.

Then, the cylindrical multi-layer body including the axial core also oscillates, and hence, if the ash is adhered to the cylindrical multi-layer body at that time, the ash is shaken off, thereby obviating the clogging in the non-woven fabric. Accordingly, the ash can be removed from the particulate filter without by burning.

(10) In the case of the item (9) described above, it is preferable that a plate-like elastic member is interposed in the gap.

Herein, the [elastic member] can be exemplified such as a gasket composed of, e.g., a ceramic fiber. Further, the preferable elastic member has its shape coincident with the connection member.

Then, with this kind of gasket interposed in the gap, it is possible to relax an impact sound emitted when the connection member impinges upon the heat resistant container due to the vibrations. Further, the impact sound is further relieved by properly selecting the material that forms the gasket without being limited to the ceramic fiber, and the clogging can be further prevented.

(11) In the case of the item (3), it is preferable that when installed in the exhaust system of the internal combustion engine, the axial core is formed with a hollow opened upstream thereof and extending downstream in the axial direction, and a through-hole formed through a peripheral wall of the axial core and communicating with the hollow and the multi-layer member along the axial core, and the axial core is thereby provided with the axial core movement preventing means.

In this case, the exhaust gas flows into the hollow within the axial core from the open side end provided by making open the upstream-side end of the axial core, and flows out to the multi-layer member along the axial core via the through-hole. The exhaust gas flowing out to the multi-layer member is discharged into the atmospheric air from the adjacent bag-shaped layer portion surrounded by the non-woven fabric and formed with the non-sealing portion provided downstream.

Therefore, the exhaust gas flows out to the multi-layer member along the axial core, i.e., to the bag-shaped layer portion adjacent most to the axial core via the through-hole of the axial core. With this exhaust gas, the axial core is correspondingly hard to receive the external force such as the pressure of its being thrust downstream of the exhaust gas. Accordingly, the axial core can be prevented from protruding out of the heat resistant container. Hence, there does not occur the damages to the particulate filter due to the deformation and the fracture of the cylindrical multi-layer body.

(12) In the case of the item (11), it is preferable that the through-hole is an oblique hole formed obliquely in the axial core in a way that extends from the upstream side of the engine exhaust system toward the downstream side thereof, and an upstream-sided opening thereof is disposed on the side of the hollow, and a downstream-sided opening thereof is disposed on the side of the multi-layer member wound on the axial core.

With this arrangement, the exhaust gas flowing to the axial core from upstream of the engine exhaust system more smoothly flows through the through-hole than in the case of the through-hole holed at the right angle to the central axis of the axial core.

Namely, the exhaust gas becomes much easier to flow out to the multi-layer member along the axial core, i.e., to the bag-shaped layer portion adjacent most to the axial core via the through-hole of the axial core. With the exhaust gas, it is therefore possible to correspondingly reduce the external force such as the pressure of thrusting the axial core towards the downstream side of the exhaust gas. Hence, the stress occurred on the axial core can be correspondingly decreased. Therefore, it is feasible to decrease the pressure of thrusting downstream the central portion of the cylindrical multi-layer body including the axial core, so that the damage to the particulate filter can be further prevented.

(13) A particulate filter according to the present invention comprises an axial core composed of a heat resisting metal, a multi-layer body formed in a cylindrical shape by winding the axial core with a multi-layer member into which a non-woven fabric and a corrugated sheet each composed of a heat resistant metal are layered, and a heat resisting container charged with the cylindrical multi-layer body, wherein when installed in an exhaust system of an internal combustion engine, the axial core is formed with a hollow opened downstream thereof and extending upstream in the axial direction, and a through-hole formed through a peripheral wall of the axial core and communicating with the hollow and the multi-layer member along the axial core.

In this case, the peripheral wall of the axial core has the through-hole communicating with the hollow and the multi-layer member along the axial core, so that the exhaust gas flowing into the cylindrical multi-layer body contains the exhaust gas flowing into the hollow from outside of the axial core via the through-hole. Therefore, a quantity of the exhaust gas flowing into the cylindrical multi-layer body decreases by a quantity of the exhaust gas flowing into the hollow, and the exhaust gas pressure at the portion formed with the cylindrical multi-layer body using the multi-layer member decreases correspondingly.

Hence, the pressure on the non-woven fabric of the cylindrical multi-layer body is reduced, and hence the welding of the sealing portion secured even by this welding is not taken off. Accordingly, this is effective in preventing the damage to the particulate filter.

Note that there arises such skepticism that the exhaust gas flowing into the hollow of the axial core via the through-hole might be discharged into the atmospheric air in a state where the no-woven fabric does not sufficiently scavenge the PMs. The multi-layer member wound on the axial core, however, covers also the through-hole. Hence, the exhaust gas, after flowing through the through-hole, flows through the non-woven fabric defined as the constructive member of the multi-layer member. Consequently, there is no necessity of having such a concern that the PMs contained in the exhaust gas discharged into the atmospheric air via the hollow of the core through the through-hole, might not be scavenged.

(14) In the case of the item (13), it is preferable that the through-hole is an oblique hole formed obliquely in the axial core in a way that extends from the upstream side of the engine exhaust system toward the downstream side thereof, and an upstream-sided opening thereof is disposed on the side of the multi-layer member wound on the axial core and a downstream-sided opening thereof is disposed on the side of the hollow.

In this case, the exhaust gas flowing towards the axial core from the multi-layer member flows through the through-hole more smoothly than in the case of the through-hole being holed at the right angle to the central axis of the axial core, and enters the hollow. Namely, the exhaust gas pressure at the portion formed with the cylindrical multi-layer body using the multi-layer member is further reduced. As a result, correspondingly a larger amount of exhaust gas can be discharged into the atmospheric air via the through-hole, so that a load upon the sealing portion can be further reduced. This is therefore further effective in preventing the damage to the particulate filter.

(15) In the case of the items (11) through (14), it is preferable that a rate at which a diameter of the axial core occupies a diameter of the cylindrical multi-layer body is within a range of 15 to 27%.

If the diameter of the axial core falls within this range, in the case of the items (11) and (12) described above, it proved from the tests performed by the present inventors that the force of thrusting the axial core is effectively reduced.

Further, if the diameter of the axial core falls within this range, in the case of the items (13) and (14) described above, it proved from the tests performed by the present inventors that the pressure applied on the non-woven fabric is decreased.

(16) A particulate filter according to the present invention comprises an axial core composed of a heat resisting metal, a multi-layer body formed by winding the axial core with a multi-layer member into which a non-woven fabric and a corrugated sheet each composed of a heat resisting metal are tiered, and a heat resisting container charged with the multi-layer body, wherein the multi-layer member has the corrugated sheets disposed on one surface of the non-woven fabric folded double in a widthwise direction so as to take a folded shape and at a portion between the folded surfaces.

The particulate filter according to the present invention is configured such that the multi-layer member wound on the heat resisting metal axial core to form the cylindrical multi-layer body, has the corrugated sheets disposed respectively on one surface of the non-woven fabric folded double in the widthwise direction in a folded shape and at a portion between the folded surfaces thereof. Then, the multi-layer member simply wound in roll has its one side end that is all in a non-sealing state at this stage. At the other side end thereof, however, the portion including the creases of the non-woven fabric, in other words, the portion corresponding to a boundary line between the two surfaces facing to each other in the folded non-woven fabric, is already substantially in the sealing state. Therefore, the necessity for the welding operation for forming the sealing portion can be eliminated correspondingly. Note that the folded non-woven fabric is wound in roll, so that the portion between substantially the sealing portions is the non-sealing portion.

Hence, the welding operation for forming the sealing portion may be done for only one side end of the multi-layer member wound in roll, so that the operation efficiency is highly improved. Note that the [crease] is not limited to a distinctive crease formed when folding the non-woven fabric, and a side portion formed with some width when folding back the non-woven fabric without the distinctive crease may come under the category of the [crease].

(17) In the case of the item (16) described above, it is preferable that the particulate filter is installed in an exhaust system of an internal combustion engine and used as a scavenger for scavenging mainly particulate matters contained in the exhaust gas, and is also installed in the engine exhaust system in a state where the creases of the folded non-woven fabric are directed downstream of the engine exhaust system.

In this case, the creased portion does not require the welding for sealing as explained above. Hence, the creased portion is not formed by making integral the originally separate non-woven fabrics adjacent to each other by welding as in the case of the conventional non-woven fabrics. Therefore, even if the fluctuations in pressure due to the exhaust heat and the exhaust pulses act on the creased portion, this creased portion does not open. Hence, it is feasible to prevent the PM scavenging rate from extremely decreasing.

(18) In the case of the item (17), a bag-shaped layer portion with its one side end closed and the other side end opened is formed by alternately forming a sealing portion for sealing leading edges of the non-woven fabrics adjacent to each other in the radial direction on one side end side of the multi-layer member and a non-sealing portion opened.

(19) In any one case of any one the items (1) through (18), it is preferable that the particulate filter is installed in an exhaust system of an internal combustion engine and used as a scavenger for scavenging mainly particulate matters contained in the exhaust gas, and, in this case, a flow-past hole that lets the exhaust gas through is formed at a downstream-sided end of a narrower passageway than other passageways among the passageway within the particulate filter through which the exhaust gas flows.

Herein, the [passageway within the particulate filter through which the exhaust gas flows] includes not only the air space surrounded by the non-woven fabrics contained in the cylindrical multi-layer body, i.e., the bag-shaped layer portion with one side end closed and the other side end opened, but also the air space formed outermost between the cylindrical multi-layer body and the heat resistant container. The air space disposed outermost is generally narrower than the air space surrounded by the non-woven fabrics contained in the cylindrical multi-layer body. This is because if the air space formed between the inner surface of the cylindrical multi-layer body and the outer surface of the heat resistant container is large, the cylindrical multi-layer body is easy to impinge on the heat resistant container due to the vibrations, and the above contrivance intends to prevent this impingement. Further, with this structure taken, the capacity of the cylindrical multi-layer body can be made as larger as possible, a PM scavenging area widens, with the result that the exhaust resistance when scavenging the PMs can be decreased.

A fluid flows first to a wide area and to a narrow area afterward. Namely, to describe it in the case of the exhaust gas flowing through the particulate filter, the exhaust gas does not flow through the narrow passageway until it comes to a state the ashes and PMs form the clogging at first in the wide passageway and the exhaust gas can not flow through this wide passageway anymore. Hence, if there is provided the flow-past hole through which the exhaust gas can flow straight to the downstream side of the narrow passageway through which to flow the exhaust gas, even if the clogging is caused, the exhaust gas flows straight through this flow-past hole, so that any damage to the particulate filter is not brought about.

However, there is a problem that is caused by only passing the exhaust gas through the narrow passage because the passage is narrow, even if a quantity of the exhaust gas flowing therethrough is small. Accordingly, it is of importance that a recycling of the particulate filter is performed before the exhaust gas flows through the flow-past hole.

(20) In the case of the item (19), it is preferable that the narrow passageway is filled with a porous substance having the maximum void ratio at which the particulate matters can be scavenged.

With this contrivance, the exhaust gas is made to simply pass through the narrow passageway, and besides it is possible to scavenge at least the PMs.

(21) A particulate filter according to the present invention comprises an axial core composed of a heat resisting metal, a multi-layer body formed in a truncated cone shape by winding the axial core with a multi-layer member into which a non-woven fabric and a corrugated sheet each composed of a heat resisting metal are tiered, and a heat resistant container charged with the multi-layer body taking the truncated cone shape.

The heat resisting container is generally accommodated in the exhaust pipe of the internal combustion engine and therefore takes the cylindrical shape in its outer configuration. Because of this configuration, the cylindrical multi-layer body is inserted into the cylindrical heat resisting container with a difficulty. The multi-layer member of the particulate filter according to the present invention, however, takes the truncated cone shape, and therefore the leading edge of the multi-layer body is hard to come into contact with the heat resistant container. Hence, the advantage is that the multi-layer body is easily inserted into the heat resistant container.

(22) In the case of the item (21), the truncated cone-shaped multi-layer body has its two side ends formed alternately with a sealing portion for sealing leading edges of the non-woven fabrics adjacent to each other and a non-sealing portion opened in the radial direction. With the sealing and non-sealing portions ensured, a bag-shaped layer portion with its one side end closed and the other side end opened, having a inclined surface taking a fan shape from the closed side towards the opened side, and the corrugated plate is disposed in a fan-shape corresponding to the fan-shaped inclined surface within the layer portion.

On the other hand, in the case where the particulate filter scavenges the PMs, if the multi-layer body takes the cylindrical shape, the PMs tend to concentrate comparatively on the downstream side in the flowing direction of the exhaust gas in the bag-shaped layer portion, so that the clogging of the non-woven fabric is easy to occur at this portion. Hence, if there excessively increases the stress at the portion, where the clogging easily occurs, in the bag-shaped layer portion, the stress greater than the rigidity us generated at the tail edge of the bag-shaped layer portion, resulting in a damage such as a fracture to this tail edge.

In the particulate filter of the present invention, however, the tail edge of the bag-shaped layer portion is larger (wider) than the leading edge and therefore has a higher rigidity. Hence, the bag-shaped layer portion has an increased rigidity on its downstream side. For this reason, even if the pressure on the downstream side of the bag-shaped layer portion rises when scavenging the PMs on the downstream side, there is no possibility in which the crack and damage occurs in the high-pressure portion because of this portion securing the high rigidity.

Further, the bag-shaped layer portion includes the fan-shaped inclined surface, so that a flowing force of the exhaust gas impinging obliquely upon the inclined surface is decomposed into a component force (vertical component force) vertical to a thicknesswise direction of the bag-shaped layer portion, and a component force (parallel component force) parallel to the surface of the bag-shaped layer portion.

On the other hand, when the multi-layer body takes the cylindrical shape as described above, the exhaust gas entering in the longitudinal direction of the bag-shaped layer portion impinges on the tail edge of the bag-shaped layer portion, and the PMs are gradually scavenged by the non-woven fabric. Especially the leading edge (downstream side) of the non-woven fabric forming the bag-shaped layer portion, however, the PMs are hardly scavenged.

By contrast, according to the particulate filter of the present invention, as described above, the bag-shaped layer portion has the fan-shaped inclined surface, so that the flowing force F of the exhaust gas impinging upon the leading edge of the non-woven fabric is decomposed into the vertical component force and the parallel component force. With the action of the vertical component force, the exhaust gas flows to respective areas within the non-woven fabric. Hence, it is possible to scavenge the PMs substantially uniformly over the whole non-woven fabric. It is therefore feasible to highly effectively restrain the occurrence of the clogging in concentration on the tail edge side of the bag-shaped layer portion.

If the clogging is caused in concentration at one portion of the bag-shaped layer portion as at the tail edge of the bag-shaped layer portion, the recycling process of the particulate filter must be executed each time. The particulate filter of the present invention is, however, capable of scavenging the PMs substantially uniformly over the whole non-woven fabric, and hence there may be correspondingly a less frequency of executing the recycling process of the particulate filter.

The recycling process is, as already described, the process for eliminating a trouble in the PM-scavenging of the particulate filter by periodically burning and thus removing the scavenged PMs in a way that makes the use of the heat of the exhaust gas and of the electric heater, etc. and thereby preventing the clogging. Therefore, it can be understood that a decreased frequency of executing this recycling process leads to an improved fuel consumption, and works highly effectively on reducing a quantity of the power consumption.

Based on such a point of view, the particulate filter is installed in the exhaust system. In this case, the following structure may be taken.

(23) In the case of the item (22), the particulate filter is attached to the exhaust system in a state where a large-diameter portion of the truncated cone-shaped multi-layer body is positioned downstream of the exhaust system. With this structure taken, the stress applied on the non-woven fabric disposed outermost of the multi-layer body becomes a compression stress due to the pressure of the exhaust gas. Reversely when attached on the upstream side, the stress on the non-woven fabric becomes a tensile stress. It is known from the tests performed by the present inventors that the non-woven fabric has a greater compression intensity than a tensile intensity, and the former structure described above improves the durability against the pressure of the exhaust gas.

(24) In the case of any one of the items (2) to (12), (19), (20) and (23), it is preferable that plural sheets of non-woven fabrics each having a different void ratio are layered integrally into one sheet of non-woven fabric taking a multi-layered structure, the multi-layer body is composed of the non-woven fabric and the corrugated plate, and the non-woven fabric taking the multi-layered structure with respect to the bag-shaped layer portion defined as a constructive member of the multi-layer body is formed so that an void ratio of the single non-woven fabric decreases stepwise from the single non-woven fabric disposed on an inlet side of the exhaust gas towards the single non-woven fabric disposed on an outlet side of the exhaust gas.

In the particulate filter of the present invention, the void ratio is not uniform but gradually decreases from the exhaust gas inlet side of the non-woven fabric towards the exhaust gas outlet side thereof. The PM having a comparatively large particle size is scavenged by the non-woven fabric having the large void ratio, and the PM having a small particle size is scavenged by the non-woven fabric having the small void ratio. The PM having an intermediate particle size is scavenged by the non-woven fabric the intermediate void ratio. Therefore, the PMs are scavenged uniformly over the whole non-woven fabric without concentrating on one portion of the non-woven fabric.

(25) In the case of any one of the items (1) through (24), it is preferable that the non-woven fabric is formed so that a line diameter of the metal fiber constituting the non-woven fabric is set within a range of 10 to 50 $\mu$m, and the void ratio defined as a capacity ratio of the gaps contained therein to a unit volume of the non-woven fabric is set to any one of the void ratios within a range of 50 to 85%.

It is understood from the tests carried out by the present inventors that when the line diameter and the void ratio fall within these ranges, the ashes are deposited with the difficulty, and that the ashes produced permeate into the metal fibers. If the void ratio is changed stepwise, it is desirable that the void ratio be set within the following range.

(26) In the case of the item (24), the stepwise change in the void ratio is set within a range of 80 to 60%.

(27) In the case of the items (25) and (26), it is preferable that a thicknesswise dimension of the non-woven fabric is within a range of 0.2 to 1.0 mm.

In this case, the thickness of the non-woven fabric applied to the multi-layer member may fall within the dimension range described above irrespective of whether the non-woven fabric takes the multi-layered structure or the mono-layered structure.

(28) In the case of any one of items (2) through (12), (18) through (21), and (25), it is preferable that two sheets of non-woven fabrics each having a different void ratio are layered integrally into one sheet of non-woven fabric taking a two-layered structure, the multi-layer body is composed of the non-woven fabric and the corrugated sheet, and the non-woven fabric taking the two-layered structure with respect to the bag-shaped layer portion defined as a constructive member of the multi-layer body is formed so that an void ratio of the non-woven fabric disposed on the inlet side of the exhaust gas than that of the non-woven fabric disposed on the outlet side of the exhaust gas.

In this case also, the approach is the same as that shown in the item (24), wherein the PMs can be scavenged uniformly over the whole non-woven fabric without concentration on one portion of the non-woven fabric.

(29) In the case of the item (28), it is desirable that the void ratios of the non-woven fabrics disposed on the inlet and outlet sides of the exhaust gas are set to 80% and 60%, respectively. The tests by the present inventors prove that if the void ratio falls within this range, there is shown a high efficiency of scavenging the PMs.

(30) In the case of any one of the items (2) through (12), (18) through (20), and (24), it is preferable that the non-woven fabric takes an integral hierarchical structure of which the void ratio changes stepwise, the multi-layer body is composed of the non-woven fabric and the corrugated sheet, and the non-woven fabric with respect to the bag-shaped layer portion defined as a constructive member of the multi-layer body is formed so that the void ratio gradually decreases from the inlet side of the exhaust gas towards the outlet side of the exhaust gas.

In this case, the arrangement is not that the plurality of non-woven fabrics each having a different void ratio are layered integrally into one sheet of non-woven fabric but that the void ratio is changed within one sheet of non-woven fabric. The effect thereof is not limited to the effect given in the item (24) described above but embraces an effect that the plural sheets of single non-woven fabrics are not required to be combined into one sheet of non-woven fabric, and therefore the operation efficiency can be enhance correspondingly.

(31) In the case of the item (30), it is desirable that the void ratio changes so as to gradually decrease within a range of 80% to 60%. If the void ratio is within this range, the tests by the present inventors proved that there is shown the high efficiency of scavenging the PMs.

(32) In the case of any one the items (1) through (31), it is desirable that an opening edge of one side end of the heat resistant container charged with the multi-layer body is provided with a supporting member for supporting the multi-layer body in the heat resistant container.

Herein, the supporting member is not schemed to make the multi-layer body unmovable by fixing it to the heat resistant container. The supporting member is provided with a scheme of obviating the clogging in the non-woven fabric by shaking off the ashes adhered to the cylindrical multi-layer body in a way that oscillates the multi-layer body with the vibrations such as the pulses. Hence, the supporting member may be exemplifies as follows.

(33) In the case of the item (32) given above, it is desirable that the supporting member includes a holding piece for supporting an outer peripheral edge of the multi-layer body in a state where the outer peripheral edge is sandwiched in between the heat resistant container and the holding piece itself.

(34) In the case of the items (1) through (33), it is desirable that the particulate filter is installed in an exhaust collective pipe.

(35) In the case of the items (1) through (34), the particulate filter is installed in an exhaust pipe, and an adiabatic space is provided between the exhaust pipe and the cylindrical multi-layer body. A size of an adiabatic space formed between the exhaust pipe and the cylindrical multi-layer body is determined a size of an interval between the inside diameter of the exhaust pipe and the outside diameter of the heat resistant container.

In this case, the adiabatic space serves to restrain an occurrence of a thermal stress caused due to a difference in thermal expansion between the cylindrical multi-layer body rising in temperature when burning the PMs and the exhaust pipe exposed to the outside. Further, the periphery of the cylindrical multi-layer body is surrounded with the adiabatic space, thereby enhancing a temperature retaining capacity when burning the PMs so as to burn the PMs at a high efficiency.

(36) In the case of the item (35), the cylindrical multi-layer body is inserted into a cylindrical member composed of a heat resistant metal, and an adiabatic space is provided between the cylindrical member and the heat resistant container. Namely, in this case, the adiabatic spaces are provided between the cylindrical multi-layer body and the heat resistant container, and between the heat resistant container and the exhaust pipe.

A size of the adiabatic space formed between the cylindrical member and the heat resistant container is determined by a difference in dimension between the outside diameter of the cylindrical member and the inside diameter of the heat resistant container. Then, it is preferable that the sealing is provided at the downstream-sided end of the adiabatic space formed between the cylindrical member and the heat resistant container so that the exhaust gas is not discharged directly into the atmospheric air.

Further, it is desirable that the cylindrical member is thick enough to support the cylindrical multi-layer body, and that a heat capacity thereof is as small as possible. The tests performed by the present inventors proved that the thicknesswise dimension thereof is, it is preferable, 0.2 to 2 mm.

(37) In the case of the item (36) given above, it is more effective that a reinforced member is inserted into the adiabatic space. The reinforced member is inserted into the adiabatic space, thereby enhancing a stability of the cylindrical multi-layer body because of being capable of supporting the cylindrical multi-layer body in the axial direction, and enhancing also the durability against the vibrations.

Moreover, it is preferable that the reinforced member is composed of a tree-dimensional metal porous member, wire-netting, a metal non-woven fabric, a corrugated sheet, a metal sheet taking an elongate rectangular shape and a punching metal each having a material filling rate of 30% or less in order not to deteriorate the adiabatic property of the adiabatic space.

Further, the generation of the thermal stress is restrained and the enhancement of the durability can be further expected by equalizing the thermal capacities per volume with respect to the reinforced material, the cylindrical member and the cylindrical multi-layer body.

(38) In the case of the items (1) through (37) described above, it is preferable that the multi-layer body is formed by joining the non-woven fabric and the corrugated sheet each defined as the constructive member thereof. That is, it is preferable that the elongate rectangular multi-layer member composed of the corrugated sheet and the non-woven fabric is wound in roll on the axial core, and thereafter the multi-layer member is formed by joining the contact portion between the corrugated sheet and the non-woven fabric.

A deviation in the axial direction can be prevented by joining the contact portion. Further, the deviation is hard to occur, and it is therefore feasible to prevent a decline of rigidity of the cylindrical multi-layer body. Accordingly, neither the cracks nor the damage is caused in the cylindrical multi-layer body.

(39) In the case of the item (38), the non-woven fabric and the corrugated sheet are joined by diffusion joining.

Herein, the [diffusion joining] is that two sheets of metals to be joined, i.e., the non-woven fabric and the corrugated sheet are layered together, and held by heating at a proper temperature in a pressurized state and thus joined. When joined by this type of diffusion joining, if a raw material of the corrugated sheet and a raw material for the non-woven fabric are substantially the same, the materials are uniformized by a diffusing phenomenon, resulting in a decrease in the stress due to the difference in thermal expansion between the corrugated sheet and the non-woven fabric. The durability can be therefore improved.

(40) In the case of the item (5), it is preferable that the arm portions are formed so that the arm portions face to the portion formed of the multi-layer member of the cylindrical multi-layer body when the connection member is attached to the opening of one side end of the heat resistant container.

When the exhaust gas is discharged, the axial pressure acts not only on the axial core as one of the constructive member of the cylindrical multi-layer body but also on the non-woven fabric and the corrugated sheet of the cylindrical multi-layer body, with the result that the non-woven fabric or the corrugated sheet might protrude from the heat resistant container. The axial deviation of the non-woven fabric and/or the corrugated sheet can be prevented by adopting such a structure that the members as the components of the multi-layer member of the cylindrical multi-layer body, i.e., the non-woven fabric and/or the corrugated sheet face to (supported by) the arm portions.

Normally, the corrugated sheet is shorter in its axial length than the non-woven fabric. Therefore, when the corrugated sheet is supported by the arm portions, the arm portions are required to have a form adapted so that the corrugated sheet are brought into contact with the arm portions. The corrugated sheet does not slide toward the exhaust side by supporting the corrugated sheet on the arm portions. Hence, there is no portion where the non-woven fabric is not supported. It is therefore possible to prevent the decrease in the rigidity of the cylindrical multi-layer body.

Further, there increases the number of the portions where the non-woven and/or the corrugated sheet is supported, so that the stress generated in the axial direction can be dispersed, and the durability of the particulate filter is improved.

(41) In the case of the item (1), it is preferable that a sealing portion for sealing the leading edges of the non-woven fabrics adjacent to each other and a non-sealing portion opened are alternately formed at both side ends of the multi-layer member in the radial direction, and the non-woven fabric and the corrugated sheet are fixed in a state where an axial side end portion of the corrugated sheet is sandwiched in between the non-woven fabrics formed with the sealing portion.

In this case, if the non-woven fabric and the corrugated sheet are fixed by welding and so on in the state where the side end of the corrugated sheet in the axial direction is sandwiched in between the non-woven fabrics forming the sealing portion, the stress in the axial direction of the multi-layer body that occurs on the non-woven fabric can be received by the corrugated sheet. Therefore, the rigidity of the cylindrical multi-layer body is improved, and it is possible to prevent the cylindrical multi-layer body from deviating downstream and protruding by the pressure of the exhaust gas. Moreover, the corrugated sheet receives the stress generated by the pressure of the exhaust gas and applied on the non-woven fabric, and hence the welding of the sealing portion on the downstream side can be prevented from being taken off.

(42) In the case of the items (1) through (41), it is preferable that the axial core has a joining portion partially fixed by welding to the non-woven fabric, and a metal quantity per unit area of the axial core at this joining portion is substantially the same a metal quantity per unit capacity of the non-woven fabric.

With this contrivance, a thermal expansion coefficient of the joining portion of the axial core is equalized to a thermal expansion coefficient of the portion coming into contact with the joining portion of the non-woven fabric. Even if the joining portion of the axial core and the portion of the non-woven fabric that comes into contact with this joining portion receives the heat of the exhaust gas and get deformed, the degrees of these deformations are the same. Therefore, it is feasible to restrain the generation of the thermal stress at the joining portion, and the durability of the joining portion, more essentially, the particulate filter.

For satisfying the requirements described above, if the axial core is large in thickness, the particulate filter is increased in size. Whereas if too thin, the rigidity of the axial core decreases, so that the thickness of the axial core is preferably 0.1 to 0.3 mm.

BEST MODE FOR CARRYING OUT THE INVENTION

Embodiments of the present invention will hereinafter be described with reference to the accompanying drawings.

<First Embodiment>

An embodiment of the present invention will be explained in depth referring to FIGS. 1 through 7.

Figure 1:
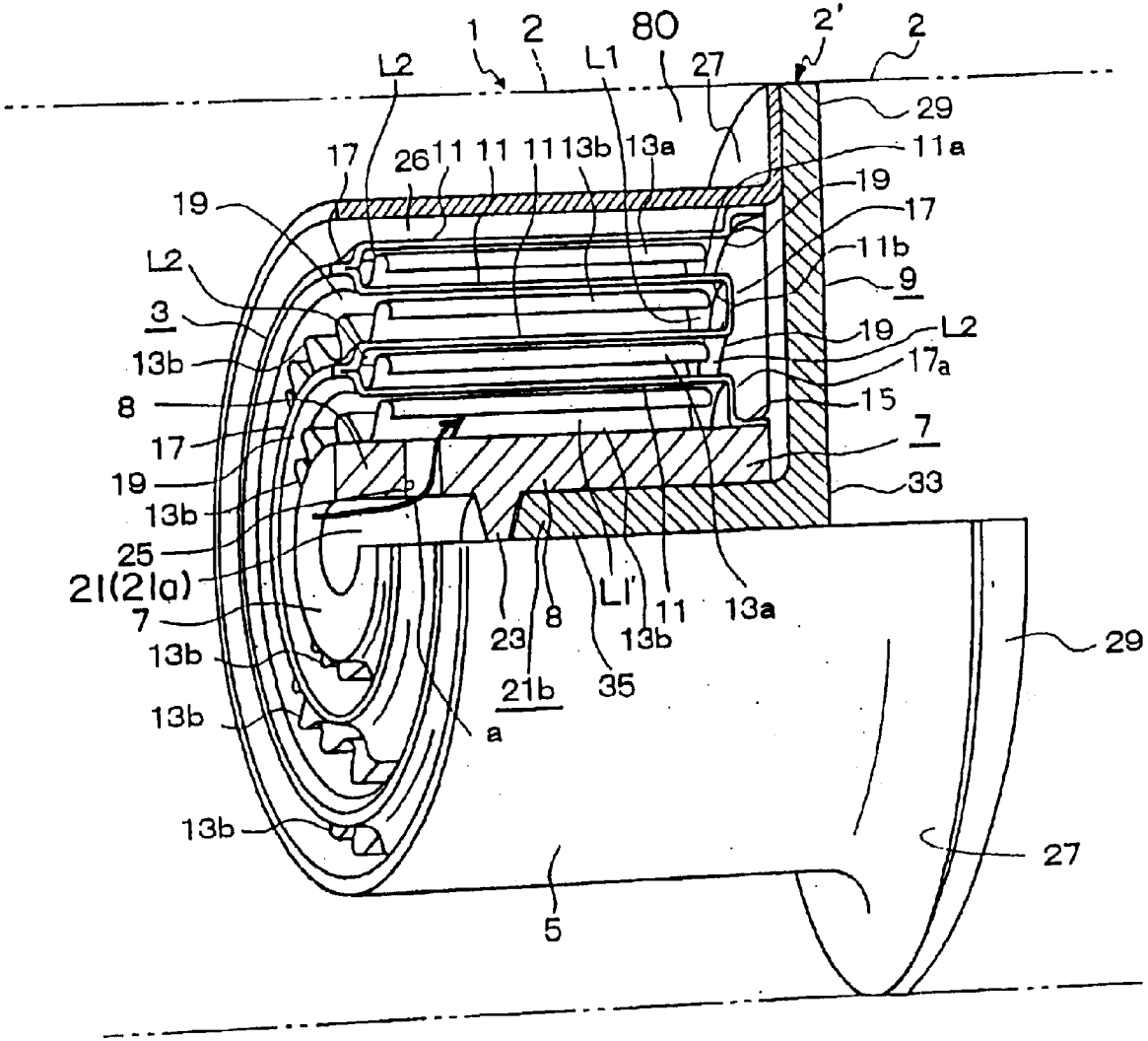
FIG. 1 is a perspective view with some portion cut away, showing a particulate filter in a first embodiment of the present invention.

FIG. 1 is a perspective view with some portions cut off, showing a particulate filter 1.

The particulate filter 1 is installed in an exhaust system 2 of, e.g., a diesel engine, and classified as a scavenger for scavenging mainly PM represented by soot defined a suspended particulate matter contained in an exhaust gas.

A basic configuration thereof is that a cylindrical multi-layer body 3 having a filter function is inserted into a metal container 5 exhibiting a heat resistance through openings formed at two side ends, and proper portions of the two members are welded to each other into one integrated unit (some portions are illustrated cut off in the drawings).

Then, in the particulate filter 1 according to the first embodiment, the cylindrical multi-layer body 3 is, as known well, composed of an elongate non-woven fabric 11 made of a heat resisting metal, and corrugated sheets 13*a*, 13*b* each made of a heat resisting metal, somewhat smaller in its widthwise dimension than the non-woven fabric and having a corrugated vertical-sectional surface. The cylindrical multi-layer body 3 is configured such that the non-woven fabric 11 and the corrugated sheets 13*a*, 13*b* are tiered in the same direction into the elongate multi-layer member (not shown), and this elongate multi-layer member is wound on an axial core 7 of the heat resisting metal to take a cylindrical shape. Further, the elongate multi-layer member is wound on the axial core 7 so that the non-woven fabric 11 becomes an outer peripheral surface of the cylindrical multi-layer body 3 when the cylindrical multi-layer body 3 is formed.

Moreover, the particulate filter 1 includes a connection member, fitted at an opening formed at one side end of the metal container 5, for fixedly connecting the metal container 5 to the axial core 7. Note that a ring member 9 is referred to as a ring member 9 for explanatory convenience in the present specification.

As for the cylindrical multi-layer body 3, to begin with, the elongate multi-layer member according to the present invention before being wound on the axial core 7 is composed of the non-woven fabric 11 folded double in a folded elongate shape, and the corrugated sheets 13*a*, 13*b* each disposed on, laminated on and welded to one surface 11*a* of the double-folded non-woven fabric 11 in an area between pile-up surfaces 11*b*, 11*b*. Note that the corrugate sheets 13*a*, 13*b* might be generically called a corrugated sheet 13 in terms of a descriptive convenience.

It is preferable that the cylindrical multi-layer body 3 be formed by joining the non-woven fabric 11 and the corrugated sheet 13 defined as the constructive members thereof to each other. Namely, the elongate multi-layer member composed of the non-woven fabric 11 and the corrugated sheet 13 wound in roll on the axial core 7, and thereafter the contact portions between the non-woven fabric 11 and the corrugated sheet 13 are joined, thus forming the cylindrical multi-layer body 3.

Next, the elongate multi-layer member is wound on the axial core 7. Then, when viewing the elongate multi-layer member sound on the axial core 7 from one side end thereof, it can be seen that a sealing portion 17 and a non-sealing portion 19 making the corrugated sheet 13 visible are alternately multi-layered spirally without by welding in a sate where the corrugated sheet 13 positioned between layers of the non-woven fabric 11 is closed invisibly by the non-woven fabric.

Then, a layer on which the sealing portion 17 is formed beforehand by folding double the non-woven fabric, in other words, a portion L1 between the pile-up surfaces has a space area surrounded by the non-woven fabric, i.e., a space with one side end closed and the other side end opened, and this portion L1 may be defined as a bag-like layer portion (which will hereinafter be called a [bag-shaped layer portion]) where this space accommodates the corrugated sheet 13. On the other hand, bag-shaped layer portions L2, L2 adjacent on both sides to this bag-shaped layer portion L1 are layer portions where the space is, though surrounded by the non-woven fabric, opened at its two side ends and accommodates the corrugated sheet 13 (referring to FIGS. 1 and 2, however, the illustration is that one side ends of the bag-shaped layer portions L2, L2 are closed by welding in terms of such a relation that the cylindrical multi-layer body 3 is already inserted into the metal container 5).

Note that the bag-shaped layer portions L1, L2 are spirally multi-layer corresponding to a length of the elongate multi-layer member.

Thus, the sealing portion 17 and the non-sealing portion 19 are formed at one side ends of the cylindrical multi-layer body 3 in the axial direction without by welding, and this configuration relies entirely on such an arrangement that the non-woven fabric 11 is, as described above, wound in the sate of being folded double. A bag-shaped layer portion L1' most adjacent to the axial core 7 is, however, a portion sealed by welding one side end 17*a* of the non-woven fabric 11 to the axial core 7 (note that the corrugated sheet contained in this bag-shaped layer portion L1' is designated for an explanatory convenience by the same reference symbol 13*b* as that of the corrugated sheet of the bag-shaped layer portion L1. Further, the welded portion of the non-woven fabric 11 to the axial core 7 is called a joined portion for the explanatory convenience and indicated by the numeral 15).

Further, a metal quantity per unit area of the axial core 7 at the joined portion is absolutely or substantially the same as a metal quantity per unit capacity of the non-woven fabric 11 (note that "the metal quantity being substantially the same" implies a state where any difference in the following effects can not be seen).

With this contrivance, a thermal expansion coefficient of the joined portion 15 becomes equal to a thermal expansion coefficient of the one side end 17*a* defined the portion coming into contact with the joined portion 15 of the non-woven fabric 11. Even in such a case that the joined portion 15 and one side end 17*a* of the non-woven fabric 11 that is brought into contact with this joined portion 15, receive the heat of the exhaust gas and deform, the joined portion 15 and one side end 17*a* get deformed to the same degree. Hence, an occurrence of a thermal stress at the joined portion can be restrained, a durability of the joined portion 15 and more essentially the particulate filter 1 can be enhanced.

For satisfying the requirements given above, if the axial core 7 is large in its thickness, the particulate filter 1 increases in size, and, whereas if too thin, a rigidity of the axial core 7 decreases. It is therefore preferable that the thickness of the axial core 7 is within a range of 0.1 to 0.3 mm.

Hence, at this stage, i.e., at a stage where the cylindrical multi-layer body 3 is merely formed by winding the elongate multi-layer member on the axial core 7 and is not yet contained in the metal container 7, there is set a state in which no sealing portion is formed at the other side end of the cylindrical multi-layer body 3.

It is, however, as described in the prior art, required that the sealing portion 17 and the non-sealing portion 19 be formed also at this other side end. Hence, the sealing portion 17 and the non-sealing portion 19 are alternately formed also at the other side end. The sealing portion 17 at the other side end is actualized by welding (see FIGS. 1 and 2).

Then, as in the case of the prior art, with respect to the bag-shaped layer portion L1 with sealing carried out at one side end thereof, no sealing is carried out at the other side end thereof. With respect to the bag-shaped layer portion L2 with no sealing is carried out at one side end, welding-based sealing is carried out at the other side end thereof as described above.

Further, the heat resisting metal fiber composing the non-woven fabric 11 and the heat resisting metal composing the corrugated sheet 13, may involve the use of, e.g., Fe—Cr—Al alloy, Ni—Cr—Al alloy and so on. The method of joining the non-woven fabric 11 and the corrugated sheet 13 to each other may include joining methods that involve brazing, diffusion-joining other than welding.

In the case of being joined by brazing, preferably a brazing material involves the use of what is based on Ni exhibiting the heat resistance.

The diffusion-joining is that the two metals to be joined, i.e., the non-woven fabric and the corrugated sheet are stacked on each other and pressurized, and these two metals in this pressurized state are held heated at a proper temperature and thus joined. In the case of being joined by the diffusion joining described above, if a corrugated sheet raw material and a non-woven fabric raw material are substantially the same, the materials are uniformized by a diffusing phenomenon, and the stress due to a difference in thermal expansion between the corrugated sheet and the non-woven fabric decreases, thereby making is possible to improve the durability.

In the case of being joined by the diffusion-joining, if the materials of the non-woven fabric 11 and of the corrugated sheet 13 are the same, the heat resistance at the joined portions can be ensured.

Further, the heat resistance can be further enhanced by uniformizing the materials due to the diffusing phenomenon. Note that the diffusion-joining may be performed after welding or brazing, and the thus obtained joined portions gain a much higher rigidity.

Normally, the diffusion-joining requires diffusive reaction at a temperature as high as 1200° C. or above, however, if a diffusion substance is supplied by using a raw material other than those of the non-woven fabric 11 and the corrugated sheet 13, the diffusive reaction can be accelerated, and the diffusion-joining can be attained within a range of 1000 to 1150° C.

Moreover, more uniform diffusion-joining can be attained by applying a pressure upon the joined portion between the non-woven fabric 11 and the corrugated sheet 13 when the diffusive reaction occurs.

To be specific, in a state where the non-woven fabric 11 and the corrugated sheet 13 are wound in roll, the outer periphery is covered with a line material or a band composed of a material such as Mo, AlN, alumina, etc. exhibiting a smaller thermal expansion coefficient than that of the metal used for the non-woven fabric 11 and the corrugated sheet 13. In this state, the whole of the cylindrical multi-layer body is pressurized uniformly in the radial direction when in the diffusive reaction at a high temperature, thereby obtaining the more uniform diffusion-joining.

Moreover, if the contact area between the non-woven fabric 11 and the corrugated sheet 13 changes when pressurized, a scatter occurs in the rigidity. Therefore, a height of the corrugation of the corrugated sheet is set to 0.7 mm to 1.5 mm, and a thickness of the corrugated sheet is set to 0.05 mm to 0.2 mm, whereby much more uniform diffusion is attained.

At this time, if the raw materials of the non-woven fabric 11 and the corrugated sheet 13 contain at least Fe or Ni, and if the raw material to be supplied contains at least Cr, an Fe—Cr series or Ni—Cr series coupling layer is formed at the joined portion therebetween, thereby obtaining a high heat resistance.

The axial core 7 has a hollow 21 of which both side ends are opened, and a partition wall 23 for partitioning the hollow 21 in two. Then, when the particulate filter 1 is installed in a way that directs creases of the folded non-woven fabric of the cylindrical multi-layer body 3 towards a downstream side of an exhaust system of the engine, a half of the hollow 21 partitioned by the partition wall 23 is formed as an upstream-sided hollow 21*a* that is opened on an upstream side of an exhaust passageway of the engine but is closed on the downstream side, and the other half is formed as a downstream-sided hollow 21*b* that is opened on the downstream side of the exhaust passageway of the engine but is closed to the upstream side. The [crease] is not herein limited to a distinctive crease formed by folding up the non-woven fabric, and embraces a side area formed with a width to some extent when folded back with no crease.

Moreover, a peripheral wall 8 of the axial core 7 is formed with two or more through-holes through which the upstream-sided hollow 21*a* communicates with the multi-layer member along the axial core 7.

Figure 2:
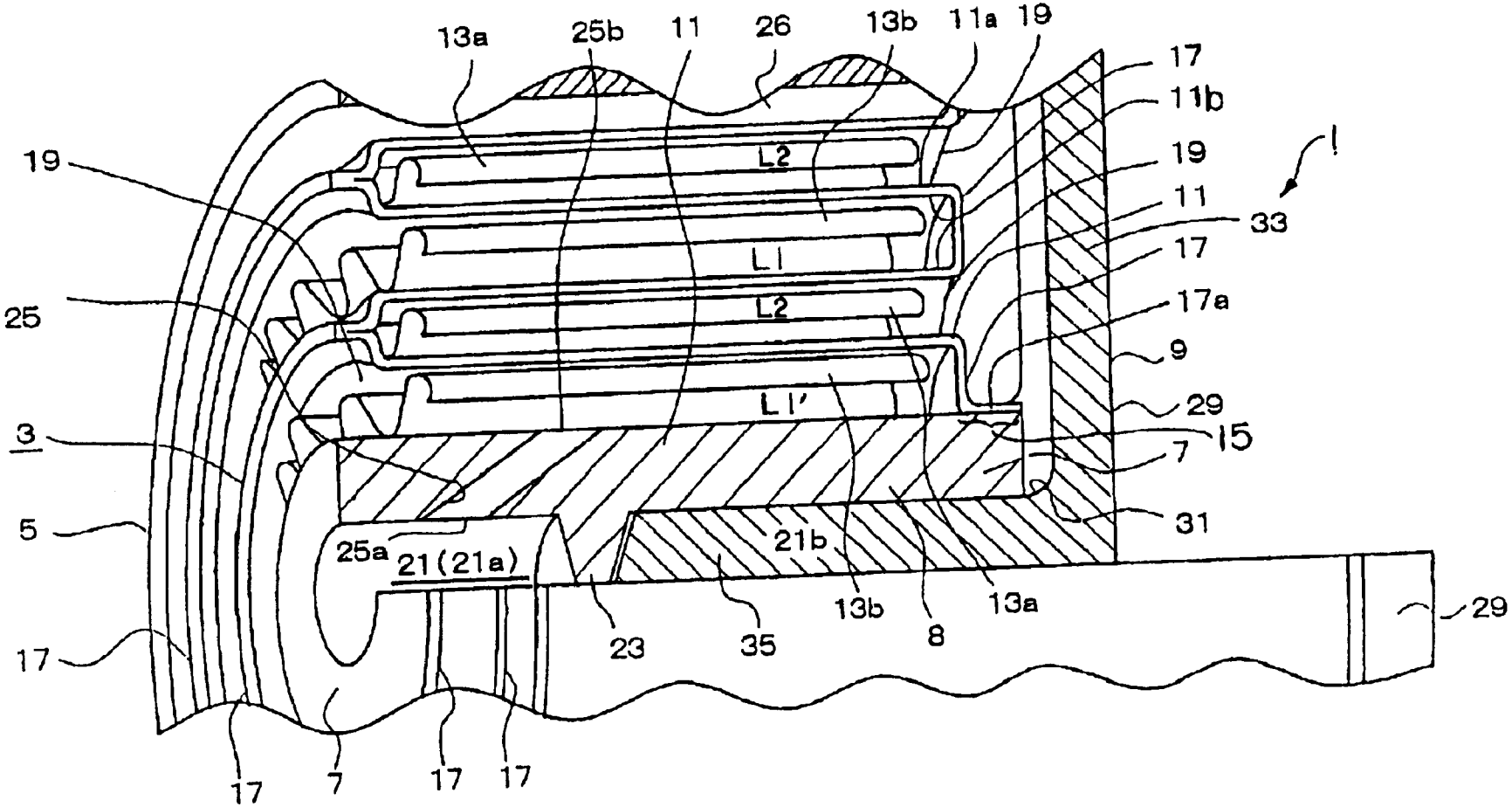
FIG. 2 is an enlarged view showing the principal portions with some portions modified.

Referring back to FIG. 1, the through-hole 25 is illustrated as a hole 25 holed at the right-angle to the peripheral wall 8 but may also be holed obliquely to the peripheral wall 8 as shown in FIG. 2. In this case, the through-hole 25 is, as shown in FIG. 2, formed obliquely extending from the upstream side of the engine exhaust passageway formed in the axial core 7. An upstream-sided opening 25*a* of the through-hole 25 is disposed on the side of the upstream-sided hollow 21*a*, while a downstream-sided opening 25*b* thereof faces to the non-woven fabric 11 in a state where the opening 25*b* is disposed on the side of the multi-layer member along the axial core 7, precisely on the side of the non-woven fabric 11 defined as a constructive member of the multi-layer member.

The metal container 5 is configured so that the interior of the metal container 5 is charged with the cylindrical multi-layer body 3 so as not to form a gap within the metal container 5 to the greatest possible degree in a way that permits the exhaust gas to flow via the cylindrical multi-layer body 3 having the filter function without leaking cut of the metal container 5 when the exhaust gas flows through the particulate filter 1. Therefore, an inside diameter of the metal container 5 is substantially the same as an outside diameter of the cylindrical multi-layer body 3.

In fact, however, it follows that a space portion is formed between an outer surface of the cylindrical multi-layer body 3 and an inner surface of the metal container 5, and this space portion services as a passageway within the particulate filter, through which the exhaust gas entering the cylindrical multi-layer body 3 substantially flows. This passageway is designated by the numeral 26 (see FIGS. 1 and 2).

Further, the particulate filter 1 is so attached as to be fitted into an exhaust pipe at a joint portion 2' between the exhaust pipes of the internal combustion engine and held in between the exhaust pipes 2. Hence, a flange 27 overhanging outside is formed at one side end of the metal container 5 and is held by the joint portion 2' of the exhaust pipe, thereby fixing the particulate filter 1 to the exhaust pipe (see FIG. 1).

Figure 3:
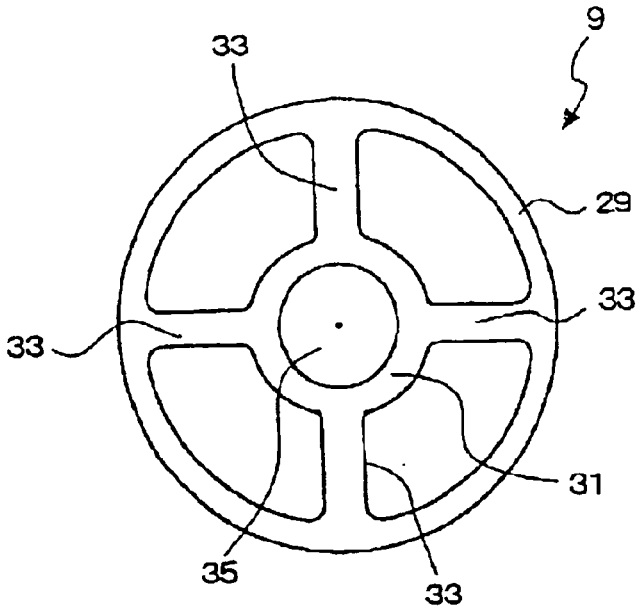
FIG. 3 is a front view showing a ring member according to the present invention.
Figure 4:
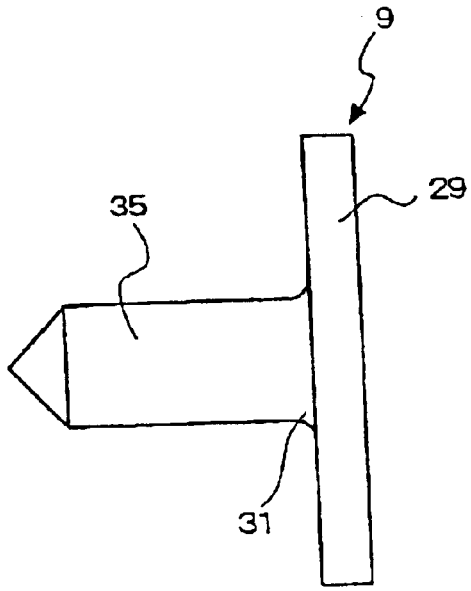
FIG. 4 is a side view showing the ring member in FIG. 3.

The ring member 9 includes, as shown in FIGS. 3 and 4, a ring portion 29 facing to the flange 27 defined as one-end opening edge of the metal container 5 when the ring member 9 is fitted to the metal container 5, a boss 31 facing to the axial core 7 of the cylindrical multi-layer body 3, and four lengths of arms 33, 33, 33, 33 connecting the ring portion 29 to the boss 31 and facing to portions of the multi-layer member, excluding the axial core 7, of the cylindrical multi-layer body 3 and wound on the axial core 7.

Further, the boss 31 is formed integrally with a fitting shaft 35 serving as a joining portion for joining the boss 31 to the downstream-sided hollow 21*b* of the axial core 7 so that the fitting shaft 35 extends on the upstream side of the axial core 7. A dimension of substantial length of the fitting shaft 35 is set the same as the lengthwise dimension of the downstream-sided hollow 21*b*.

Figure 5:
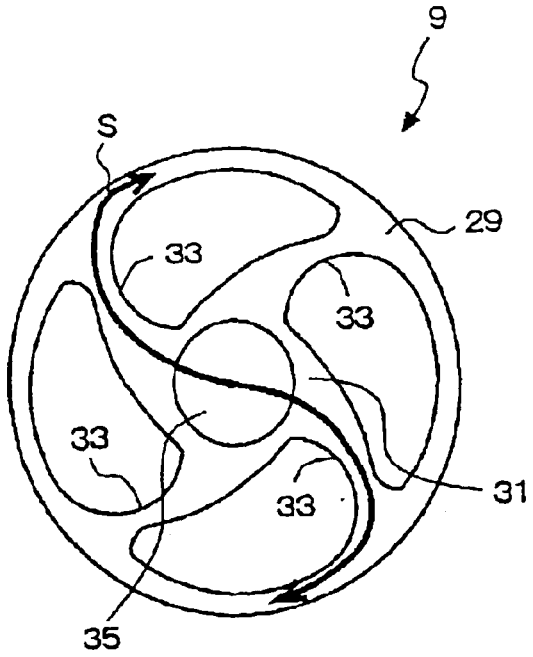
FIG. 5 is a front view showing another ring member of the present invention.
Figure 6:
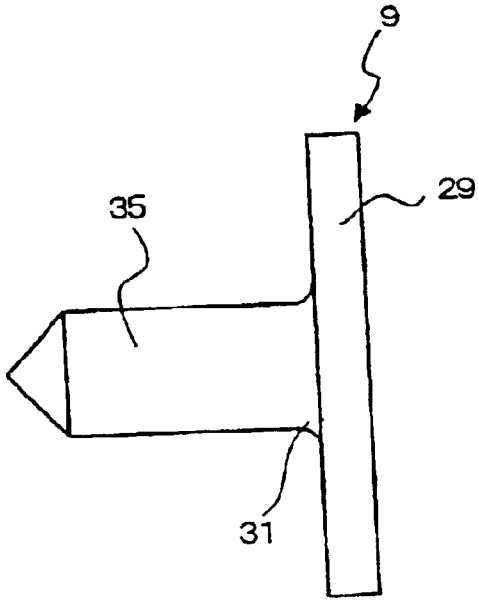
FIG. 6 is a side view showing the ring member in FIG. 5.

The arms 33 may take, as can be understood from FIG. 3, for example, a rectilinear cross shape or a curvilinear double-S shape as shown in FIG. 5 (see a line S having two arrowheads in FIG. 5).

Further, if a diameter of the axial core 7 of the cylindrical multi-layer body 3 is set so that a rate at which this diameter occupies a diameter of the cylindrical multi-layer body 3 is within a range of 15 to 27%, the test performed by the present inventors has proven that an extrusion force relative to the axial core 7 decreases.

Next, it will be explained about assembling of the particulate filter 1.

The cylindrical multi-layer body 3 is inserted into the metal container 5. Thereafter, the inner surface of the metal container 5 is welded to the outer peripheral surface of the cylindrical multi-layer body 3, thereby fixing the cylindrical multi-layer body 3 to the metal container 5. Finally, the fitting shaft 35 of the ring member 9 is fitted into the downstream-sided hollow 21*b* of the axial core 7, whereby the metal container 5 and the cylindrical multi-layer body 3 are formed into one united body.

At this time, the particulate filter 1 is thus configured, wherein the ring portion 29 of the ring member 9 faces to the flange 27 of the metal container 5, and the arms 33, 33, 33, 33 faces to the portions, excluding the axial core 7, of the cylindrical multi-layer body 3.

Note that what is indicated by the numeral 80 is a space formed between the exhaust pipe 2 and the cylindrical multi-layer body 3. The exhaust gas emitted form the engine, though discharged into the atmospheric air via the particulate filter 1, stays, on the way to the outside, in the space 80 formed between the exhaust pipe 2 and the cylindrical multi-layer body 3, whereby the space 80 becomes an adiabatic space. Hence, the space 80 will hereinafter be called the adiabatic space 80. A downstream-sided side end of the adiabatic space 80 is closed by the flange 27 so that the exhaust gas is not discharged directly into the atmospheric air.

A size of the adiabatic space 80 is determined by a dimensional difference between the outside diameter of the metal container 5 and the inside diameter of the exhaust pipe 2.

Next, operations and effects of the thus configured particulate filter 1 in the first embodiment will be explained.

When the particulate filter 1 is attached to the joint portion 2' of the exhaust pipe 2, in the particulate filter 1, the ring member 9 prevents the axial core 7 of the cylindrical multi-layer body 3 inserted into the metal container 5 from moving in the axial direction.

Then, the ring member 9 is hard to come off because of the fitting shaft 35 of the boss 31 being fitted into the downstream-sided hollow 21*b* of the axial core 7 of the cylindrical multi-layer body 3, and the boss 31 is fixed via the arms 33, 33, 33, 33 to the ring portion 29. Therefore, when the particulate filter 1 is installed in the exhaust system of the internal combustion engine, even if a pressure caused by exhaust pulses etc acts to thrust the axial core 7 towards the downstream side, the movement of the axial core within the metal container 5 is hindered by the boss 31 and the arms 33, 33, 33, 33 of the ring member 9. Therefore, it does not happen that the whole cylindrical multi-layer body 3 containing the axial core at its center protrudes from the metal container 5. Hence, the ring member 9 may be called an axial core movement preventing means.

In other words, when the ring member 9 is attached to the one-side opening of the metal container 5, the arms 33 are formed so that the arms 33 face to the portions formed as the multi-layer member of the cylindrical multi-layer body 3. Therefore, when the exhaust gas is discharged, the axial pressure acts on the non-woven fabric 11 of the cylindrical multi-layer body 3 and the corrugated sheet 13 as well as on the axial core 7 defined as one of the constructive members of the cylindrical multi-layer body 3, with the result that the non-woven fabric 11 or/and the corrugated sheet 13 might protrude from the metal container 5.

However, in the structure, the arms 33 face to (support) the portions formed by the multi-layer member of the cylindrical multi-layer body 3, i.e., the non-woven fabric 11 and/or the corrugated sheet 13. It is therefore feasible to prevent the axial shift of the non-woven fabric 11 and/or the corrugated sheet 13.

Normally, the axial length of the corrugated sheet 13 is shorter than that of the non-woven fabric 11. Hence, if the corrugated sheet 13 is supported by the arms 33, it is required that the configuration of the arms 33 be adapted so that the corrugated sheet 13 comes into contact with the arms 33. The corrugated sheet 13 does not slide towards the exhaust side by supporting the corrugated sheet on the arms 33, and hence the entire non-woven fabric 11 is supported. Consequently, a decrease in rigidity of the cylindrical multi-layer body 3 can be prevented.

Further, the number of portions supporting the non-woven fabric 11 and/or the corrugated sheet 13 increases, and it is therefore feasible to disperse the stress occurred in the axial direction and to improve the durability of the particulate filter 1.

Note that the following is a comparison between the rectilinear arms 33 and the curvilinear arms 33.

A length of the rectilinear arm 33 is shorter than that of the curvilinear arm 33, and therefore has a less rate of facing to the cylindrical multi-layer body. Hence, it can be said that the rectilinear arm 33 correspondingly has a less hindrance against the flow of the exhaust gas, resulting in a decrease in exhaust resistance. Accordingly, a smooth flow of the exhaust gas is obtained, however, there decreases a strength of restraining the protrusion of the cylindrical multi-layer body from the metal container 5.

With respect to the curvilinear arm 33, if the arm 33 is configured curvilinearly as in an S-shape, the length of the arm 33 connecting the ring portion to the boss is larger than that of the rectilinear arm 33. Therefore, an area rate of the arms 33 facing to the cylindrical multi-layer body increases, resulting in a rise in degree of how much the arms 33 restrain the flow of the exhaust gas flowing through the cylindrical multi-layer body. Hence, the exhaust resistance increases corresponding to the rise described above. This results in an unsmoothed flow of the exhaust gas. There, however, rises the strength of restraining the protrusion of the cylindrical multi-layer body from the metal container 5. Further, an allowable difference in dimension due to the thermal expansion in the case of the curvilinear arms can be taken larger than in the case of the rectilinear arms, and a better usability is obtained correspondingly.

Thus, both of the rectilinear and curvilinear arms 33 have merits and demerits respecitively, however, whether the arm 33 takes the rectilinear or curvilinear shape, the boss for restraining the movement of the axial core is fixed by the arms 33, with the result that there increase the rigidity of the boss and the strength of restraining the central portion of the cylindrical multi-layer body that faces to this boss from protruding downstream out of the metal container 5.

Further, in the case where the particulate filter 1 is installed in the engine exhaust system, the axial core 7 has the upstream-sided hollow 21*a* disposed upstream and opened at its upstream-sided end but closed downstream, and has the through-hole 25 formed in the peripheral wall 8 of this axial core 7.

Hence, the exhaust gas flows into the upstream-sided hollow 21*a* of the axial core 7. Then, the inflow exhaust gas flows through the through-hole 25 and flows out exiting the multi-layer member along the axial core, i.e., the bag-shaped layer portion L1' adjacent most to the axial core 7 (see an arrowhead a in FIG. 1). Consequently, an external force smaller corresponding to this such as a pressure acting to thrust the axial core 7 toward the downstream side of the exhaust gas, is applied on the axial core 7. It does not therefore happen that the axial core 7 protrudes from the metal container 5. Accordingly, the axial core 7 includes the upstream-sided hollow 21*a* and the through-hole 25, whereby the axial core 7 is, it can be said, formed with the axial core movement preventing means. In other words, the upstream-sided hollow 21*a* and the through-hole 25 formed in the axial core 7 may be defined as the axial core movement preventing means.

Figure 7:
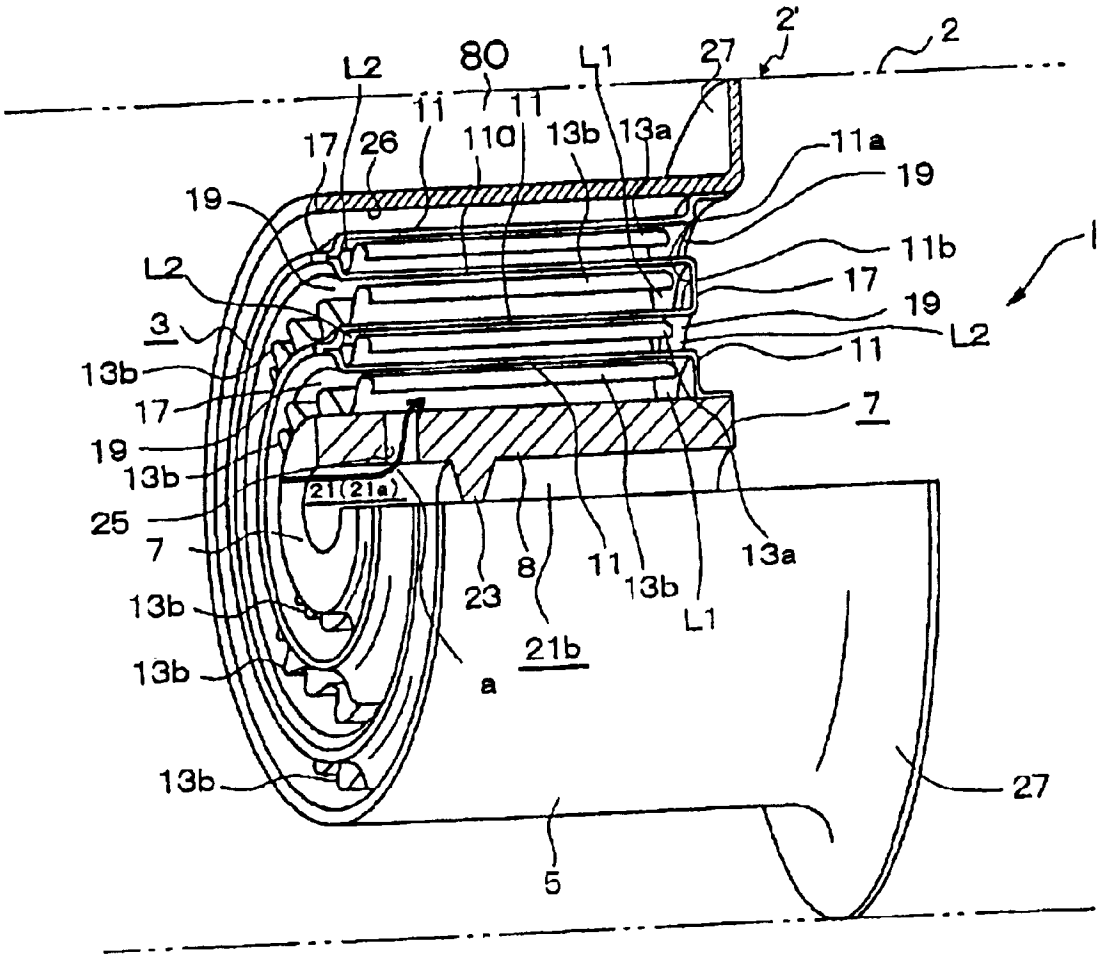
FIG. 7 is a view of a modified example of the particulate filter in the first embodiment of the present invention, showing a state where the ring member is removed from the particulate filter.

Hence, as shown in FIG. 7, even if the ring member 9 is eliminated from the particulate filter 1, it may be said that the particulate filter 1 has the axial core movement preventing means.

Including the particulate filter 1 shown in FIG. 7, the particulate filter 1 involves the use of the axial core 7, and therefore, at the start of winding a leading edge of the elongate multi-layer member wound on the axial core 7 with respect to the elongate multi-layer member formed by stacking the non-woven fabric and the corrugated sheet, the elongate multi-layer member can be wound in a state where a bending degree (a curvature) required for winding the leading edge of the multi-layer member is larger than in the case of winding without the axial core 7.

Therefore, minute cracks and creases are hard to occur in the start-of-winding portion (which is the leading edge portion described above) of the multi-layer member, in other words, the portion of the multi-layer member that comes into contact with the periphery of the axial core when the cylindrical multi-layer body 3 is formed with the multi-layer member. Hence, the durability of the central portion of the cylindrical multi-layer body can be enhanced.

Further, in the particulate filter 1, even when the central portion of the cylindrical multi-layer body 3 receives the pressure caused by the exhaust pulses, etc. and forced to be thrust towards the downstream side of the exhaust gas, the movement of the axial core 7 is prevented by a variety of axial core movement preventing means described above. Accordingly, the axial core 7 does not protrude from the metal container 5, so that the cylindrical multi-layer body gets neither deformed nor fractured. Hence, the particulate filter 1 is not damaged.

Further, the sealing portion 17 is the folded portion formed by folding the non-woven fabric 11 without by welding. Hence, the sealing portion 17 is not formed by integrally welding the originally separated and adjacent non-woven fabrics as exemplified in the prior art by welding, and therefore, even when the fluctuations in pressure due to the exhaust heat and pulses act on the sealing portion 17, this sealing portion is never opened. Therefore, it does not happen that the rate of scavenging the PMs extremely decreases due to opened sealing portion.

Furthermore, the welding for sealing is not needed at the portion containing the creases of the non-woven fabric, in other words, at the boundary between the two surfaces facing to each other of the layers of the folded non-woven fabric. Hence, the operation efficiency is improved corresponding thereto.

In addition, it is preferable that the upstream-sided hollow 21*a* be as shallow as possible. This is because, with this contrivance, the quantity of the exhaust gas entering the hollow 21*a* becomes small, and it is correspondingly hard to receive the influence of the pressure.

Moreover, the through-hole 25 may be, as shown in FIG. 2, formed as the oblique hole holed obliquely to the peripheral wall 8, extending from the upstream side of the engine exhaust gas passageway of the axial core 7 towards the downstream side. In this case, the upstream-sided opening 25*a* is disposed on the side of the upstream-sided hollow 21*a*, while the downstream-sided opening 25*b* thereof faces to the non-woven fabric 11 in the state where the opening 25*b* is disposed on the side of the multi-layer member along the axial core 7, precisely on the side of the non-woven fabric 11 defined as the constructive member of the multi-layer member. Therefore, the exhaust gas flowing from upstream of the engine exhaust system towards the axial core flows through the through-hole 25 more smoothly than in the case of being holed at the right angle to the central axis of the axial core 7.

Namely, the exhaust gas becomes easier to flow through the through-hole 25 of the axial core 7 into the bag-shaped layer portion L1' defined as the multi-layer member along the axial core 7 and adjacent most to the axial core 7, and it is therefore possible to further decrease correspondingly the external force such as the pressure to thrust the axial core 7 towards the downstream side of the exhaust gas downstream side with the exhaust gas. For this reason, the stress occurred in the axial core 7 can be decreased corresponding thereto. Hence, the pressure of thrusting the central portion of the cylindrical multi-layer body containing the axial core 7 towards the downstream side, can be reduced, and therefore the particulate filter 1 can be further prevented from being damaged.

Then, the following is further found out as a result of comparisons of the durability and heat resistance between the prior art and the first embodiment.

The thermal stress occurred in the non-woven fabric in relation to a temperature distribution within the cylindrical multi-layer body 3 when burning the PMs, is 8N/mm$^2$ at 200° C. in the conventional structure. By contrast, according to the first embodiment, the thermal stress is 4N/mm$^2$ at 100° C. owing to the adiabatic space 80. The ensuring of this numerical value is preferable enough to prevent, it can be known in the first embodiment, the heat from dissipating into the atmospheric air and restrain the thermal stress.

Further, the adiabatic space 80 makes it possible to restrain the occurrence of the thermal stress caused by the difference in thermal expansion between the cylindrical multi-layer body 3 rising in its temperature when burning the PMs and the exhaust pipe 2 exposed to the atmospheric air.

Moreover, the periphery of the cylindrical multi-layer body 3 is surrounded with the adiabatic space 80, an hence a temperature retaining capacity when burning the PMs is enhanced, whereby the PMs can be burnt at a high efficiency.

In addition, the portion at which the corrugated sheet 13 comes into contact with the non-woven fabric 11 is joined, thereby making it feasible to prevent an axial deviation of the cylindrical multi-layer body 3. Further, the deviation is hard to occur, and a decrease in rigidity of the cylindrical multi-layer body 3 can be therefore restrained. Accordingly, neither the crack nor the damage occurs in the cylindrical multi-layer body 3.

<Second Embodiment>

Figure 8:
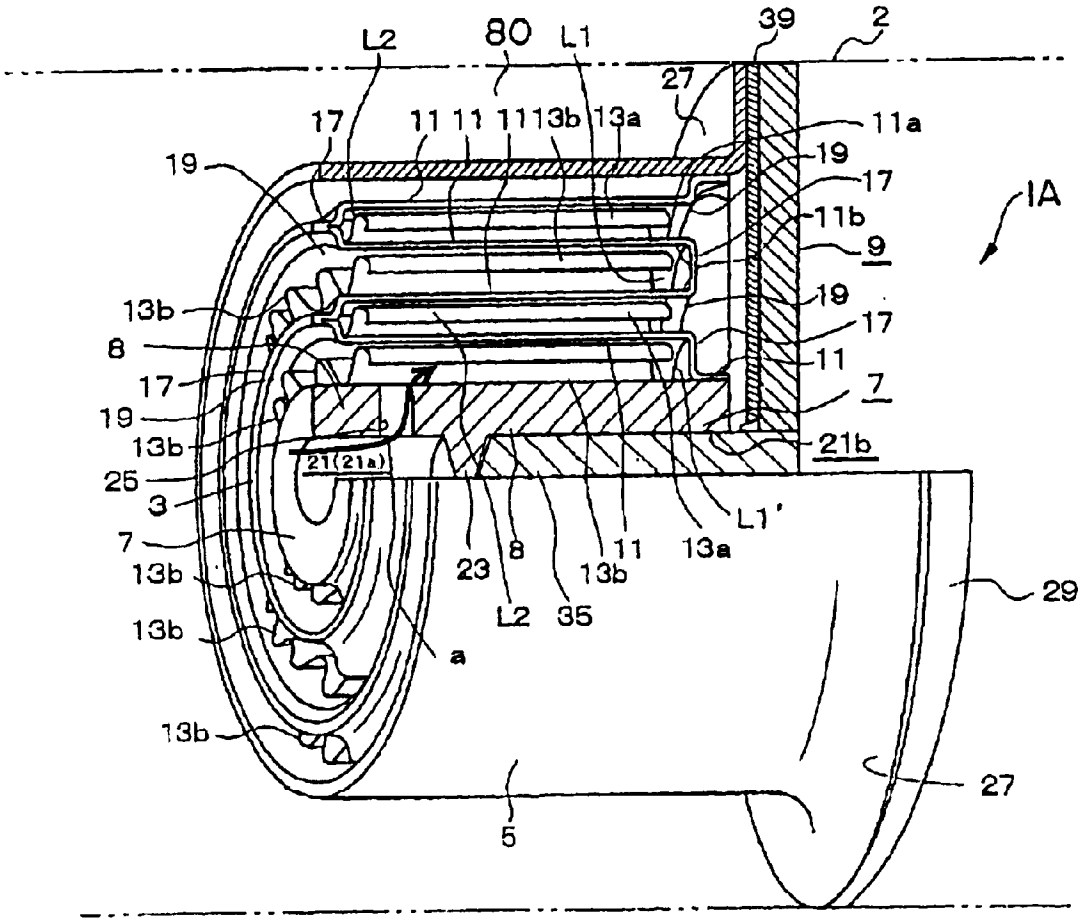
FIG. 8 is a perspective view with some portions cut away, showing the particulate filter in a second embodiment of the present invention.
Figure 9:
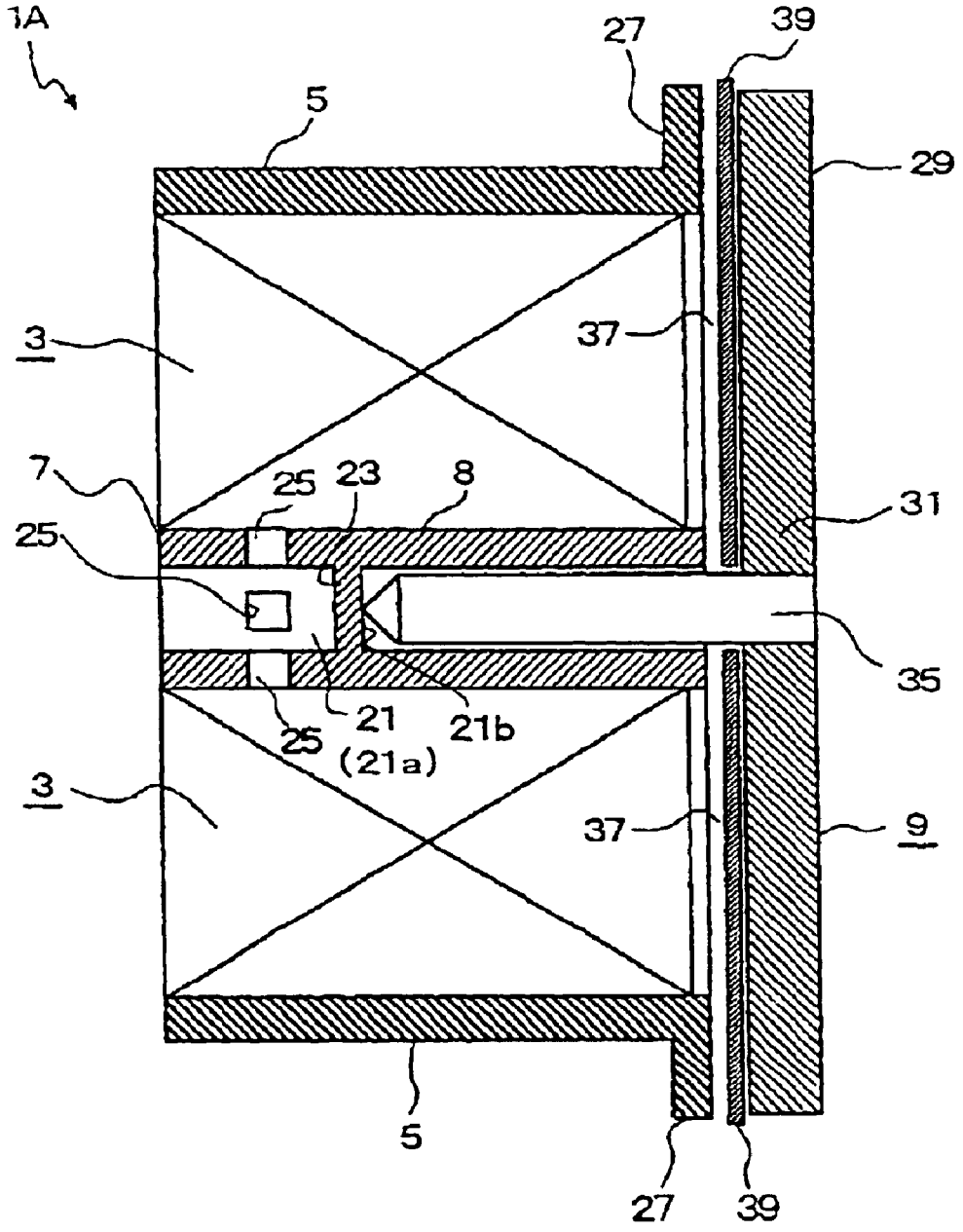
FIG. 9 is a vertical sectional view in FIG. 8.

A second embodiment will be described referring to FIGS. 8 and 9.

The following is a different point of a particulate filter 1A in the second embodiment from the particulate filter 1 in the first embodiment (see FIGS. 1 through 7). When installing the particulate filter 1A in the exhaust system of the internal combustion engine, the fitting shaft 35 and the ring member 9 are formed as separate members, and a dimension of a substantial length of the fitting shaft 35 is set somewhat larger than a lengthwise dimension of the downstream-sided hollow 21*b* of the axial core 7. Then, the fitting shaft 35 and the axial core 7 are composed of separate members each exhibiting a different elasticity. When the fitting shaft 35 is fitted into the downstream-sided hollow 21*b*, a gap 37 is formed between the metal container 5 and the ring member 9 due to a dimensional difference between the lengthwise dimension of the fitting shaft 35 and the lengthwise dimension of the downstream-sided hollow 21*b*. A plate-like elastic member 39 (exemplified such as a gasket composed of a ceramic fiber) of which a planar configuration is substantially coincident with the ring member 9, is disposed in the gap 37. Note that the gap is illustrated to deliberately make it conspicuous in order to clarify an existence of this gap 37 in FIG. 9 but in fact appears small enough not to be perceived at a glance as shown in FIG. 8.

Hence, the same components as those of the particulate filter 1 in the first embodiment are marked with the same numerals, and their repetitive explanations are omitted. Note that the fitting shaft 35 has a higher elasticity than that of the axial core 7.

The thus configured particulate filter 1A in the second embodiment exhibits the following operational effects in addition to the operational effects exhibited by the particulate filter 1 in the first embodiment.

For example, if the periodic vibrations caused by the external force, i.e., the vibrations caused by the fluctuations in pressure due to the exhaust pulses are transferred to the particulate filter 1A, the axial core 7 easy to receive a great influence thereof vibrates within the gap 37 due to the elasticity difference from the fitting shaft 35 fitted to the axial core 7.

Then, the cylindrical multi-layer body 3 containing the axial core 7 also vibrates within the metal container 5. Hence, if ashes are deposited eon the non-woven fabric 11 of the cylindrical multi-layer body 3, clogging of the non-woven fabric 11 of the cylindrical multi-layer body 3, clogging of the non-woven fabric 11 defined as the constructive member of the cylindrical multi-layer body 3 is obviated by shaking the ashes off. Hence, the incombustible ashes can be removed form the particulate filter 1A.

In addition, the stress on the cylindrical multi-layer body 3 due to the thermal expansion of the fitting shaft 35 that occurs under a high-temperature condition, is relaxed, whereby a structural destruction of the cylindrical multi-layer body 3 can be also restrained.

Further, the plate-like elastic member 39 like the gasket is disposed in the gap 37, thereby making it feasible to relieve an impact sound emitted when the metal container 5 impinges on the ring member 9 due to the vibrations. Moreover, the material of the plate-like elastic member 39 is properly selected without being limited to the ceramic fiber, and the clogging is further prevented while relieving the impact sound.

<Third Embodiment>

A third embodiment will be described referring to FIGS. 10 and 11.

A different point of a particulate filter 1B in the third embodiment from the particulate filter IA in the second embodiment (see FIGS. 8 and 9), is that neither the ring member 9 nor the elastic member 39 related thereto is provided, an axial core 7B having a different configuration from the axial core 7 is provided, and the sealing provided at one side end of the cylindrical multi-layer body is different. Hence, the description will be focused on these different portions, and the same other components are marked with the same numerals as those in the second embodiment, and their repetitive explanations are omitted.

To start with, the axial core 7B includes a hollow 21B opened at its downstream-sided end but closed at the upstream-sided end, extending in the axial direction and having no partition wall, and a through-hole 25B formed through a peripheral wall 8B of the axial core 7B and communicating with the hollow 21B and the multi-layer member along the axial core. Further, an upstream-sided end surface 40 closed as shown in FIG. 10 assumes a planar shape.

Further, a sealing portion 17*b* at one side end of a cylindrical multi-layer body 3B in the third embodiment, which corresponds to the sealing portion 17 at one side end of the cylindrical multi-layer body 3 in the second embodiment, is not formed by folding double the non-woven fabric.

Namely, the cylindrical multi-layer body 3B in the third embodiment basically includes two or more even-numbered pieces of non-woven fabrics 11 containing the elongate multi-layer members and exhibiting a filter function as in the prior art, and the same number of corrugated sheets 13 each composed of the heat resisting metal plate as the number of the non-woven fabrics 11. The sealing is provided by welding one side ends of a couple of non-woven fabrics 11 to each other.

Based on this relationship, the outer surface of the axial core 7B is covered with the non-woven fabric 11.

Figure 10:
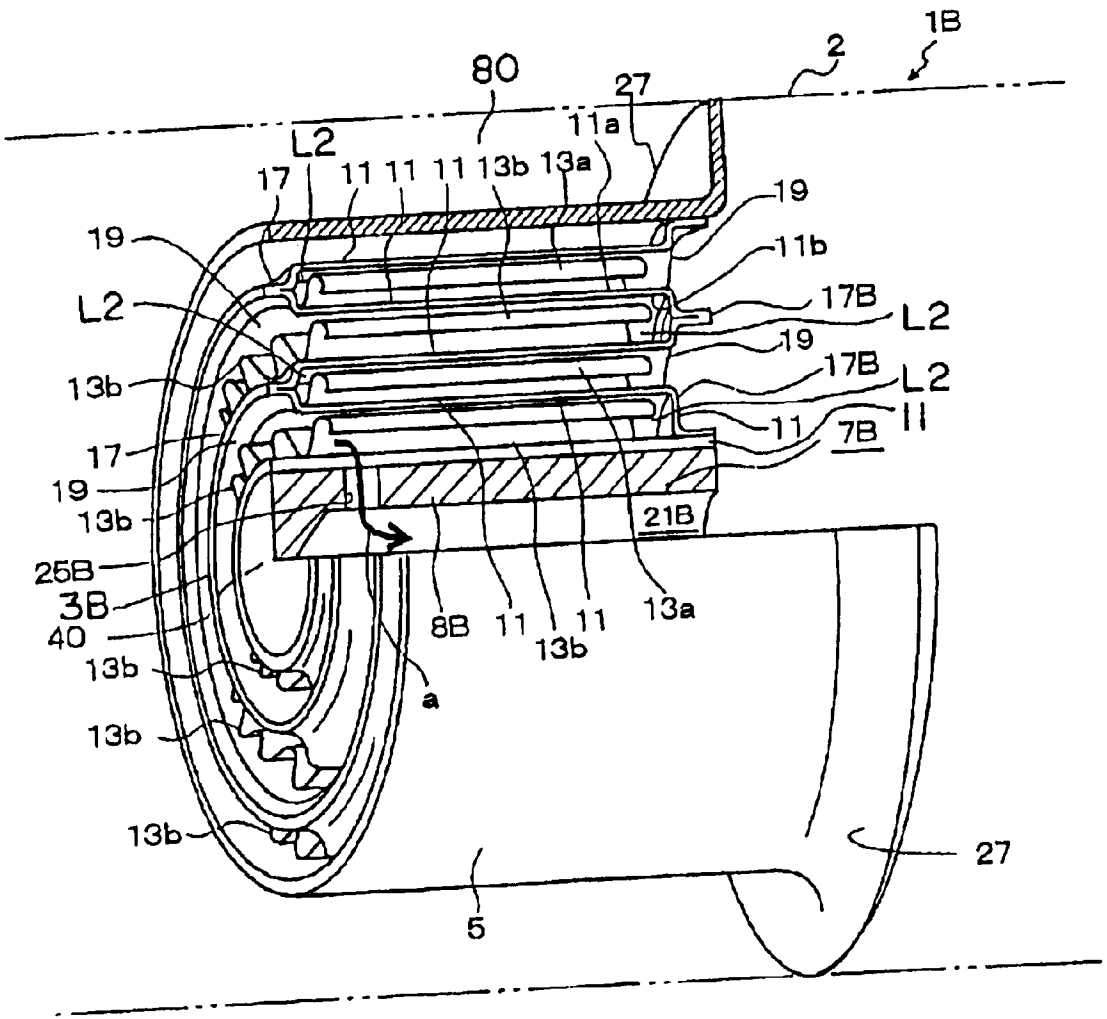
FIG. 10 is a perspective view with some portions cut away, showing the particulate filter in a third embodiment of the present invention.
Figure 11:
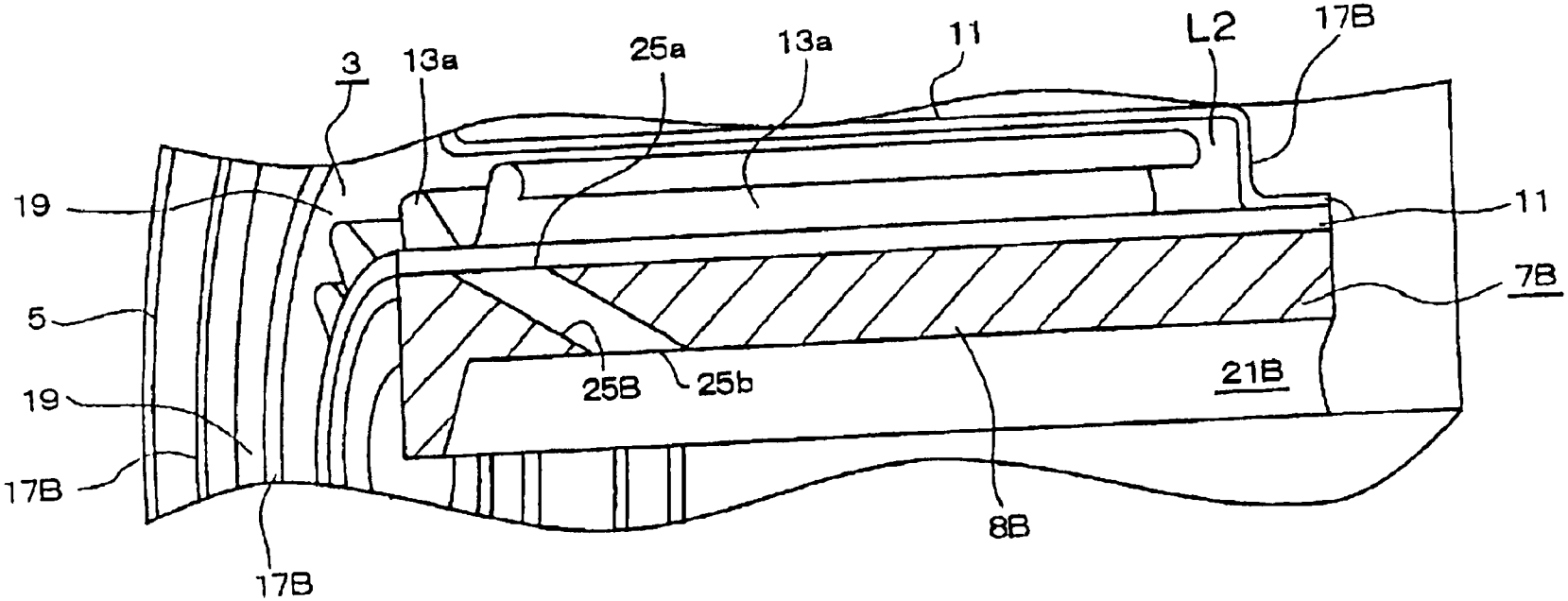
FIG. 11 is an enlarged view with some portions modified in FIG. 10.

In addition, what is shown as the though-hole 25B in FIG. 10 is the one holed at the right angle to the peripheral wall 8B. As illustrated in FIG. 11, however, the through-hole 25B may be an oblique hole holed obliquely to the peripheral wall 8B. Namely, the through-hole 25B is formed in the axial core 7B obliquely extending from the upstream side of the engine exhaust passageway towards the downstream side. An upstream-sided opening 25*a* of the through-hole 25B is disposed on the side of the multi-layer member along the axial core 7B, precisely on the side of the non-woven fabric defined as the constructive member of the multi-layer member, while a downstream-sided opening 25*b* thereof is disposed on the side of the hollow 21B.

The thus configured particulate filter 1B in the third embodiment has substantially the same operational effects as those of the particulate filter 1A in the second embodiment (see FIGS. 8 and 9) except for the following operational effects based on the difference in the configuration from the particulate filter 1A according to the second embodiment.

The peripheral wall 8B of the axial core 7B has the through-hole 25B communicating with the hollow 21B and the multi-layer member along the axial core, and hence some proportion of the exhaust gas having flowed into the cylindrical multi-layer body 3B flows into the hollow 21B from outside the axial core via the through-hole 25B (as indicated by an arrowhead a in FIG. 10). Therefore, a quantity of the exhaust gas flowing through the cylindrical multi-layer body 3B decreases correspondingly, and an exhaust gas pressure at a portion formed by the multi-layer member in the cylindrical multi-layer body 3B decreases corresponding thereto.

Hence, the welding of the sealing portion 17B formed by welding downstream of the cylindrical multi-layer body 3 is hard to taken off. Accordingly, it does not happen that the welding of the sealing portion 17B is taken off. This is therefore effective in preventing damage to the particulate filter 1B.

Incidentally, there arises skepticism that the exhaust gas entering the hollow 21B of the axial core 7B via the through-hole 25B might be discharged into the atmospheric air without the PM being thoroughly scavenged by the non-woven fabric 11. The multi-layer member wound on the axial core 7B, however, covers the through-hole 25*b* as well. Hence, the exhaust gas, when flowing through the through-hole 25B, passes through the non-woven fabric 11 defined as the constructive member of the cylindrical multi-layer body 3B, so that there is no necessity of having such a doubt that the PMs contained in the exhaust gas discharged into the atmospheric air via the hollow 21B of the axial core 7B and via the through-hole 25B as well, might not be scavenged.

Further, if the through-hole 25B is formed as the oblique hole, the exhaust gas flowing towards the axial core 7B from the multi-layer member enters more smoothly the hollow 21B via the through-hole 25B than when the through-hole 25B is holes at the right angle to the central axis of the axial core 7B. Namely, the exhaust gas pressure at the portion formed by the multi-layer member in the cylindrical multi-layer member 3 is further reduced. As a result, a larger quantity of the exhaust gas can be discharged correspondingly into the atmospheric air via the through-hole 25B, and therefore a burden needed for the sealing portion 17B can be further reduced. Consequently, this is much more effective in preventing the damage to the particulate filter 1B.

<Fourth Embodiment>

Figure 12:
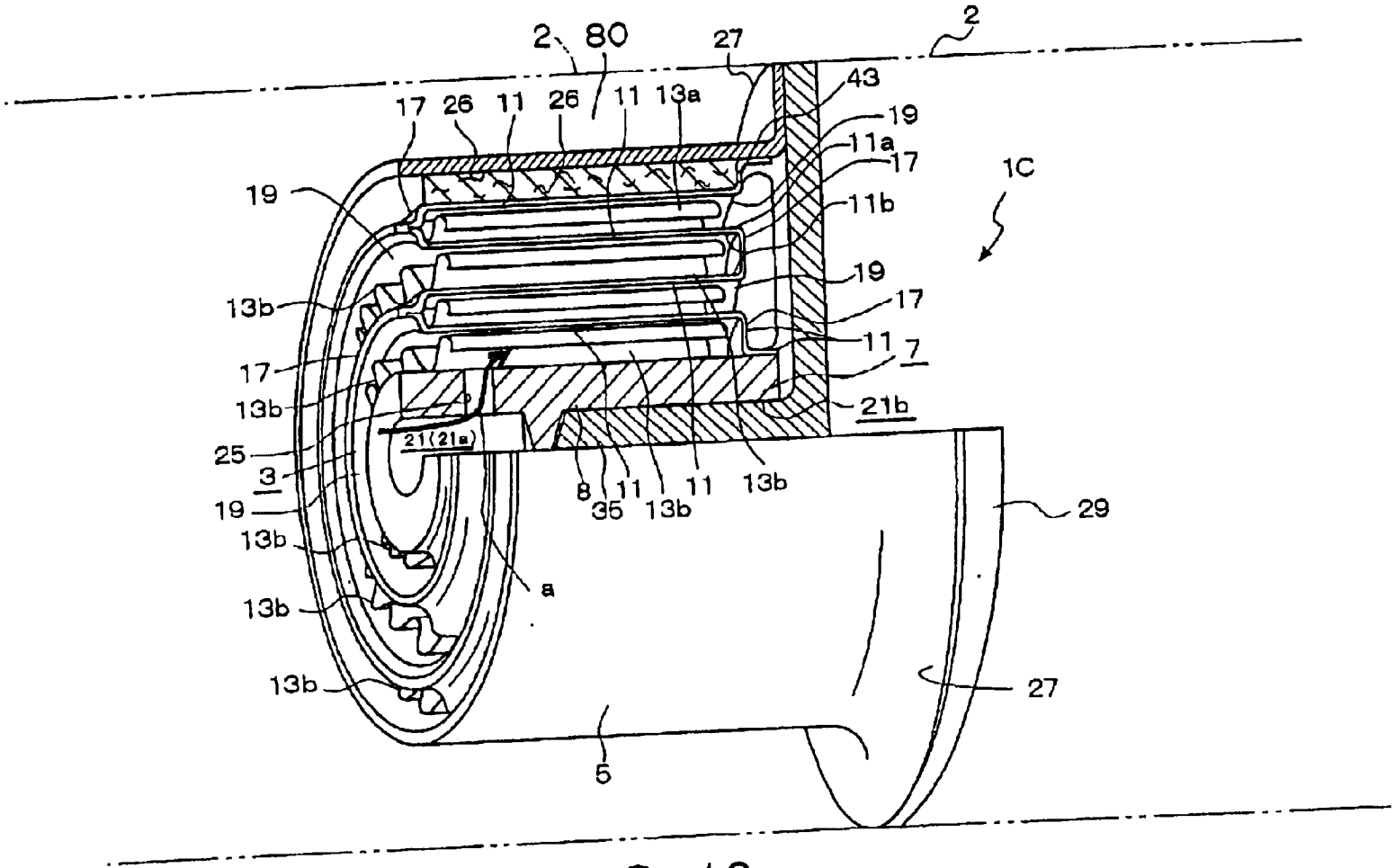
FIG. 12 is a perspective view with some portions cut away, showing the particulate filter in a fourth embodiment of the present invention.
Figure 13:
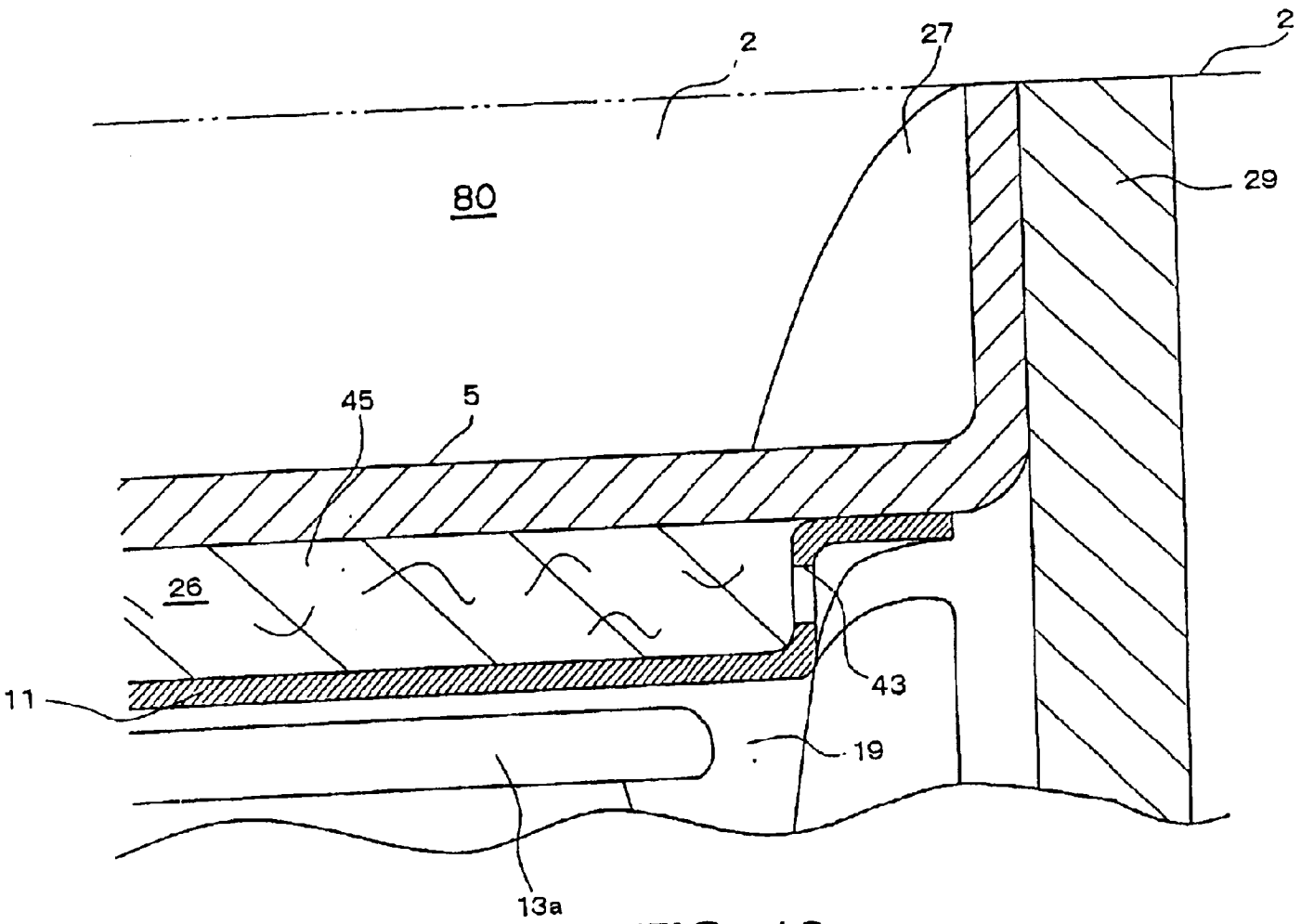
FIG. 13 is an enlarged view showing the principal portions in FIG. 12.

A fourth embodiment will be explained referring to FIGS. 12 and 13.

The following is a different point of a particulate filter 1C in the fourth embodiment from the particulate filter 1 in the first embodiment (see FIGS. 1 through 7). There is formed a flow-past hole 43 through which the exhaust gas flows straight to the downstream side of a passageway narrower than other passageways among the passageways for letting the exhaust gas through within the particulate filter 1C, to be more specific, straight to the downstream side of an air space 26 formed between the outer surface of the cylindrical multi-layer body 3 and the inner surface of the metal container 5, and the air space 26 is filled with a porous material 45 such as the non-woven fabric etc having a maximum void ratio capable of scavenging the PMs. Hence, the same components as those of the particulate filter 1 in the first embodiment are marked with the same numerals, and their repetitive explanations are omitted. Note that the porous material 45 may not be provided.

There exists, however, a problem in the scheme that the narrow passageway, though small in quantity of the exhaust gas flowing therethrough because of being narrow, lets the exhaust gas flow straight. It is therefore of importance that the particulate filter is previously reproduced before the exhaust gas flows through the flow-past hole.

The thus configured particulate filter 1C in the fourth embodiment exhibits the following operational effects in addition to the operational effects exhibited by the particulate filter 1 in the first embodiment.

That is, the air space 26 as the narrow passageway described above is filled with the porous material 45, and it is preferable that the PMs such as at least the soot etc can be thereby scavenged without simply letting the exhaust gas flow straight. The arrangement that the air space 26 formed between the outer surface of the cylindrical multi-layer body 3 and the inner surface of the metal container 5 is the passageway narrower than other passageways among the passageways within the particulate filter 1C, is schemed to prevent the cylindrical multi-layer body 3 from impinging upon the metal container 5 due to the vibrations because of this impingement being easy to occur if the air space 26 formed between the outer surface of the cylindrical multi-layer body 3 and the inner surface of the metal container 5 is large. Further, it is because, with this structure taken, a capacity of the cylindrical multi-layer body 3 can be made as large as possible enough to enlarge the area for scavenging the PMs, and the exhaust resistance when scavenging the PMs can be reduced.

(Others)

Moreover, the non-woven fabric 11 used for the particulate filter has following pieces of data that are common throughout the embodiments discussed above.

The non-woven fabric 11 will be explained referring to FIGS. 14 to 16.

Figure 14:
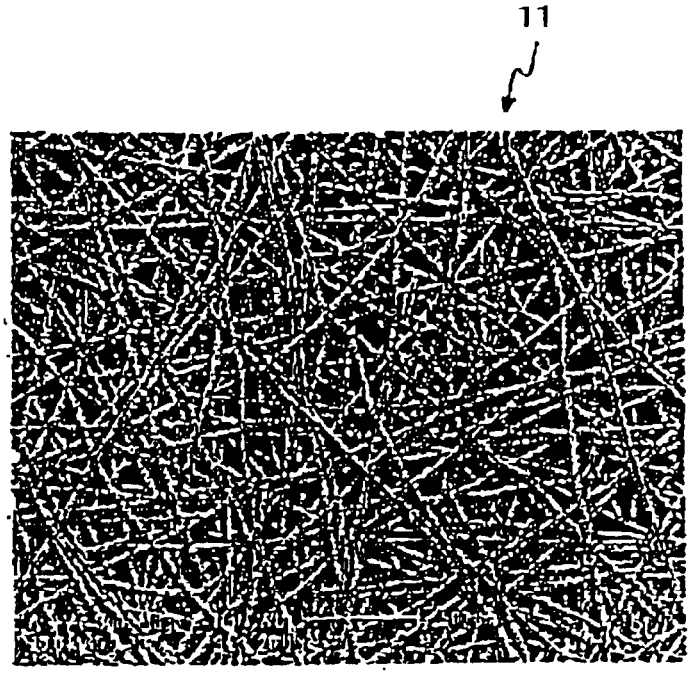
FIG. 14 is a view showing a state of photographing a non-woven fabric of the present invention before particulate matters are deposited by use of an SEM.
Figure 15:
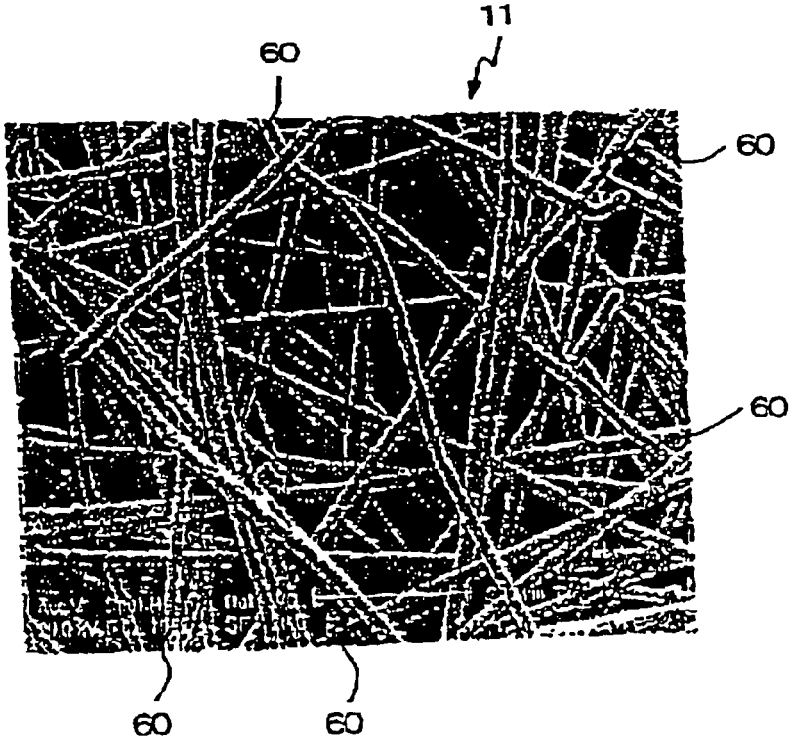
FIG. 15 is a partially enlarged view of FIG. 14.
Figure 16:
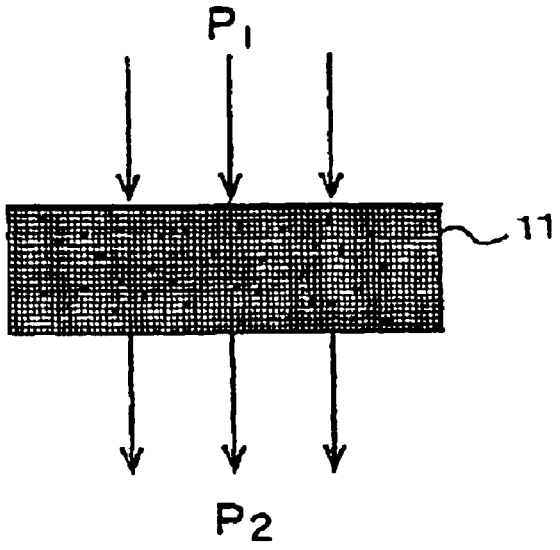
FIG. 16 is a view showing a state in which the ashes permeate into the non-woven fabric according to the present invention.

FIGS. 14 and 15 are photos each showing the surface of the non-woven fabric 11 by use of an SEM (Scanning Electron Microscope), and showing a state where the ashes etc are not deposited. Further, FIG. 15 shows the surface at a greater rate of enlargement than in FIG. 14.

In this non-woven fabric 11, a line diameter of a metal fiber 60 constituting the non-woven fabric 11 is set within a range of 10 to 50 $\mu$m. Further, the void ratio defined as a rate of the capacity of the gap contained in the non-woven fabric 11 with respect to the unit capacity of the non-woven fabric 11, is set to any one of the void ratios falling within a range of 50 to 85%, and a dimension of the thickness thereof falls within a range of 0.2 to 1.0 mm.

Then, the present inventors discovered that an ash deposition quantity, in the case of using the non-woven fabric 11 having the data described above, can be remarkably decreased even at a temperature on the order of, e.g., 600° C. conceived as a soot combustible temperature less than 1000° C. conceived as an ash combustible temperature.

Moreover, the present inventors pursued for a cause that neither the ash nor the soot is deposited on the non-woven fabric 11, and discovered that the ash and soot (see black dots in FIG. 16) permeate into the fibers of the non-woven fabric 11. The symbols P1 and P2 represent an upstream-sided pressure and a downstream-sided pressure in the case of installing the particulate in the engine exhaust system, and there is established a relationship such as P1>P2. The reason why the upstream-sided pressure P1 is higher than the downstream-sided pressure P2 may be given as one factor of being attributed to the exhaust pulses.

Figure 17:
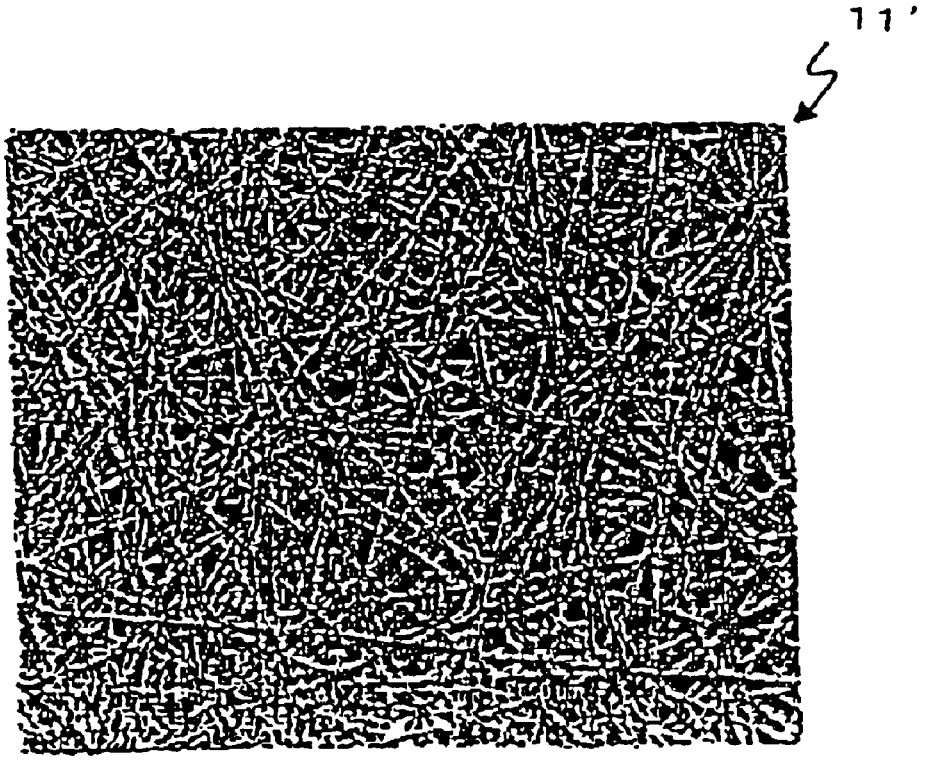
FIG. 17 is a view showing a state of photographing a non-woven fabric in a comparative example 1 before the particulate matters are deposited by use of the SEM.
Figure 18:
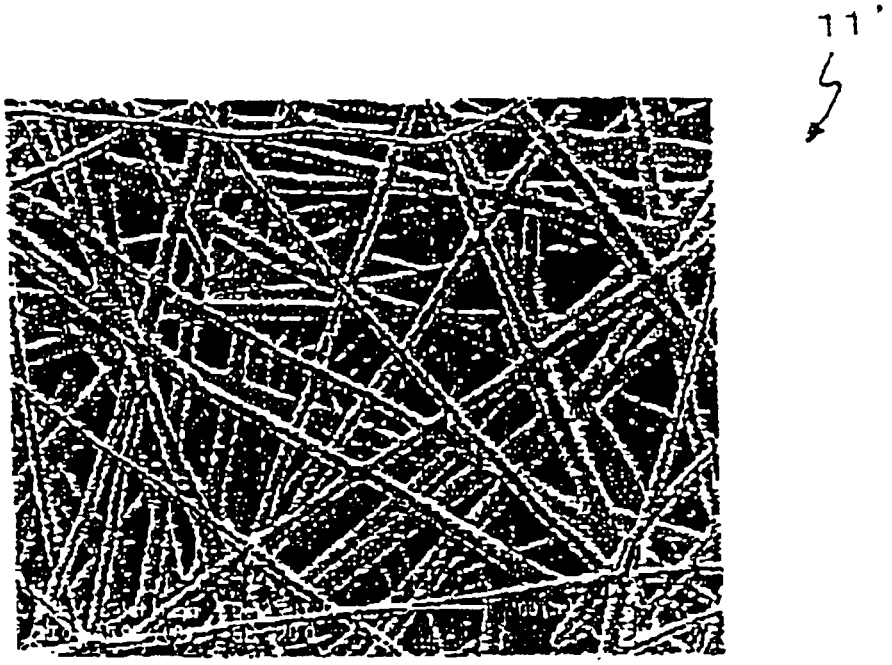
FIG. 18 is a partially enlarged view of FIG. 17.

FIGS. 17 and 18 are views showing states where a non-woven fabric 11' (a comparative example 1) that does not contain the above data is photographed by use of the SEM in contrast with the non-woven fabric 11, and correspond to FIGS. 14 and 15, respectively.

Figure 19:
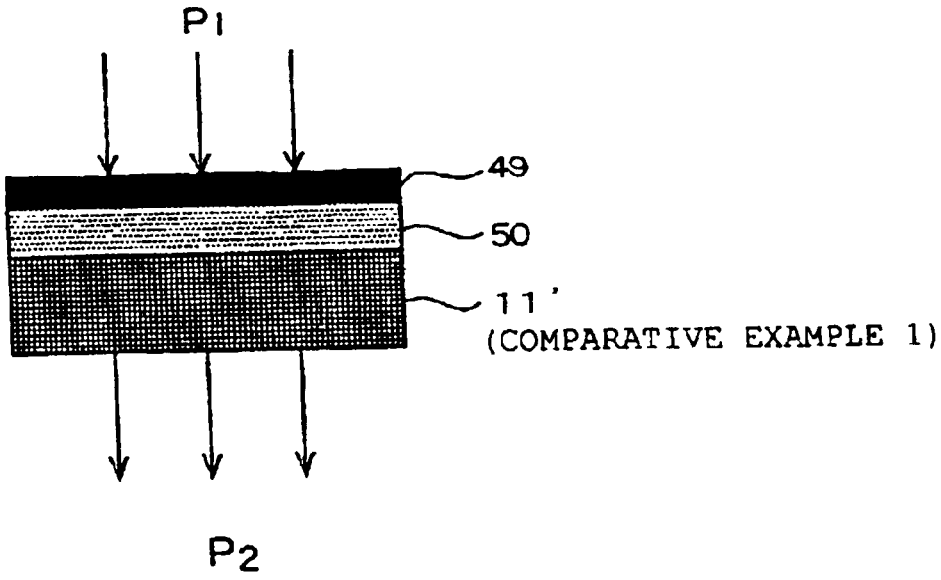
FIG. 19 is a schematic view showing a state where the PMs typified by soot and the ashes are deposited on the non-woven fabric in the comparative example 1.

Further, FIG. 19 is a schematic diagram showing a state where a PM 49 represented by the soot and the ash 50 are deposited on the non-woven fabric 11'. The arrowheads in FIG. 19 indicates flow directions of the exhaust gas with respect to the non-woven fabric 11', and also show a state where the PM 49 and the ash 50 are deposited in this sequence on the comparative example 1. The symbols P1 and P2 represent the same as those in FIG. 15.

Moreover, the present inventors elucidated the reason why the ash is hard to deposit on the non-woven fabric if at least the void ratio and the line diameter among the void ratio, the line diameter and the thickness fall within the specified ranges described above.

This reason will be given in sequence.

Figure 20:
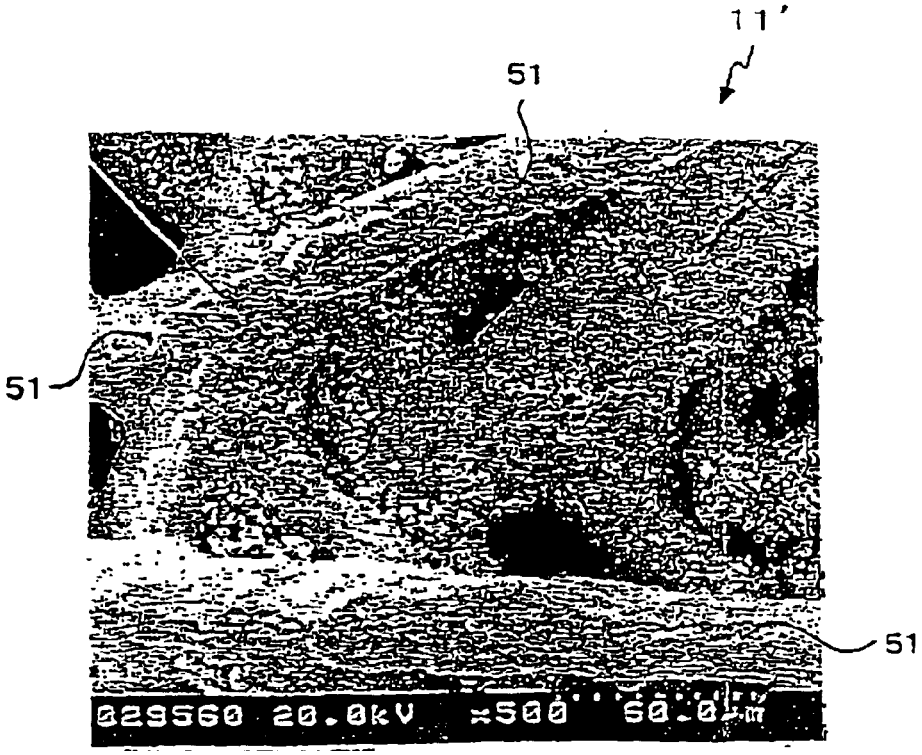
FIG. 20 is a view showing a photo of the non-woven fabric in the comparative example 1 before the deposition by use of the SEM.
Figure 21:
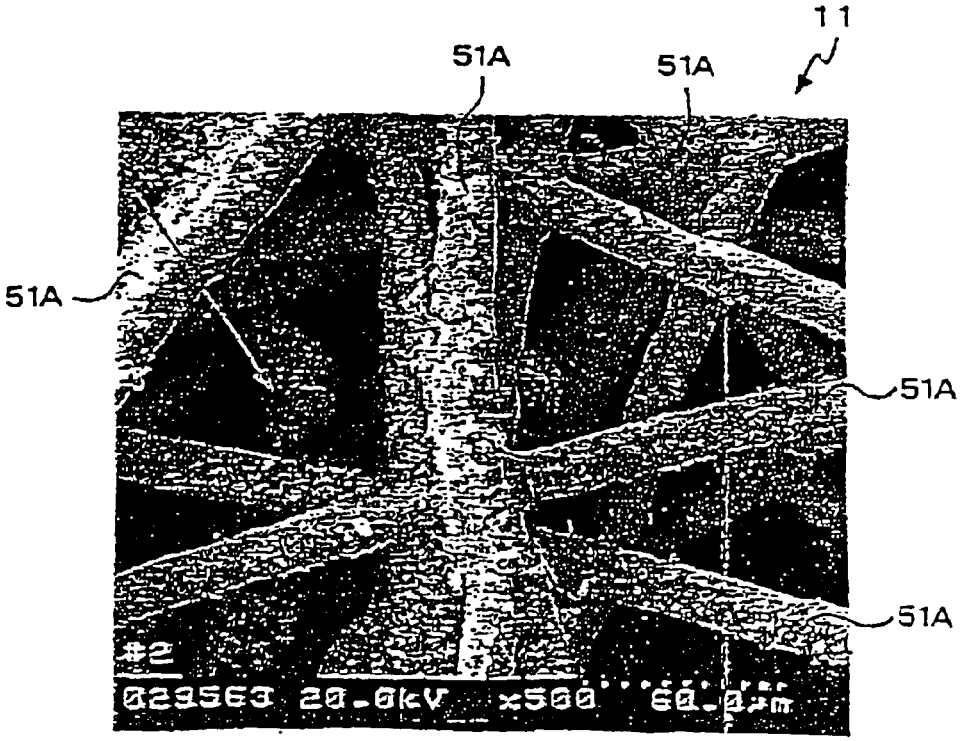
FIG. 21 is an enlarged view showing a state where the ashes are deposited on the non-woven fabric according to the present invention, which state is photographed by use of the SEM.

FIGS. 20 and 21 are enlarged photos photographed by use of the SEM, and show states where the ash etc is deposited on the non-woven fabric 11' and the non-woven fabric 11, respectively.

Referring to FIG. 20, lines 51, 51, . . . extending at random each indicate a state where the PM 49 and the ash 50 such as the soot are adhered to the metal fibers of the non-woven fabric 11'.

By contrast, FIG. 21 shows the non-woven fabric 11 that may be said to be a counter measure version according to the present invention. It can be understood also in FIG. 21 that lines 51A, 51A, . . . extending at random indicate that the PM 49 such as the soot and the ash 50 are adhered to the metal fibers of the non-woven fabric.

It can be also understood from the comparison between the non-woven fabric 11' in the comparative example shown in FIG. 20 and the non-woven fabric 11 as the countermeasure version shown in FIG. 21 that a less quantity of the soot and ash are deposited on the metal fibers 51A, 51A, . . . of the non-woven fabric 11 as the countermeasure version. Hence, an original shape of the metal fiber is clearly distinctive in FIG. 21, and by contrast the original shape of the metal fiber in FIG. 20 is not distinctive because of a large quantity of the soot and ash.

The difference in depositions of the soot and ash between the non-woven fabric 11' in the comparative example 1 and the non-woven fabric 11 as the countermeasure version is clear. However, the principle of how the ash etc is deposited on the metal fibers will be explained before elucidating the reason therefore.

If the exhaust gas impinges perpendicularly upon the metal fibers, vortexes swirling in the directions opposite to each other are alternately produced from both side of the metal fibers, and thus a so-called Karman vortex street occurs. Then, a rear portion of the metal fibers comes to an extremely low pressure state as proximal as a vacuum due to the influence of the Karman vortex street. Therefore, at this rear portion, the ash and soot are hard to blow away, and there appears an environment where the ash and soot are easily deposited.

Consequently, the ash and the soot are gradually deposited and eventually grown into a bridge, and further, if the ash, etc. is deposited on even this bridge, the metal fiber loses its original shape as seen in the photo in FIG. 20.

In the case of using the non-woven fabric 11 having the data as shown in FIG. 21, however, the so-called bridge configured by pile-ups of the ashes, etc. is hard to form. Moreover, if the void ratio is high even when the bridge comes into shape, the bridge becomes elongate and fragile in strength. Hence, the ash etc is hard to deposit.

Further, the ashes are physically deposited on the surfaces of the metal fibers, and a size of this deposition is small in proportion to a size of the gap between the metal fibers. Accordingly, when receiving the strong pressure (P1 given above) based on a strong impact as by the exhaust pulses from the exhaust upstream side, the ashes and soot permeate into the gaps between the metal fibers as shown in FIG. 16, and therefore become hard to deposit as shown in FIG. 19.

Moreover, the bridge is harder to come into shape in the case of permeating into the gaps between the metal fibers than in the case of depositing thereon, and consequently the exhaust resistance gets smaller. Therefore, a load on the metal fibers can be reduced corresponding thereto, so that the sealing portion 17B becomes durable.

Then, the soot permeating into the non-woven fabric can be burnt with the heat having a temperature on the order of 600° C., and the ashes incombustible at such a temperature are, if the impact force as by the exhaust pulses is applied, discharged out of the gaps between the metal fibers of the non-woven fabric 11. The ash itself is, as already described, lime, and therefore, if discharged into the atmospheric air, no particular problem may arise.

The present inventors clarified for the first time as a result of the concentrated endeavors that when the particulate filter involving the use of the non-woven fabric 11 as the countermeasure version is used in the engine exhaust system, the ashes etc are not deposited on the metal fibers but permeate in between the metal fibers.

The particulate filter according to the present invention, which involves the use of the non-woven fabric 11 based on the knowledge clarified above, is capable of highly effectively preventing the clogging in the cylindrical multi-layer body.

Figures 22, 23:
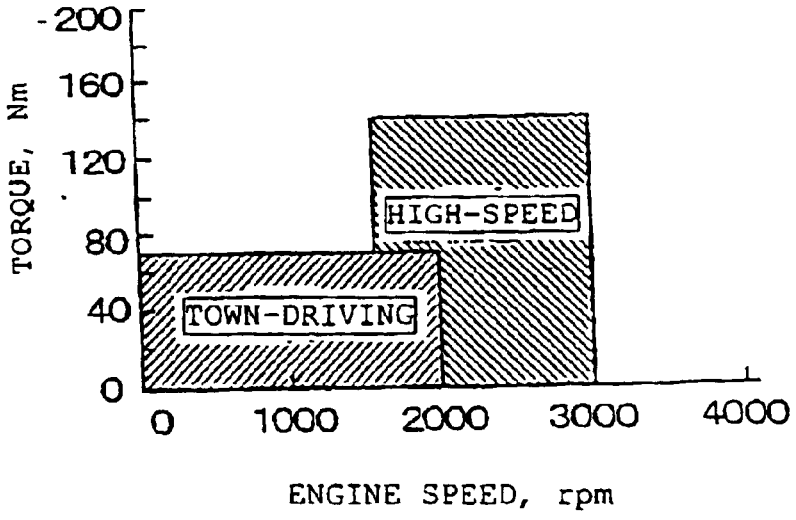
FIG. 22 is a diagram showing a comparative table of deposition quantities on the non-woven fabric in the comparative example 1 and on the non-woven fabric (countermeasure version) of the present invention.
FIG. 23 is a graph showing visualized driving areas in a town-driving mode and in a high-speed mode.

Further, FIG. 22 is a table showing a comparison between the comparative example 1 and the non-woven fabric having the data described above, and showing depositing rates of the ash, etc. on the respective non-woven fabrics. It can be understood from this table that the rate of the deposition on the non-woven fabric as the countermeasure version is smaller by approximately 20% when driving with the same engine both in a through-town mode and in a high-speed mode.

FIG. 23 is a graph in which driving areas in the through-town mode and in the high-speed mode are visualized. FIG. 23 schemes to shows a visualized display that the through-town mode has a torque within a range of 0 to approximately 70 Nm and an engine speed within a range of 0 to 2000 rpm, and the high-speed mode has a torque within a range of approximately 0 to approximately 140 Nm and an engine speed within a range of 1600 to 3000 rpm.

<Fifth Embodiment>

Figure 24:
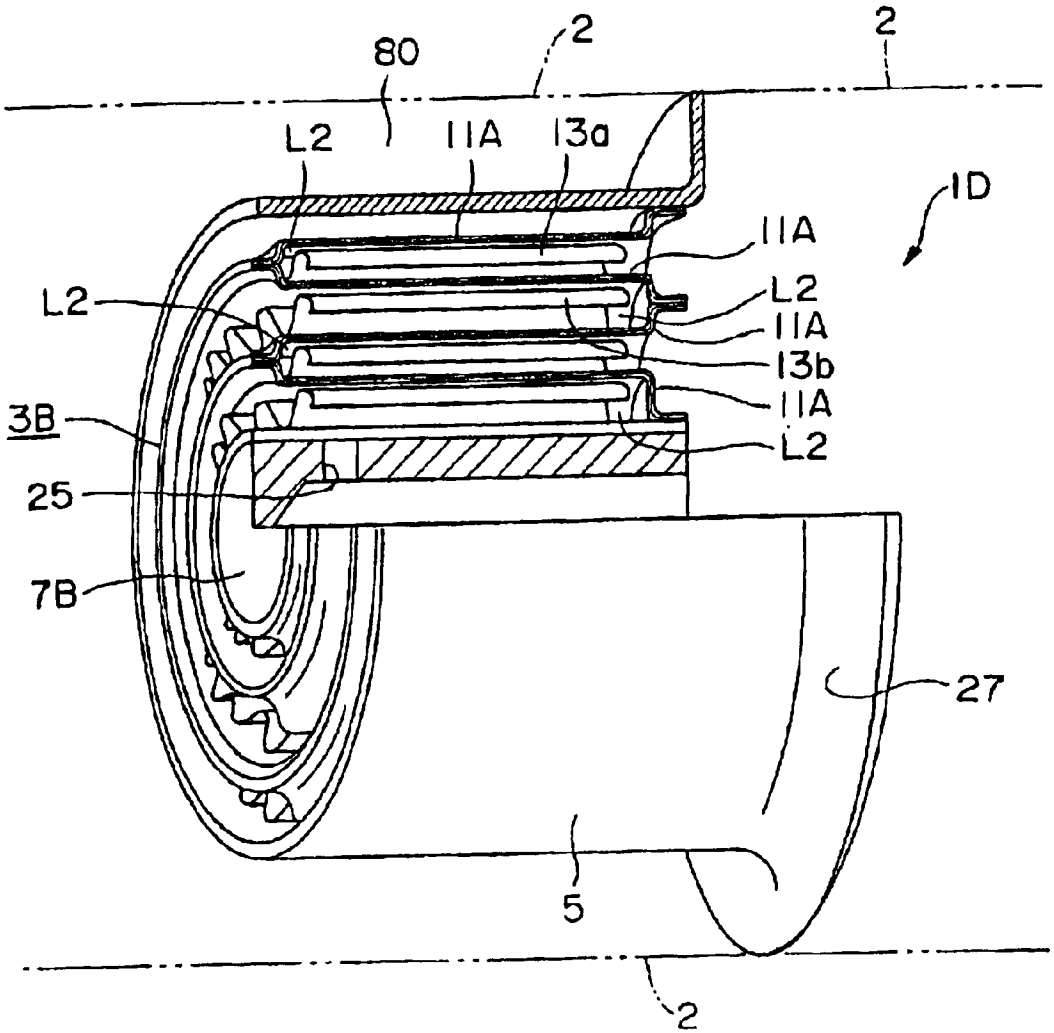
FIG. 24 is a perspective view with some portions cut away, showing the particulate filter in a fifth embodiment of the present invention.
Figure 25:
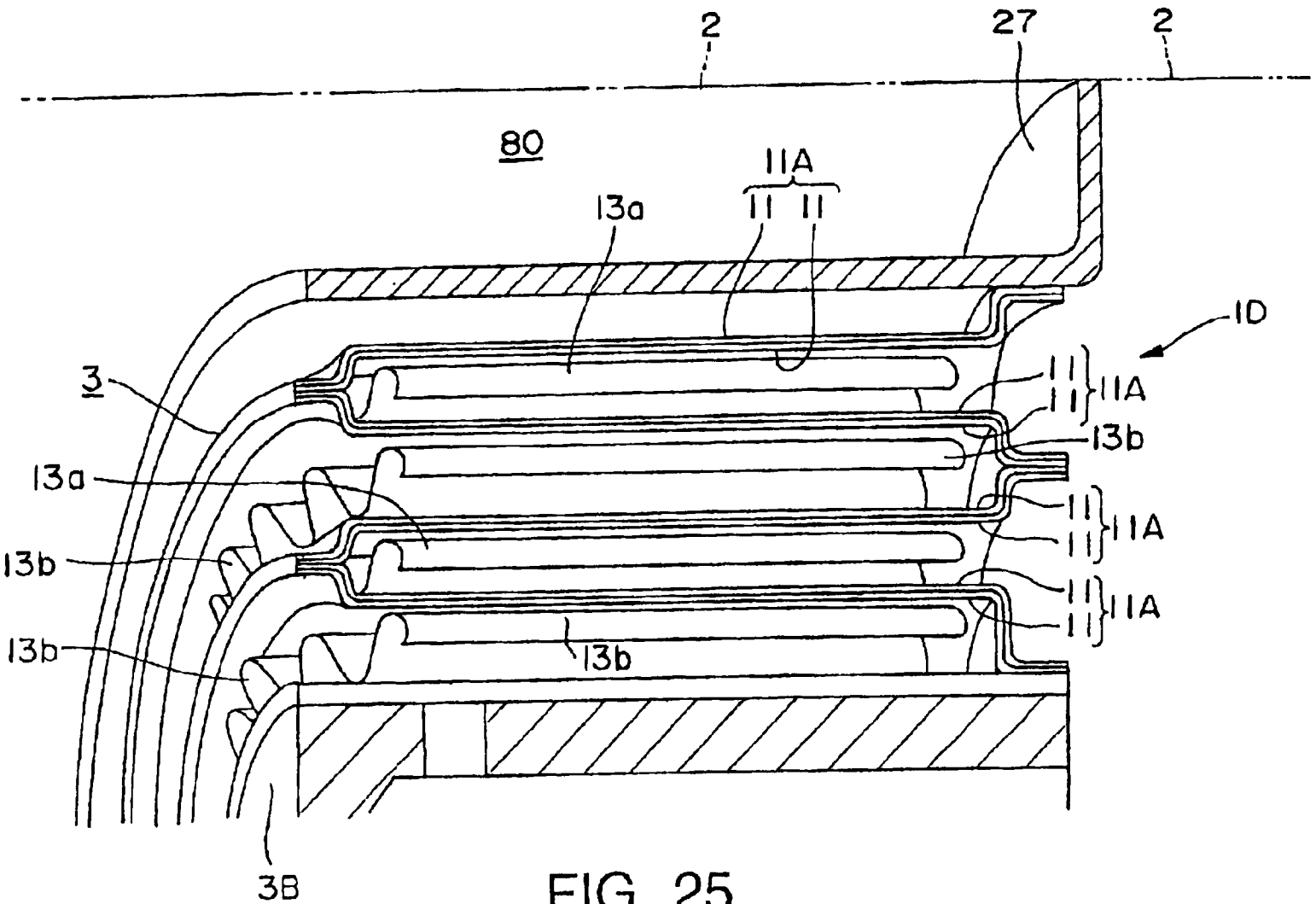
FIG. 25 is an enlarged view showing the principal portions in FIG. 24.

Next, a fifth embodiment will be described with reference to FIGS. 24 and 25.

A different point of a particulate filter 1D in the fifth embodiment from the particulate filter 1B in the third embodiment (see FIGS. 10 and 11), is that plural sheets of non-woven fabrics 11, 11, . . . each having a different void ratio are integrally layered into one sheet of non-woven fabric 11A having a multi-layer structure. Then, a multi-layer body 3B is composed of this non-woven fabric 11A and the corrugated sheet 13. The non-woven fabric 11A having the multi-layer structure relative to the bag-shaped layer portion L2 that serves as a constructive portion of the multi-layer body 3B, is configured in a way that decreases stepwise the void ratio of the single non-woven fabric 11 in sequence from the single non-woven fabric 11 disposed on the side of an inlet of the exhaust gas down to the single non-woven fabric 11 disposed on the side of an outlet of the exhaust gas. Namely, the non-woven fabric 11A takes the integral hierarchical structure in which the void ratio changes stepwise. Then, the stepwise change of the void ratio is set within a range of 80% to 60%.

According to the fifth embodiment, however, two sheets of non-woven fabrics 11 each having the different void ratio are integrally layered into one sheet of non-woven fabric 11A having the two-layered structure. The multi-layer body 3B is composed of this non-woven fabric 11A and the corrugated sheet 13. The non-woven fabric 11A having the two-layered structure relative to the bag-shaped layer portion L2 that serves as the constructive portion of the multi-layer body 3B, is configured so that the void ratio of the single non-woven fabric 11 disposed on the side of the inlet of the exhaust gas is higher than that of the single non-woven fabric 11 disposed on the side of the outlet of the exhaust gas. In this case, the void ratio of the single non-woven fabric 11 disposed on the side of the inlet of the exhaust gas and the void ratio of the single non-woven fabric 11 disposed on the side of the outlet of the exhaust gas, are set to 80% and 60%, respectively.

Hence, the same components as those of the particulate filter 1B in the third embodiment are marked with the same symbols, and the repetitive explanations are omitted. For making the different points distinctive, however, putting the symbols concentrates on the different components, and putting the symbols on the same other components is minimized to the degree required. Further, sixth and seventh embodiments that will hereinafter be described take the way of marking the components with a minimum number of symbols required with the same gist.

The thus configured particulate filter 1D in the fifth embodiment has the following operational effects in addition to the operational effects exhibited by the particulate filter 1B in the third embodiment. In the particulate filter 1D, two or more sheets of non-woven fabrics each having hitherto taken the single structure are layered into one sheet of non-woven fabric taking the multi-layered structure, wherein the void ratio of the single non-woven fabric is set stepwise within the range of 80% to 60%. The particulate filter 1D is therefore capable of scavenging the PM in dispersion without concentrating the scavenging of the PMs at one point.

To describe it more specifically, according to the particulate filter 1D, the void ratio of the non-woven fabric 11A is not fixed and decreases stepwise from the portion on the side of the inlet of the exhaust gas towards the portion on the side of the outlet of the exhaust gas. Therefore, the PM having a comparatively large particle size is scavenged by the non-woven fabric 11 having the large void ratio, while the PM having a comparatively small particle size is not scavenged by the non-woven fabric 11 having the large void ratio but is scavenged by the non-woven fabric 11 having the small void ratio. Then, the PM having an intermediate particle size is not scavenged by the non-woven fabric 11 having the large void ratio but is scavenged by the non-woven fabric 11 having the intermediate void ratio. Accordingly, the PM can be scavenged in dispersion corresponding to the particle size of the PM. Therefore, it does not happen that the PM is scavenged in concentration at one area of the non-woven fabric, with the result that the bridge is hard to form. Hence, when the particulate filter 1D using the thus structured non-woven fabric is applied to the exhaust pipe 2, a loss of pressure can be also reduced.

Figure 26:
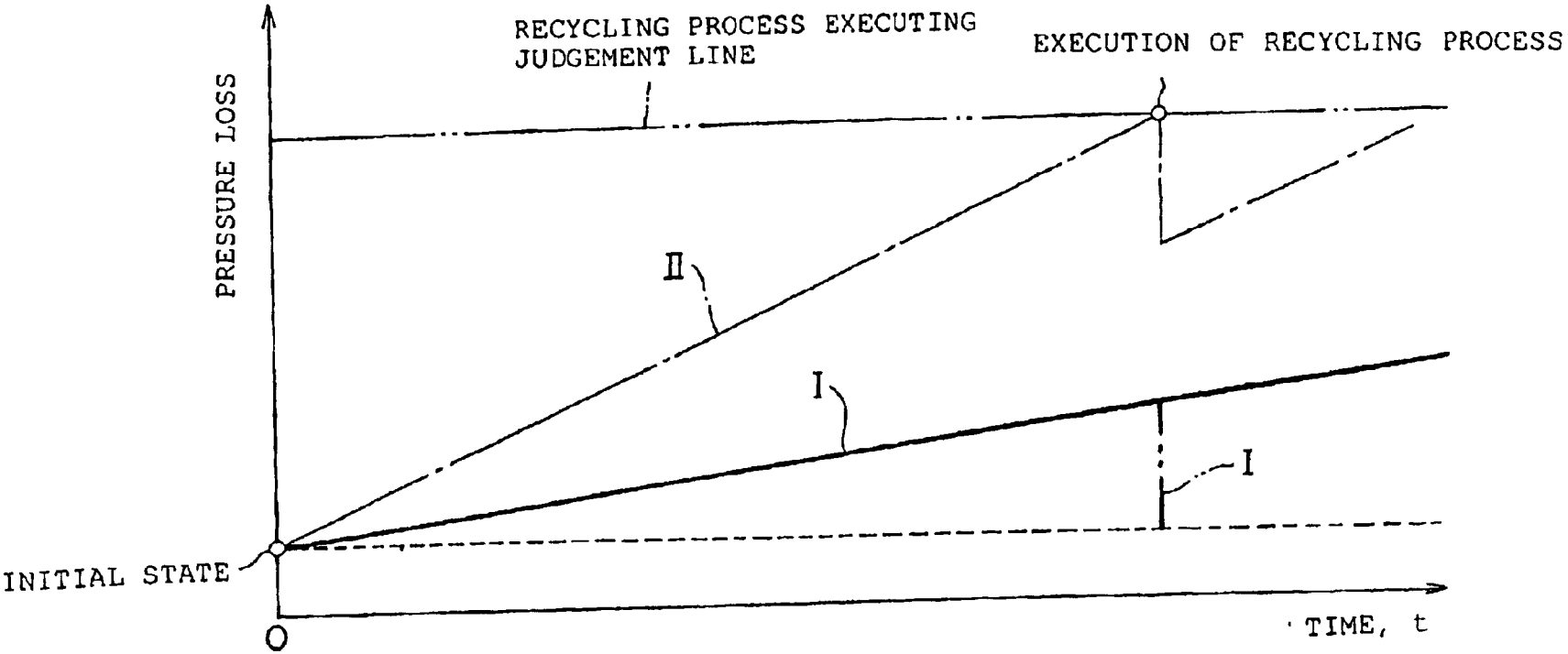
FIG. 26 is a graph showing an effect of the particulate filter in the fifth embodiment.

FIG. 26 is a graphic chart showing an effect in the fifth embodiment.

In FIG. 26, the axis of ordinates indicates the loss of pressure, and the axis of abscissa indicates the time. Further, referring to FIG. 26, the solid line I indicates a graph line of the pressure loss with respect to an elapse of the time when the particulate filter 1D in the fifth embodiment is applied to the engine exhaust system, and the one-dotted line II indicates a graph line of the pressure loss with respect to the elapse of the time when the conventional particulate filter is applied to the engine exhaust system. The broken line indicates a value of the pressure loss in the initial states of these two particulate filters, and the two-dotted line is a recycling process execution judgement line for judging whether a recycling process is needed. The implication is that the necessity of executing the recycling process arises just when the graphs I and II reache the recycling process execution judgement line.

It can be understood from FIG. 26 that since a gradient of the graph line II is larger than a gradient of the graph line I, the fifth embodiment shows a smaller pressure loss if within the same period of time, and hence a frequency of executing the recycling process can be decreased.

Further, the graph line II shows that the pressure loss does not reach the level of the initial state with only one execution of the recycling process, and therefore the recycling process must be executed a plurality of times, or a recycling process execution time per execution must be increased. By contrast, according to the particulate filter 1D in the fifth embodiment, at a stage where the graph line II reaches a point of time when the recycling process is to be executed, it does not yet come to a state of requiring the execution of the recycling process. If the recycling process is executed at this point of time, however, it can be understood that the pressure loss can be decreased down to the level of the initial state simply by executing the recycling process once. Here, it is assumed a throughput of the recycling process for each execution is the same with respect to both of the particulate filter 1D and the conventional particulate filter.

The recycling process is, as already described, the process for eliminating a trouble in the PM-scavenging of the particulate filter by periodically burning and thus removing the scavenged PMs in a way that makes the use of the heat of the exhaust gas and of the electric heater and thereby preventing the clogging. Therefore, a decreased frequency of executing this recycling process leads to an improved fuel consumption, and works highly effectively on reducing a quantity of the power consumption.

In the case of the non-woven fabric 11A taking the two-layered structure, the PM having the comparatively large particle size is scavenged by the non-woven fabric 11 having the large void ratio, and the PMs having the intermediate and small particle sizes are scavenged by the non-woven fabric 11 having the small void ratio.

Figure 27:
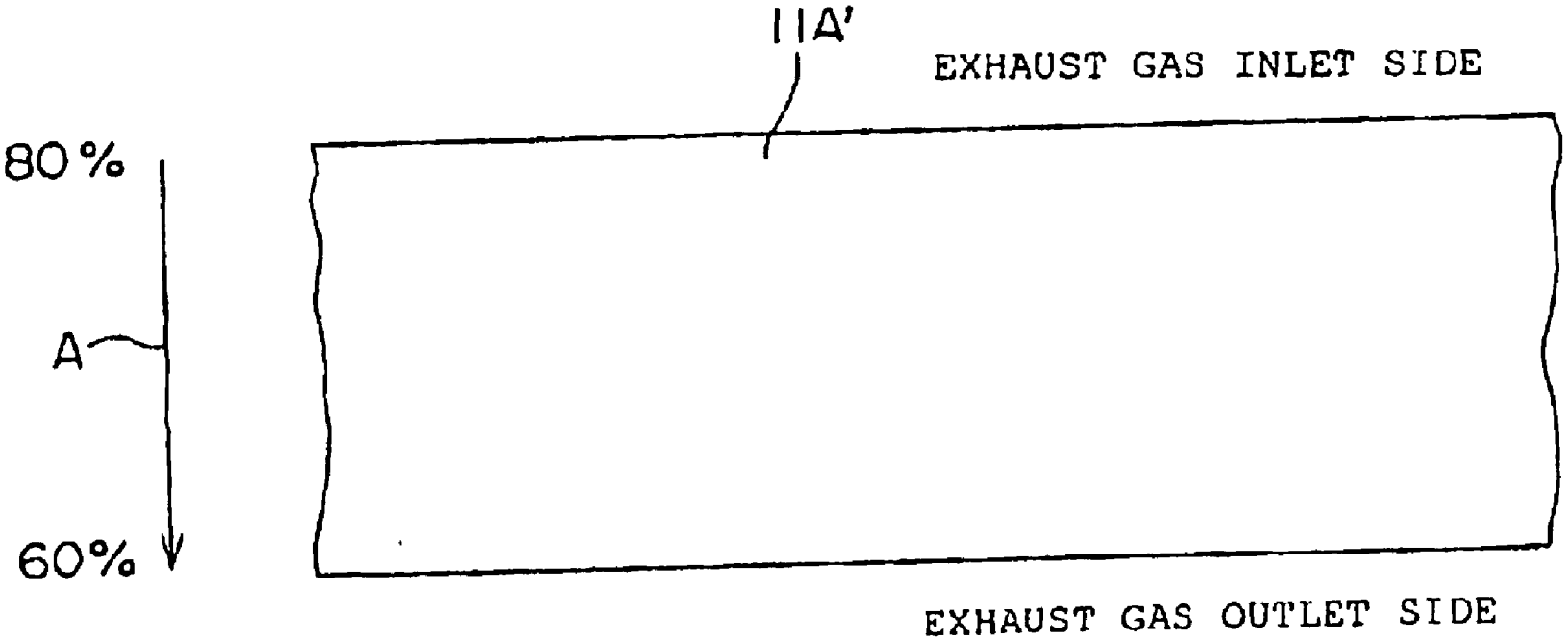
FIG. 27 is a diagram showing a change in void ratio of the non-woven fabric.

Further, as shown in FIG. 27, the non-woven fabric may be formed as a non-woven fabric 11A' taking a mono-layered structure, and the void ratio thereof may be gradually decreased from the portion on the side of the inlet of the exhaust gas toward the portion on the side of the outlet of the exhaust gas in the non-woven fabric 11. In this case, it is desirable that the stepwise change in the void ratio be set to gradually change within the range of 80% to 60% from the inlet side of the exhaust gas of the bag-shaped layer portion towards the outlet side of the exhaust gas (see an arrowhead A indicating the change in the void ratio).

In this case, the arrangement is not that the plurality of non-woven fabrics each having the different void ratio are layered integrally into one sheet of non-woven fabric but that the void ratio is changed within one sheet of non-woven fabric. Therefore, it is a matter of course that substantially the same effects as in the case of the non-woven fabric taking the multi-layered structure, and, there being no necessity of piling up the plurality of non-woven fabrics, the operation efficiency can be enhanced correspondingly. Note that the arrangement that the stepwise change in the void ratio is set to gradually change within the range of 80% to 60% from the inlet side of the exhaust gas of the bag-shaped layer portion towards the outlet side of the exhaust gas, can be also applied to other embodiments.

Incidentally, the numerical values (80% to 60%) of the void ratio given above are, as a matter of course, just the exemplification of values. In short, the numerical values capable of obtaining the effects described above in the fifth embodiment, may suffice. When the void ratio falls within the range of 80% to 60%, however, the present inventors performed the tests and came to the conviction that the efficiency of scavenging the PMs is high.

<Sixth Embodiment>

Figure 28:
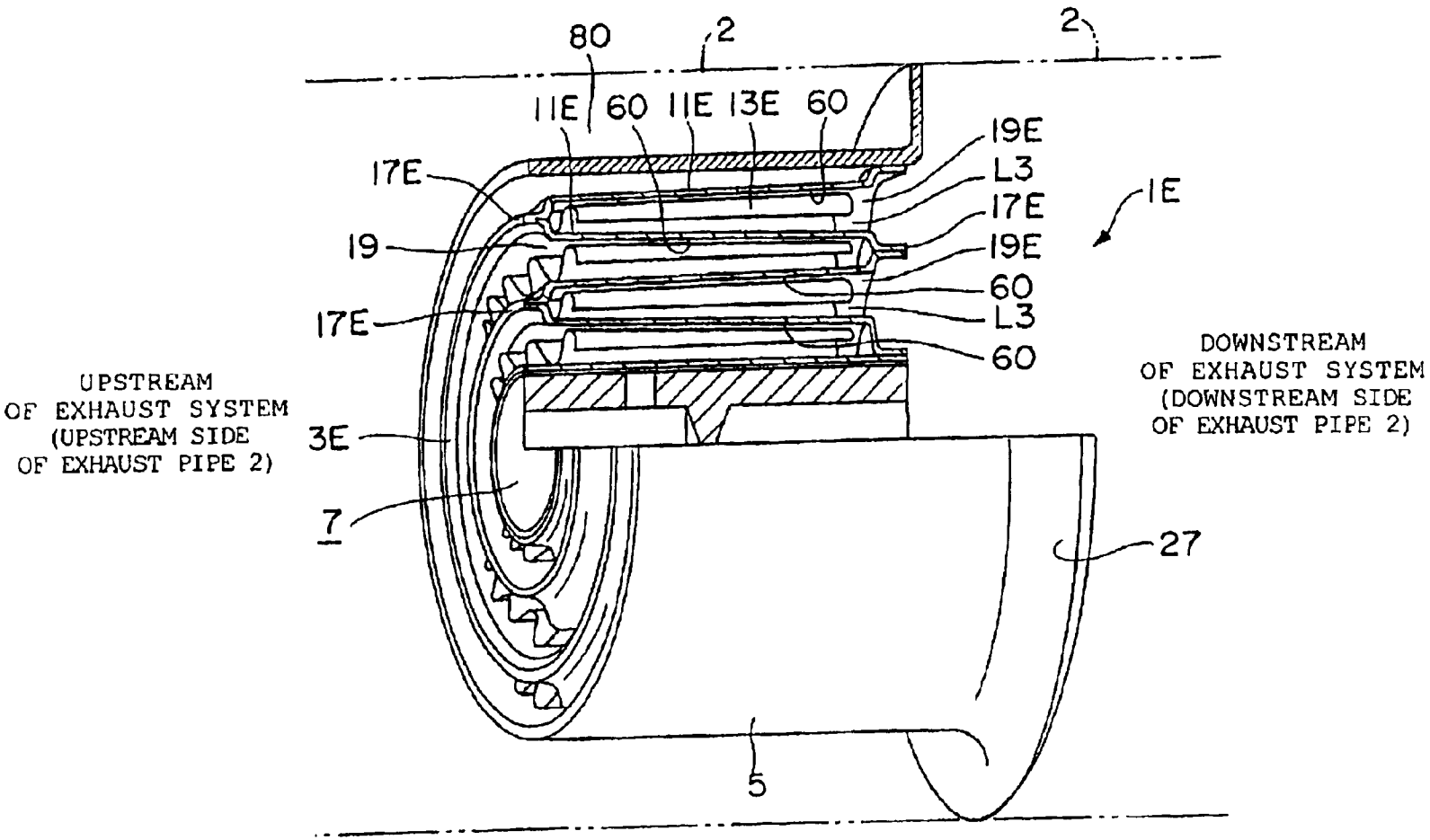
FIG. 28 is a perspective view with some portions cut away, showing the particulate filter in a sixth embodiment of the present invention.

Next, a sixth embodiment will be explained referring to FIGS. 28 and 29.

The biggest different point of a particulate filter 1E in the sixth embodiment from the particulate filter 1B in the third embodiment (see FIGS. 10 and 11), is that the multi-layer body is formed a truncated cone shape. Note that the axial core used herein is not the axial core 7B in the third embodiment but the same as the axial core 7 in the first embodiment (see FIGS. 1 to 7).

Hence, the same components as those of the particulate filter 1B in the third embodiment and the axial core corresponding to the axial core in the first embodiment, are marked with the same numerals, and the repetitive explanations thereof are omitted.

The particulate filter 1E in the sixth embodiment includes the axial core 7 composed of the heat resistance metal, a multi-layer body 3E taking the truncated cone shape configured by winding the axial core 7 with a multi-layer member into which a non-woven fabric 11E and a corrugated sheet 13E each composed of the heat resisting metal are layered, and the metal container 5 charged with this multi-layer body 3E. Then, a sealing portion 17E for sealing the leading edges of adjacent layers of non-woven fabric 11E and a non-sealing portion 19E opened, are alternately formed in the radial direction at both side ends of the truncated cone-shaped multi-layer body 3E. With these sealing and non-sealing portions 17E, 19E ensured, there are formed bag-shaped layer portions L3, L3, . . . each having one side end closed and the other side end opened and including an inclined surface 60 taking a fan-shape from the closed side toward the opened side. The corrugated sheet 13E is disposed in a fan-shape within the bag-shaped layer portion L3.

Then, in a state where a large-diameter portion of the truncated cone-shaped multi-layer body 3E is disposed downstream of the exhaust pipe 2 defined as the constructive member of the exhaust system, the particulate filter 1E is fitted to the exhaust pipe 2.

The operational effects of the thus configured particulate filter 1E in the sixth embodiment will sequentially be explained.

By the way, when the PM is scavenged by the particulate filter, if the multi-layer member is cylindrical as in other embodiments discussed above, the PMs tend to be converged relatively on the downstream side (tail edge) in the flowing direction of the exhaust gas within the bag-shaped layer portion, with the result that the non-woven fabric is easy to have the clogging at that portion. Hence, if the stress at the tail edge that is easy to have the clogging within the bag-shaped layer portion, becomes too high, the stress occurred at this tail edge portion overwhelms its rigidity, resulting in damage such as a fracture, etc. caused in the tail edge portion.

In the particulate filter 1E according to the sixth embodiment, however, the tail edge of the corrugated sheet 13 in the bag-shaped layer portion L3 is larger (in width) than the leading edge thereof and therefore has a higher rigidity. Hence, the downstream side (tail edge) of the bag-shaped layer portion L3 has a high strength. Therefore, even if the pressure at the tail edge of the bag-shaped layer portion L3 rises when scavenging the PMs on the downstream side, there is no possibility where the fracture and damage occur in the tail edge portion because of ensuring the high strength at this tail edge portion.

Namely, if structured so that the particulate filter 1E is attached to the exhaust system in the state where the large-diameter portion of the truncated cone-shaped multi-layer body 3E is disposed downstream of the exhaust system, the stress applied on the outermost peripheral layer of non-woven fabric 11E of the multi-layer body 3E becomes compression stress due to the pressure of the exhaust gas. By contrast, if attached to the upstream side, the stress applied on the non-woven fabric 11E becomes a tensile stress. It was known from the tests performed by the present inventors that the non-woven fabric 11E has a compression intensity larger than a tensile intensity, and the structure described above is capable of enhancing the durability against the pressure of the exhaust gas.

Figure 29:
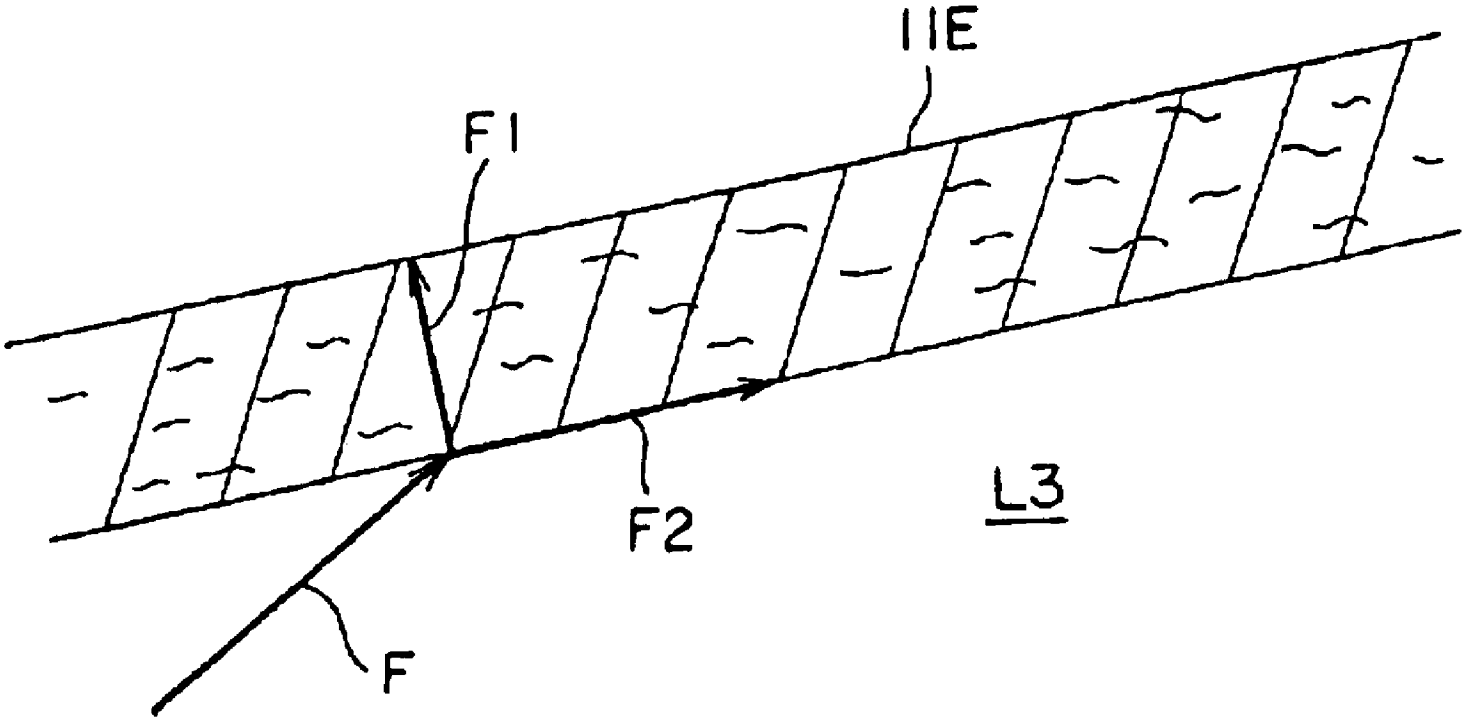
FIG. 29 is an enlarged view showing the principal portions of the non-woven fabric constituting a truncated cone-shaped multi-layer body.

Further, the bag-shaped layer portion has the fan-shaped inclined surface 60, and therefore, as shown in FIG. 29, a flowing force F of the exhaust gas impinging obliquely upon the inclined surface 60 is decomposed into a component force (vertical component force) F1 vertical to a thickness-wise direction of the bag-shaped layer portion L3, and a component force (parallel component force) F2 parallel to the surface of the bag-shaped layer portion.

On the other hand, as discussed above, if the multi-layer body is cylindrical, the exhaust gas flowing in parallel to the longitudinal direction of the bag-shaped layer portion impinges mainly upon the tail edge portion of the bag-shaped layer portion, and the PM is gradually scavenged by the non-woven fabric 11 but can hardly be scavenged at the portions (especially the upstream side) other than the tail edge portion of the non-woven fabric 11 constituting the bag-shaped layer portion.

In contrast with this, in the particulate filter 1E in the sixth embodiment, however, the bag-shaped layer portion L3 includes the fan-shaped inclined surface 60, and hence the flowing force F of the exhaust gas impinging on the non-woven fabric 11E is decomposed into the vertical component force F1 and the parallel component force F2, and the exhaust gas flows through within the non-woven fabric 11E by dint of action of the vertical component force F1. Therefore, the PMs can be scavenged substantially uniformly over the whole non-woven fabric 11E, whereby the clogging at the tail edge of the bag-shaped layer portion L3 can be prevented highly effectively.

If the clogging occurs in concentration on one portion such as the tail edge of the bag-shaped layer portion, the number of the recycling processes of the particulate filter must be increased. The particulate filter 1E in the sixth embodiment is, however, as described above, capable of scavenging the PMs substantially uniformly over the non-woven fabric 1E, and it is therefore possible to reduce the frequency of executing the recycling process of the particulate filter 1E as seen on the graph line in the fifth embodiment shown in FIG. 26.

Note that the non-woven fabric 11E may be configured such that the plural sheets of non-woven fabrics 11, 11, . . . each having the different void ratio are layered integrally into one sheet of non-woven fabric taking the multi-layered structure as in the case of the non-woven fabric 11A in the fifth embodiment, and may also be configured as the non-woven fabric taking the mono-layered structure shown in FIG. 27 so that the void ratio thereof gradually decreases from the inlet side of the exhaust gas towards the outlet side of the exhaust gas within the non-woven fabric 11. It is feasible to exemplify the case where that the stepwise change in the void ratio in this case is set to gradually change within the range of 80% to 60% from the inlet side of the exhaust gas towards the outlet side of the exhaust gas.

<Seventh Embodiment>

Figure 30:
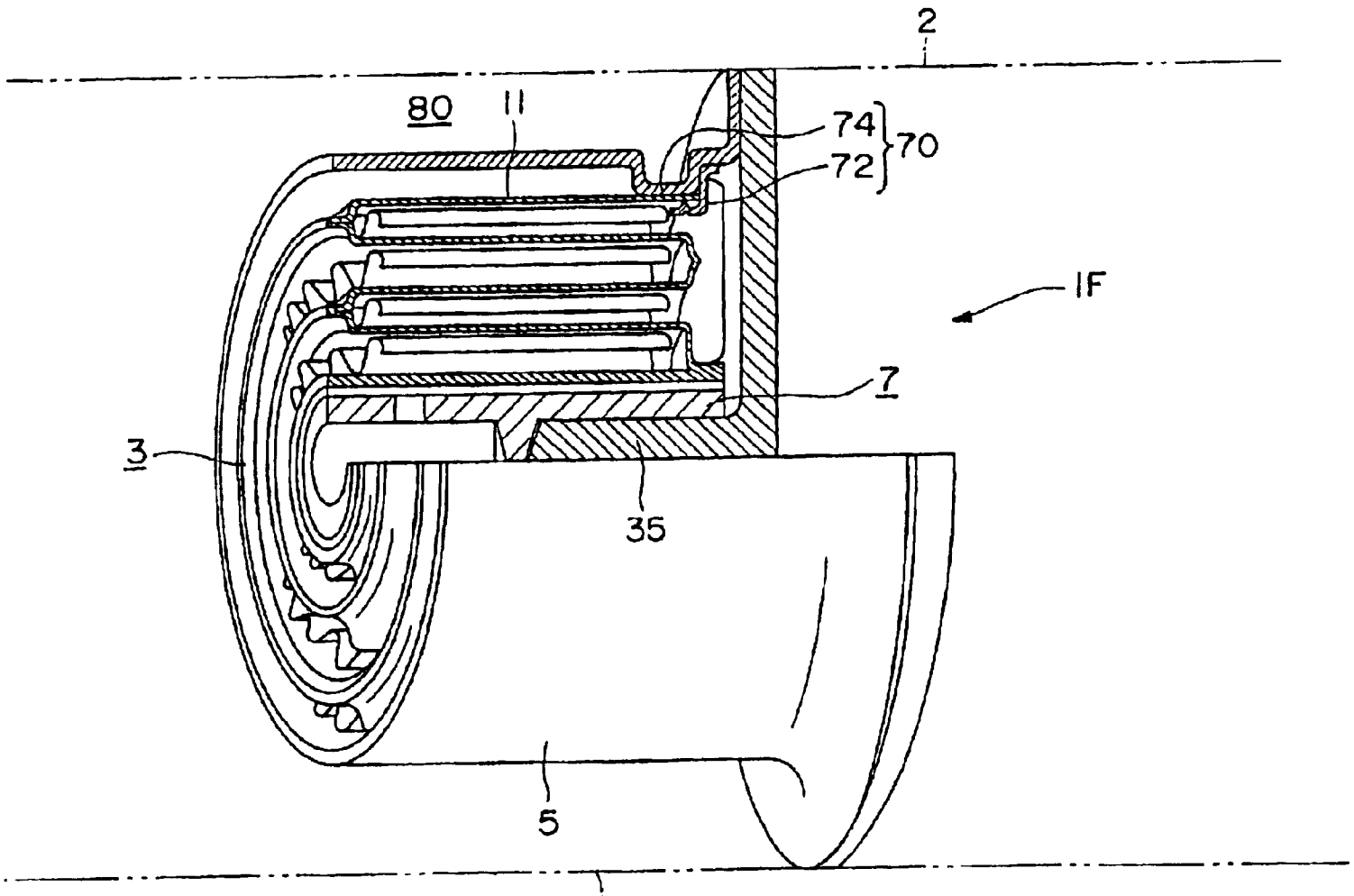
FIG. 30 is a perspective view with some portions cut away, showing the particulate filter in a seventh embodiment of the present invention.
Figure 31:
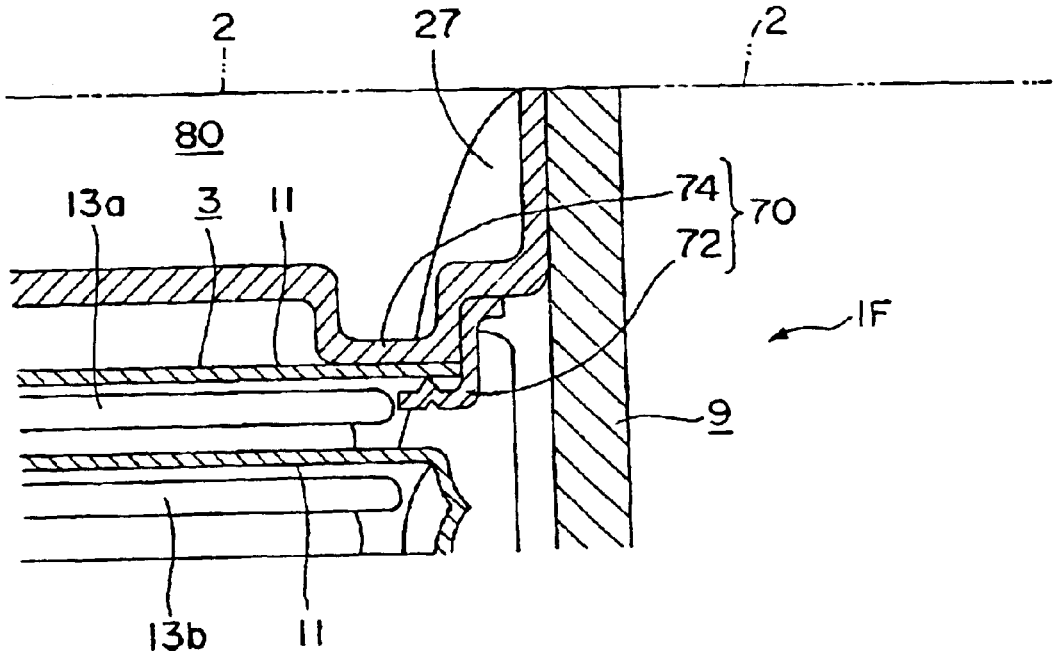
FIG. 31 is an enlarged view showing the principal portions in FIG. 30.

A seventh embodiment will next be explained with reference to FIGS. 30 and 31.

A different point of a particulate filter 1F in the seventh embodiment from the particulate filter 1A in the second embodiment (see FIGS. 8 and 9) discussed above, is that a supporting member 70 for supporting the multi-layer body 3 is provided at the opening edge of one side end of the heat resistant container, as a substitute for the plate-like elastic member 39. Hence, the same components as those of the particulate filter 1A in the second embodiment are marked with the same numerals, and their repetitive explanations are omitted.

The supporting member 70 includes a holding piece 72 for supporting the non-woven fabric 11 disposed outermost corresponding to the outer peripheral edge of the multi-layer body 3 in a way that sandwiches the non-woven fabric 11 in between a groove 74 taking a recessed shape in cross-section and the holding piece 72 itself.

Note that the supporting member 70 is not limited to what is exemplified in the seventh embodiment is provided not for the purpose of fixing the multi-layer body 3 unmovable to the metal container 5 but for the purpose of obviating the clogging in the non-woven fabric 11 by shaking off the ashes adhered to the multi-layer body 3 in a way that vibrates the multi-layer body 3 with the vibrations such as pulses and so on. Hence, any kinds of supporting members exhibiting the operational effect described above may be, as a matter of course, used.

Therefore, according to the thus configured particulate filter 1F in the seventh embodiment, as in the case of the particulate filter 1A in the second embodiment (see FIGS. 8 and 9), when the vibrations caused by the fluctuations in pressure with the exhaust pulses, which may be defined as the periodical vibrations caused by the external force, are transferred, the cylindrical multi-layer body 3 including the axial core 7 vibrates in the metal container 5, and hence, if the ashes are deposited on the non-woven fabric 11 of the cylindrical multi-layer body 3, the ashes are shaken off, thereby obviating the clogging in the non-woven fabric 11 defined as the constructive member of the cylindrical multi-layer body 3. Hence, the incombustible ashes can be removed from the particulate filter 1F.

Further, the supporting member 70 can be applied also to other embodiments described above.

<Eighth Embodiment>

Figure 32:
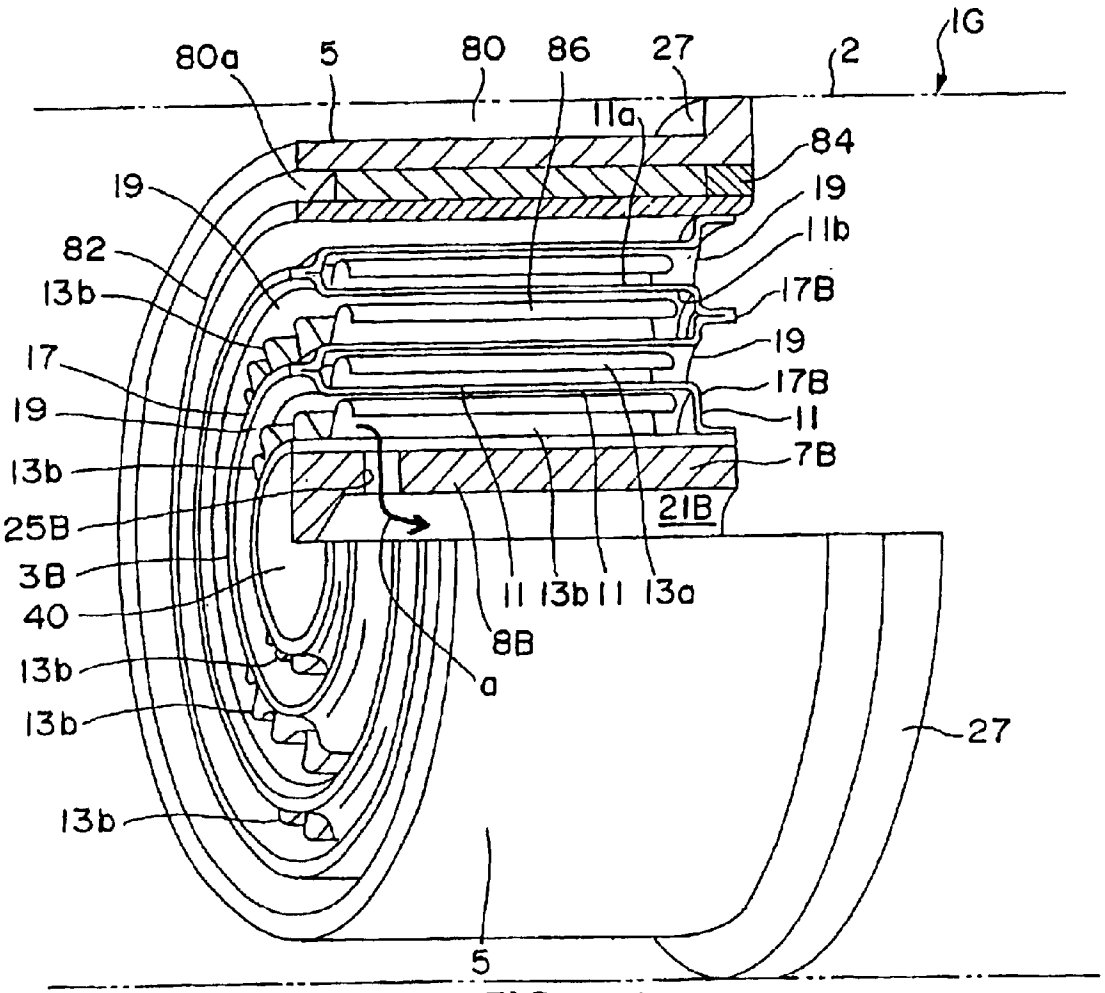
FIG. 32 is a perspective view with some portions cut away, showing the particulate filter in an eighth embodiment of the present invention.

An eighth embodiment of the present invention will hereinafter be described referring to FIG. 32.

A different point of a particulate filter 1G in the eighth embodiment from the particulate filter 1B in the third embodiment is that, for forming a separate adiabatic space other than the adiabatic space on an inner peripheral side of the metal container 5, the cylindrical multi-layer body 3B is inserted into the metal container 5, and a cylindrical member 82 composed of a heat resisting metal is loosely fitted to the metal container 5, and a reinforced member 86 is inserted into this separate adiabatic space. The above different point includes some other portions related to this separate adiabatic space.

This separate adiabatic space is indicated by the symbol 80*a*. Further, the downstream-sided end of the adiabatic space 80*a* is sealed by a sealing 84 so that the exhaust gas is not discharged directly into the atmospheric air. Note that the sealing 84 also functions to join the cylindrical member 82 to the metal container 5.

Hence, the discussion will be focused on the different components, and the same other components are marked with the same symbols as those used in the third embodiment, and their repetitive explanations are omitted.

A size of the adiabatic space 80*a* is determined by a dimensional difference between an outside diameter of the cylindrical member 82 and an inside diameter of the metal container 5. Hence, the particulate filter 1G has a two-tiered adiabatic space structure on the whole containing the adiabatic spaces 80 and 80*a*. Namely, the particulate filter 1G has both of the adiabatic space 80*a* formed between the cylindrical multi-layer body and the heat resistant container and the adiabatic space 80 formed between the heat resistant container and the exhaust pipe.

Further, the cylindrical member 82 is thick enough to support the cylindrical multi-layer body 3B. Then, it is desirable that a thermal capacity there of be as small as possible, and, according to the tests performed by the present inventors, it is considered preferable that a thickness dimension thereof falls within a range of 0.2 to 2 mm.

The following proved as a result of comparing the durability and the heat resistance between the prior art and the eighth embodiment of the present invention. The thermal stress occurred on the non-woven fabric in relation to a temperature distribution within the cylindrical multi-layer body when burning the PMs, is $4N/mm^2$ at 100° C. in the particulate filter described in the first embodiment, while in the eighth embodiment it is $2N/mm^2$ at 50° C. because of having the two-tiered adiabatic spaces 80, 80*a*.

Then, with these numerical values ensured, the eighth embodiment is more preferable in terms of preventing the heat diffusion into the atmospheric air and restraining the thermal stress.

Moreover, it is preferable that the reinforced member 86 be composed of a tree-dimensional metal porous member, wire-netting, a metal non-woven fabric, a corrugated sheet, a metal sheet taking an elongate rectangular shape and a punching metal each having a material filling rate of 30% or less in order not to deteriorate the adiabatic property of the adiabatic space 80*a*.

As a result of inserting the reinforced member 86 into the adiabatic space 80*a*, the thermal stress occurred on the non-woven fabric in relation to the temperature distribution within the cylindrical multi-layer body can be restrained down to $2N/mm^2$ at 50° C. Further, according to a vibration durability test in which a load on the order of 50G is applied at 700° C., there is obtained such excellent vibration durability that no damage is seen even when the load is applied 10,000,000 times repeatedly.

Namely, the cylindrical multi-layer 3B can be supported in the axial direction by inserting the reinforced member into the adiabatic space 80*a*, thereby increasing the stability of the cylindrical multi-layer body 3B and improving the durability against the vibrations.

Moreover, the occurrence of the thermal stress is restrained by equalizing the thermal capacities per volume of the reinforced member 86, the cylindrical member 82 and the cylindrical multi-layer body 3B, and it can be further expected that the durability is improved.

<Ninth Embodiment>

Figure 33:
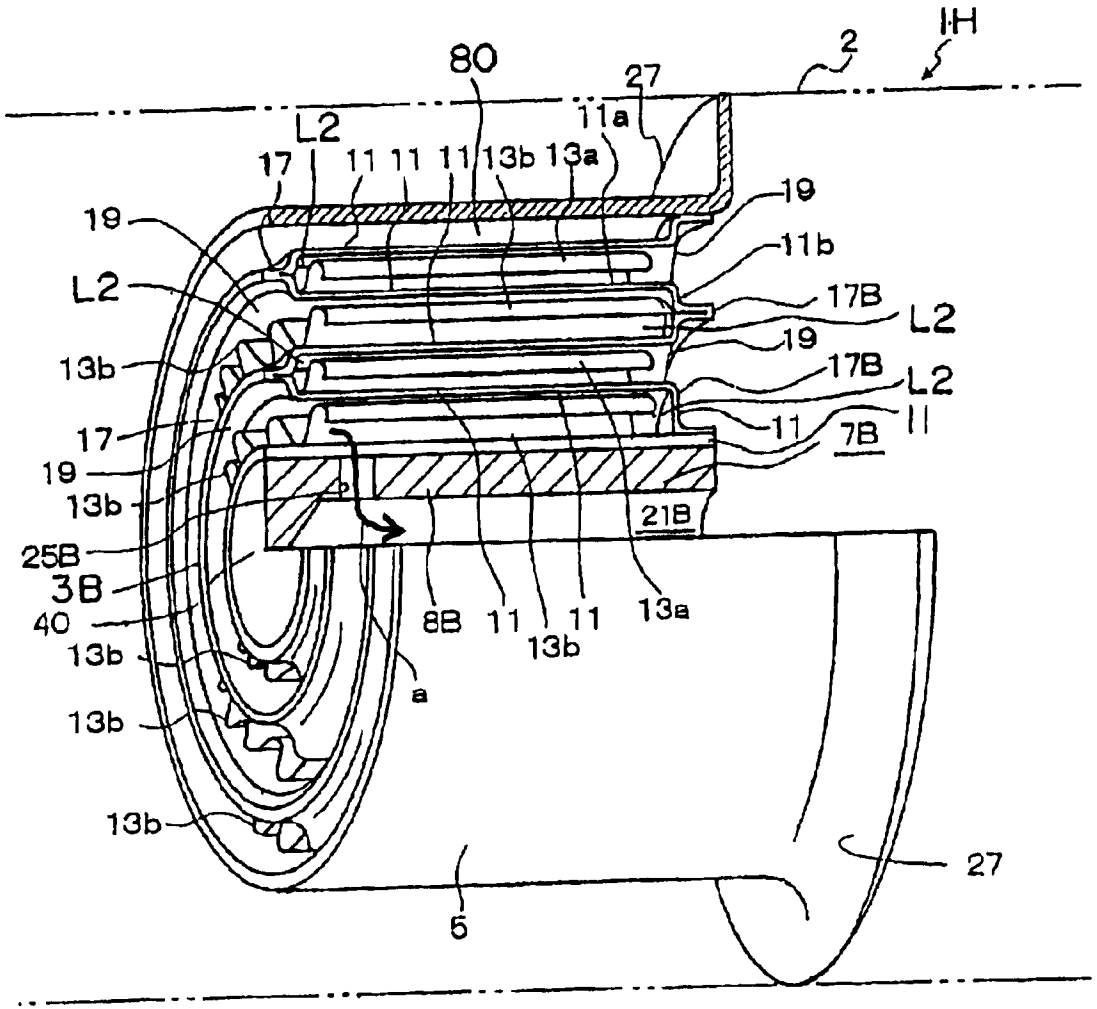
FIG. 33 is a perspective view with some portions cut away, showing the particulate filter in a ninth embodiment of the present invention.
Figure 34:
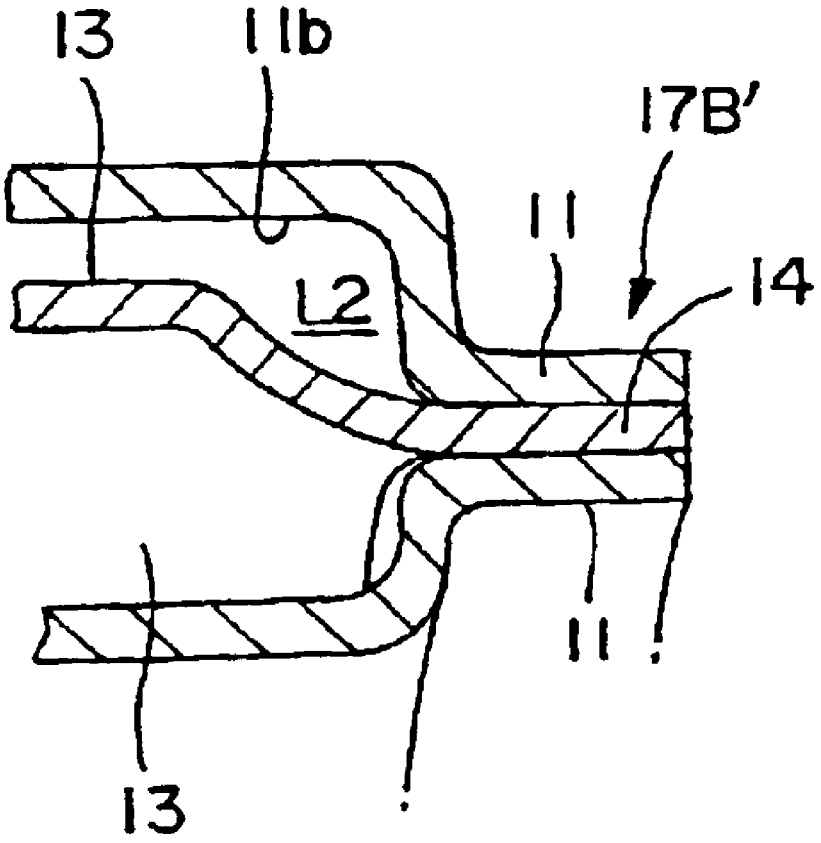
FIG. 34 is an enlarged view showing the principal portions in FIG. 33.

A ninth embodiment of the present invention will be described referring to FIGS. 33 and 34.

A different point of a particulate filter 1H in the ninth embodiment from the particulate filter 1B in the third embodiment, is that a sealing portion 17B' is formed by sandwiching a side end portion 14 of the corrugated sheet 13 in between one side ends of the non-woven fabrics 11 and integrally welding them in this state.

Hence, the discussion will be focused on this different portion, and the same other components are marked with the same symbols as those shown in the third embodiment, and the repetitive explanations are omitted.

Namely, the sealing portion 17B is formed merely by welding one side ends of the couple of non-woven fabrics 11 adjacent to each other. The sealing portion 17B' is, however, as shown in FIG. 34, formed my sandwiching the axial side end portion 14 of the corrugated sheet 13 in between one side ends of the non-woven fabrics 11 and integrally welding them in this state.

If combined in this way, the corrugated sheet 13 can receive the axial stress occurred on the non-woven fabric 11, and it is therefore feasible to improve the rigidity of the cylindrical multi-layer body 3B and prevent the cylindrical multi-layer body from deviating downstream and protruding by the pressure of the exhaust gas. Further, the corrugated sheet receives the stress occurred by the pressure of the exhaust gas and applied on the non-woven fabric 11, and hence the welding of the sealing portion on the downstream side can be prevented from being taken off. Note that the axial side end portion 14 welded to the non-woven fabric 11 in this case be, it is required, of course formed flat with no ruggedness in terms of facilitating the welding operation.

Incidentally, the axial side end portion 14 formed flat may include a plurality of notches (not shown) previously formed at a proper interval in the winding direction of the multi-layer member and extending in the axial direction, whereby the flat axial side end portion 14 can be ensured without any obstacle against the corrugated sheet even when the corrugated sheet 13 is wound on the axial core 7.

Further, the corrugated sheet 13 is, though originally corrugated, formed with the notches, thereby yielding such an advantage that the axial side end portion 14 of the corrugated sheet 13 can be easily flattened by said press.

MODIFIED EXAMPLE

Further, a plurality the through-holes are, though not illustrated, formed in one side end portion of a cylindrical metal container with its one side end closed and the other side end opened, and the cylindrical multi-layer body is inserted into this container, thereby configuring the particulate filter. When this particulate filter is installed in the engine exhaust passageway, it can be considered that the particulate filter is attached so that the closed side end of the cylindrical container is directed downstream of the engine exhaust passageway.

In this case, even when the central portion of the cylindrical multi-layer body of the particulate filter is thrust towards the downstream side by the pressure caused by the exhaust pulses and so on, the closed side end becomes a hindrance and thus restrains the movement of the axial core. Hence, the cylindrical multi-layer body neither protrudes from the cylindrical container nor gets deformed and fractured, and the damage to the particulate filter can be prevented.

Moreover, the closed side end is, though closed, formed with the plurality of through-holes, and therefore the exhaust gas does not stagnate.

Note that the closed side end serves as an axial core movement preventing means in this case.

The particulate filter described above is classified into a separation type in which the particulate filter is provided in each of branch pipes of an exhaust manifold as an exhaust collective pipe so as to correspond to each cylinder, and a collective type in which the particulate filter comparatively larger than the separation type is disposed at a portion, on the upstream side in the vicinity of an unillustrated catalyst converter, of the exhaust pipe 2 of the internal combustion engine. A determination about which type is selected or whether the separation type and the collective type are combined, may be made for a proper use corresponding to an engine displacement, and a type and an application of the vehicle mounted with the engine.

Note that the separation type may involve a case where the respective particulate filters communicate with each other via a connection pipe, and a case of making the particulate filters non-communicative by use of no connection pipe. In this case also, it is preferable that the particulate filter be properly applied according to the necessity.

Further, the non-woven fabrics and the axial cores exemplified in the respective embodiments take different modes and may be, without being limited to the combinations thereof in the respective embodiments, properly combined with the non-woven fabrics and the axial cores on other embodiments.

As discussed above, the particulate filter according to the present invention exhibits, for instance, the following effects:

The particulate filter can be prevented from being damaged.

↵# The ashes can be removed from the particulate filter without by burning.

↵# The welding to the non-woven fabric for forming the sealing can be simplified.

↵# The operability can be enhanced by facilitating the insertion of the multi-layer body into the heat resistant container.

↵# If the PMs such as the soot are accumulated o the particulate filter, the number of the recycling processes can be reduced.

↵# The durability of the particulate filter can be improved.

Industrial Applicability

As discussed above, the particulate filter according to the present invention is used in the exhaust system of, e.g., a diesel engine and suitable for scavenging the particulate matters typified by the soot categorized as the suspended particulate matters contained in the exhaust gas.

What is claimed is:

1. A particulate filter, comprising:

an axial core composed of a heat resisting metal;

a multi-layer body formed by winding the axial core with a multi-layer member into which a non-woven fabric and a corrugated sheet each composed of a heat resisting metal are tiered;

a heat resisting container charged with the multi-layer body; and a heat resistant axial core movement preventing means for preventing the axial core from moving in the axial direction within the heat resisting container.

2. A particulate filter according to claim 1, wherein the multi-layer body takes a cylindrical shape, of which two side ends are formed alternately with a sealing portion for sealing leading edges of the non-woven fabrics adjacent to each other and a non-sealing portion opened in the radial direction, and with the sealing and non-sealing portions ensured, a bag-shaped layer portion with its one side end closed and the other side end opened is formed.

3. A particulate filter according to claim 1, wherein the axial core movement preventing means is a connection member for fixedly connecting the heat resisting container to the axial core of the multi-layer body.

4. A particulate filter according to claim 1, wherein the heat resisting container is a container of which two side ends are opened, and the connection member is fitted to an opening at one side end of the heat resisting container and includes a ring portion facing to an opening edge of the one side end of the heat resisting container, a boss portion facing to the axial core of the multi-layer body, and arm portions connecting the ring portion to the boss portion and facing to portions excluding the axial core with respect to the multi-layer body.

5. A particulate filter according to claim 4, wherein the boss portion includes a joining portion joining said boss portion to said axial core.

6. A particulate filter according to claim 4, wherein the arm portion takes a rectilinear shape.

7. A particulate filter according to claim 4, wherein the arm portion takes a curvilinear shape.

8. A particulate filter according to claim 5, wherein the particulate filter is installed in an exhaust system of an internal combustion engine and used as a scavenger for scavenging mainly particulate matters contained in the exhaust gas, the axial core has a hollow of which two side ends are opened, the hollow containing a partition wall for partitioning the hollow into two, when the particulate filter is installed in the engine exhaust system, the partition wall partitions the hollow into an upstream-sided hollow opened upstream of the exhaust system but closed downstream of the exhaust system, and a downstream-sided hollow opened downstream but closed upstream, the joining portion serves as a fitting shaft fitted into the downstream-sided hollow, and a substantial lengthwise dimension of the fitting shaft is set somewhat larger than a lengthwise dimension of the downstream-sided hollow, the fitting shaft and the axial core are composed of separate members each having a different elasticity, and a gap is formed between the heat resisting container and the connection member due to a dimensional difference between the lengthwise dimension of the fitting shaft and the lengthwise dimension of the downstream-sided hollow when the fitting shaft is fitted into the downstream-sided hollow.

9. A particulate filter according to claim 8, wherein a plate-like elastic member is interposed in the gap.

10. A particulate filter according to claim 1, wherein when installed in the exhaust system of the internal combustion engine, the axial core is formed with a hollow opened upstream and extending downstream in the axial direction, and a through-hole formed through a peripheral wall of the axial core and communicating with the hollow and the multi-layer member along the axial core, and the axial core is thereby provided with the axial core movement preventing means.

11. A particulate filter according to claim 10, wherein the through-hole is an oblique hole formed obliquely in the axial core in a way that extends from an upstream side of the engine exhaust system toward a downstream side of the engine exhaust system, and an upstream-sided opening of the through-hole is disposed on a side of the hollow, and a downstream-sided opening of the through-hole is disposed on a side of the multi-layer member wound on the axial core.

12. A particulate filter, comprising:

an axial core composed of a heat resisting metal;

a multi-layer body formed in a cylindrical shape by winding the axial core with a multi-layer member into which a non-woven fabric and a corrugated sheet each composed of a heat resisting metal are layered; and a heat resisting container charged with the cylindrical multi-layer body, wherein when installed in an exhaust system of an internal combustion engine, the axial core is formed with a hollow opened downstream of the axial core and extending upstream in an axial direction, and a through-hole formed through a peripheral wall of the axial core and communicating with the hollow and the multi-layer member along the axial core.

13. A particulate filter according to claim 12, wherein the through-hole is an oblique hole formed obliquely in the axial core in a way that extends from an upstream side of the engine exhaust system toward a downstream side of the engine exhaust system, and an upstream-sided opening of the through-hole is disposed on a side of the multi-layer member wound on the axial core, and a downstream-sided opening of the through-hole is disposed on a side of the hollow.

14. A particulate filter according to claim 10, wherein a rate at which a diameter of the axial core occupies a diameter of the multi-layer body is within a range of 15 to 27%.

15. A particulate filter comprising:

an axial core composed of a heat resisting metal;

a multi-layer body formed by winding the axial core with a multi-layer member into which a non-woven fabric and a corrugated sheet, each composed of a heat resisting metal, are tiered;

a heat resisting container charged with the multi-layer body, and a heat resistant axial core movement preventing means for preventing the axial core from moving in the axial direction within the heat resisting container, wherein the multi-layer member has the corrugated sheets disposed on one surface of said non-woven fabric folded double in a widthwise direction so as to take a folded shape and at a portion between the folded surfaces.

16. A particulate filter according to claim 15, wherein the particulate filter is installed in an exhaust system of an internal combustion engine and used as a scavenger for scavenging mainly particulate matters contained in the exhaust gas, and is also installed in the engine exhaust system in a state where creases of the folded non-woven fabric are directed downstream of the engine exhaust system.

17. A particulate filter according to claim 16, wherein a bag-shaped layer portion with its one side end closed and its other side end opened is formed by alternately forming a sealing portion for sealing leading edges of the non-woven fabrics adjacent to each other in a radial direction on one side end side of the multi-layer member and a non-sealing portion opened.

18. A particulate filter according to claim 1, wherein the particulate filter is installed in an exhaust system of an internal combustion engine and used as a scavenger for scavenging mainly particulate matters contained in the exhaust gas, and, a flow-past hole that lets the exhaust gas through is formed at a downstream-sided end of a narrower passageway than other passageways within the particulate filter through which the exhaust gas flows.

19. A particulate filter according to claim 18, wherein the narrow passageway is filled with a porous substance having a void ratio at which the particulate matters can be scavenged.

20. A particulate filter, comprising:

an axial core composed of a heat resisting metal;

a multi-layer body formed in a truncated cone shape by winding the axial core with a multi-layer member into which a non-woven fabric and a corrugated sheet, each composed of a heat resisting metal, are tiered; and a heat resisting container charged with the multi-layer body taking the truncated cone shape.

21. A particulate filter according to claim 20, wherein the truncated cone-shaped multi-layer body has its two side ends formed alternately with a sealing portion for sealing leading edges of said non-woven fabrics adjacent to each other and a non-sealing portion opened in a radial direction, with the sealing and non-sealing portions ensured, a bag-shaped layer portion with its one side end closed and the other side end opened, having a inclined surface taking a fan shape from the closed side towards the opened side, and the corrugated sheet is disposed in a fan-shape corresponding to the fan-shaped inclined surface within the layer portion.

22. A particulate filter according to claim 21, wherein the particulate filter is attached to the exhaust system in a state where a large-diameter portion of the truncated cone-shaped multi-layer body is positioned downstream of the exhaust system.

23. A particulate filter according to claim 2, wherein plural sheets of non-woven fabrics each having a different void ratio are layered integrally into one sheet of non-woven fabric having a multi-layered structure; the said multi-layer body is composed of the non-woven fabric and the corrugated sheet; and the non-woven fabric, having the multi-layered structure with respect to the bag-shaped layer portion defined as a constructive member of the multi-layer body, is formed so that a void ratio of the single non-woven fabric decreases stepwise from the single non-woven fabric disposed on an inlet side of the exhaust gas towards the single non-woven fabric disposed on an outlet side of the exhaust gas.

24. A particulate filter according to claim 1, wherein the non-woven fabric is formed so that a line diameter of the metal fiber constituting the non-woven fabric is set within a range of 10 to 50 $\mu$m, and a void ratio, defined as a capacity rate of the gaps contained therein with respect to a unit volume of the non-woven fabric, is set to any of the void ratios within a range of 50 to 85%.

25. A particulate filter according to claim 23, wherein the stepwise change in the void ratio is set within a range of 80 to 60%.

26. A particulate filter according to claim 24, wherein a thicknesswise dimension of the non-woven fabric is within a range of 0.2 to 1.0 mm.

27. A particulate filter according to claim 2, wherein two sheets of non-woven fabrics each having a different void ratio are layered integrally into one sheet of non-woven fabric having a two-layer structure; the multi-layer body is composed of the non-woven fabric and the corrugated sheet; and the non-woven fabric, having the two-layered structure with respect to the bag-shaped layer portion defined as a constructive member of the multi-layer body, is formed so that a void ratio of the non-woven fabric disposed on the inlet side of the exhaust gas is larger than a void ratio of the non-woven fabric disposed on the outlet side of the exhaust gas.

28. A particulate filter according to claim 27, wherein the void ratios of the non-woven fabrics disposed on the inlet and outlet sides of the exhaust gas are set to 80% and 60%, respectively.

29. A particulate filter according to claim 2, wherein the non-woven fabric takes an integral hierarchical structure of which the void ratio changes stepwise, the multi-layer body is composed of the non-woven fabric and the corrugated sheet, and the non-woven fabric with respect to the bag-shaped layer portion, defined as a constructive member of said multi-layer body, is formed so that the void ratio gradually decreases from the inlet side of the exhaust gas towards the outlet side of the exhaust gas.

30. A particulate filter according to claim 29, wherein the void ratio changes so as to gradually decrease within a range of 80% to 60%.

31. A particulate filter according to claim 1, wherein an opening edge of one side end of the heat resisting container, charged with said multi-layer body, is provided with a supporting member for supporting the multi-layer body in the heat resisting container.

32. A particulate filter according to claim 31, wherein the supporting member includes a holding piece for supporting an outer peripheral edge of the multi-layer body in a state where the outer peripheral edge is sandwiched in between the heat resisting container and the holding piece itself.

33. A particulate filter according to claim 1, wherein the particulate filter is installed in an exhaust collective pipe.

34. A particulate filter according to claim 1, wherein the particulate filter is installed in an exhaust pipe, and an adiabatic space is provided between the exhaust pipe and the multi-layer body.

35. A particulate filter according to claim 34, wherein the cylindrical multi-layer body is inserted into a cylindrical member composed of a heat resisting metal, and an adiabatic space is provided between the cylindrical member and the heat resisting container.

36. A particulate filter according to claim 35, wherein a reinforced member is inserted into the adiabatic space.

37. A particulate filter according to claim 1, wherein the multi-layer body is formed by joining the non-woven fabric and the corrugated sheet each defined as a constructive member of the multi-layer body.

38. A particulate filter according to claim 37, wherein the non-woven fabric and the corrugated sheet are joined by diffusion joining.

39. A particulate filter according to claim 4, wherein the arm portions are formed so that the arm portions face the portion formed of the multi-layer member of the cylindrical multi-layer body when the connection member is attached to the opening of one side end of the heat resisting container.

40. A particulate filter according to claim 1, wherein a sealing portion for sealing the leading edges of the non-woven fabrics adjacent to each other and a non-sealing portion opened are alternately formed at both side ends of the multi-layer member in the radial direction, and the non-woven fabric and the corrugated sheet are fixed in a state where an axial side end portion of the corrugated sheet is sandwiched in between the non-woven fabrics formed with the sealing portion.

41. A particulate filter according to claim 40, wherein the axial side end of the corrugated sheet takes a flat shape, and includes a plurality of notches formed at a proper interval in the winding direction of said multi-layer member and extending in the axial direction.

42. A particulate filter according to claim 1, wherein the axial core has a joining portion partially fixed by welding to the non-woven fabric, and a metal quantity per unit area of the axial core at this joining portion is substantially the same a metal quantity per unit capacity of the non-woven fabric.

* * * * *

UNITED STATES PATENT AND TRADEMARK OFFICE

CERTIFICATE OF CORRECTION

PATENT NO. : 6,776,815 B2
DATED : August 17, 2004
INVENTOR(S) : Zenichiro Kato et al.

It is certified that error appears in the above-identified patent and that said Letters Patent is hereby corrected as shown below:

Column 41,
Line 65, "A particulate filter according to claim 1" should read -- A particulate filter according to claim 3 --

Signed and Sealed this

First Day of February, 2005

JON W. DUDAS
*Director of the United States Patent and Trademark Office*